US011085750B2

(12) United States Patent
Feda

(10) Patent No.: US 11,085,750 B2
(45) Date of Patent: Aug. 10, 2021

(54) FUZE SETTER ADAPTER SYSTEMS AND TECHNIQUES

(71) Applicant: BAE Systems Information and Electronic Systems Integration Inc., Nashua, NH (US)

(72) Inventor: Francis M. Feda, Sudbury, MA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 16/960,811

(22) PCT Filed: Apr. 9, 2019

(86) PCT No.: PCT/US2019/026545
§ 371 (c)(1),
(2) Date: Jul. 8, 2020

(87) PCT Pub. No.: WO2019/199794
PCT Pub. Date: Oct. 17, 2019

(65) Prior Publication Data

US 2020/0348117 A1 Nov. 5, 2020

Related U.S. Application Data

(60) Provisional application No. 62/655,422, filed on Apr. 10, 2018.

(51) Int. Cl.
*F42C 17/04* (2006.01)

(52) U.S. Cl.
CPC ..... *F42C 17/04* (2013.01)

(58) Field of Classification Search
CPC ..... F42C 17/00; F42C 17/04
(Continued)

(56) References Cited

U.S. PATENT DOCUMENTS 5,109,185 A 4/1992 Ball
5,440,990 A 8/1995 Wiedefeld et al.
(Continued)

FOREIGN PATENT DOCUMENTS

EP 3097380 11/2016
WO 2018146457 8/2018

OTHER PUBLICATIONS

WB Parts. Fuze Setter Adapter Product Details, 2008.[retrieved on Jun. 6, 2019]. Retrieved from the Internet. <URL: https://www.wbparts.com/rfq/1290-01-567-5207.html>. entire document.
(Continued)

*Primary Examiner* — Reginald S Tillman, Jr.
(74) *Attorney, Agent, or Firm* — Scott J. Asmus; Sand, Sebolt & Wernow LPA

(57) ABSTRACT

Techniques and architecture are disclosed for a fuze setter adapter that operationally engages an incompatible fuze and fuze setter with each other so that fuze setting may be undertaken. The fuze and fuze setter each include at least one wireless or direct connect interface for electrical power transfer and/or data communications. The fuze setter adapter provides complementary interfaces configured to couple with the interfaces of the fuze and fuze setter. A processor control in the fuze setter adapter links the fuze setter adapter interfaces. The processor control is programmed to receive data communications from the fuze setter, convert those signals to fuze-compatible signals, and transfer the fuze-compatible signals to the fuze, and vice versa. The processor control is further programmed to receive electrical power from the fuze setter, convert that electrical power to fuze-compatible power, and transfer the fuze-compatible power to the fuze.

20 Claims, 43 Drawing Sheets

(58) Field of Classification Search
USPC ..... 89/6, 6.5
See application file for complete search history.

(56) References Cited

U.S. PATENT DOCUMENTS

| | | | | |
|---|---|---|---|---|
| 5,497,704 | A | 3/1996 | Kurschner et al. | |
| 6,557,450 | B1 | 5/2003 | Cox et al. | |
| 7,698,983 | B1 | 4/2010 | Pinto et al. | |
| 9,317,477 | B1 * | 4/2016 | Khuc | F42C 17/04 |
| 9,472,971 | B2 | 10/2016 | Soar | |
| 2005/0126379 | A1 | 6/2005 | Pikus et al. | |
| 2007/0246797 | A1 | 10/2007 | Pham et al. | |
| 2009/0217836 | A1 | 9/2009 | Dietrich et al. | |
| 2010/0058946 | A1 | 3/2010 | Geswender et al. | |
| 2014/0160944 | A1 | 6/2014 | Venkatesan et al. | |
| 2016/0341532 | A1 | 11/2016 | Owen et al. | |

OTHER PUBLICATIONS

International Search Report, PCT/US2019/026545, dated Jun. 25, 2019, 7 pages.
International Search Report, PCT/US2019/014682, dated Jun. 25, 2019, 9 pages.
Fuze Setter Interface for Powering and Programming a Fuze on a Guided Projectile, U.S. Appl. No. 16/294,505, filed Mar. 6, 2019.
Fuze Setting Systems and Techniques, U.S. Appl. No. 16/605,450, filed Oct. 15, 2019.
International Search Report, PCT/US20/20798, dated Jun. 10, 2020, 11 pages.

* cited by examiner

FUZE SETTER ADAPTER SYSTEMS AND TECHNIQUES

TECHNICAL FIELD

The following disclosure relates generally to fuze setting systems and, in particular, to a fuze setter adapter utilized to operatively engage a fuze with an incompatible fuze setter and enable communication between the fuze and incompatible fuze setter so that fuze setting is able to occur.

BACKGROUND

Artillery fuzes are typically attached to a leading end of an artillery projectile prior to launch from a gun platform. Fuze setting is the process of quickly programming targeting and other data into artillery fuzes. Fuze setting has to occur prior to launch and is typically accomplished by engaging the fuze with a fuze setter. The fuze setter may be part of an autoloader system used to automatically load artillery projectiles into the gun platform while minimizing the need for operator intervention. Alternatively, the fuze setter may be a handheld device that is brought into engagement with the nose of the artillery fuze.

Legacy fuze setters for artillery fuzes have used inductive coupling-based communications and power transfer interfaces to transfer targeting and other information to legacy fuzes prior to launch. Electrical power has also been transferred from the legacy fuze setter to the legacy fuze during fuze setting. "Next generation" artillery fuzes, i.e., artillery fuzes with precision guidance capability that can correct for firing errors and steer the projectile to a desired target impact point, require larger amounts of data to be transferred to them during fuze setting. Interfaces on legacy fuze setters are too slow to transfer the quantity of data necessary to next generation fuzes in the short time available for the fuze setting process prior to launch. Additionally, next generation fuzes may incorporate a different high speed interface that is not backwards compatible with legacy inductive fuze setters. This incompatibility between the legacy fuze setters and the next generation fuzes typically prevents next generation fuzes from being programmed by legacy fuze setters, even if the slower data transfer can be tolerated. Legacy fuzes and next generation fuze setters are also incompatible for similar reasons and this incompatibility prevents legacy fuzes from being programmed by next generation fuze setters. This situation is problematic because there are significant existing inventories of legacy fuze setters that cannot be used to program next generation fuzes and, conversely, inventories of legacy fuzes that cannot be programmed using next generation fuze setters.

Different types of next generation fuzes and next generation fuze setters may also be incompatible because they use different components to transfer electrical power and data signals.

SUMMARY

The present disclosure is directed to a fuze setter adapter that is capable of mating with a fuze and a fuze setter which are typically incompatible with each other, and enabling a fuze setting operation to occur despite the inherent incompatibility between the fuze and fuze setter. Internal electronics in the fuze setter adapter supports data capture, storage, and reformatting as the communications protocols on either side of the fuze setter adapter may require. The fuze setter adapter also supports the ability to convert electrical power input from a legacy fuze setter into a form compatible with a next generation fuze. Power for the fuze setter adapter may be derived from the fuze setter, thereby avoiding the need for a separate power supply for the fuze setter adapter.

A first exemplary fuze setter adapter is disclosed herein that provides both an inductive communications interface and a direct connect power interface. The first exemplary fuze setter adapter disclosed herein contains electronics capable of communicating with legacy fuze setters (via the inductive interface) and with the next generation fuze (via the direct connect interface). A second exemplary fuze setter adapter is disclosed herein that provides an inductive communications interface and an inductive power interface. The second exemplary fuze setter adapter disclosed herein contains electronics capable of communicating with legacy fuze setters and with the next generation fuze via two separate inductive interfaces.

An example embodiment of the present disclosure provides a system including a fuze having an interface; a fuze setter having an interface; and a fuze setter adapter configured to operatively communicate with both the fuze and the fuze setter, wherein the fuze setter adapter is mated to the fuze setter.

Particular implementations may include one or more of the following features. The system may further comprise a control element situated inside the fuze setter adapter, wherein the control element is configured to handle communications operations including data translation, data buffering other data manipulation operations as may be necessary, and communications operations between fuze setter and fuze, as well as electrical power conversion and distribution to the fuze. The control element may further comprise processor control capability. The interface of the fuze may be incompatible with the interface of the fuze setter.

Another example embodiment provides a system including a fuze having an interface and a fuze setter having an interface. There is a fuze setter adapter configured to operatively communicate with both the fuze and the fuze setter, wherein the fuze setter adapter is mated to the fuze setter. A locking mechanism may be provided to secure the fuze setter adapter to one or both of the fuze and fuze setter. A process control element is provided on the fuze setter adapter.

Particular implementations may include one or more of the following features. The interface of the fuze may be incompatible with the interface of the fuze setter. The interface to the fuze may be one or more of an electrical direct connect interface and a wireless interface, where the wireless interface may include one or more induction coils, optical transceivers, and radio frequency (RF) transceivers. In some examples, optical transceivers and RF transceivers are used for communications and inductive interfaces are used for electrical power transfer. The interface of the fuze may be an inductive communications interface, and it may be a direct connect communications interface, whereby direct connect refers to a direct electrical connection interface, or more broadly, a non-inductive interface. The interface of the fuze setter may be the inductive communications interface, and it may be the direct connect communications interface. The system may include a processor control capability.

In one aspect, an exemplary embodiment of the present disclosure may provide a method of fuze setting comprising engaging a fuze setter adapter between a fuze setter and a fuze, where the fuze setter and the fuze are incompatible with each other; establishing communication between the fuze setter adapter and both the fuze setter and the fuze;

transferring fuze setting data from the fuze setter to the fuze setter adapter; and transferring the fuze setting data from the fuze setter adapter to the fuze.

In one exemplary embodiment, the transferring of the fuze setting data from the fuze setter to the fuze setter adapter further comprises encoding the fuze setting data into waveforms; and transferring the waveforms of the encoded fuze setting data from the fuze setter to the fuze setter adapter. In one example, the method further comprises receiving the waveforms of the encoded fuze setting data; decoding the fuze setting data from the waveforms; encoding the decoded fuze setting data into a fuze-compatible format; and transferring the fuze-compatible format of the fuze setting data from the fuze setter adapter to the fuze. In one exemplary embodiment, the method includes transferring the waveforms of the encoded fuze setting data from the fuze setter to the fuze setter adapter via a first interface; and transferring the fuze-compatible format of the fuze setting data from the fuze setter adapter to the fuze via a second interface. In one example, the method includes utilizing one of a direct connect interface and a wireless interface as one or both of the first interface and the second interface.

In one exemplary embodiment, the method further comprises applying electrical power from the fuze setter to the fuze setter adapter; generating fuze-compatible electrical power; and applying the fuze-compatible electrical power to the fuze. In one example, one or both of applying of electrical power from the fuze setter to the fuze setter adapter and applying of the fuze-compatible electrical power occurs through utilizing one of a direct connect interface and a wireless interface.

In an exemplary embodiment, the method further comprises sending a discrete electrical signal from the fuze setter to the fuze setter adapter; converting the discrete electrical signal to a fuze-compatible format; and sending the converted discrete electrical signal from the fuze setter adapter to the fuze. In one example, the method further includes sending a fuze discrete electrical signal from the fuze to the fuze setter adapter; converting the fuze discrete electrical signal to a fuze-setter-compatible format; and sending the converted fuze discrete electrical signal from the fuze setter adapter to the fuze setter.

In one exemplary embodiment, the method further comprises engaging the fuze with the fuze setter adapter via a first mechanical interface; and engaging the fuze setter adapter with the fuze setter via a second mechanical interface. In one embodiment, the method further includes utilizing programming provided in a processor control of the fuze setter adapter to perform one or more of an electrical signal conversion, a communications conversion, and a communications translation on the fuze setting data prior to transferring the fuze setting data from the fuze setter adapter to the fuze.

In one aspect, an exemplary embodiment of the present disclosure may provide a fuze setting system comprising a fuze and a fuze setter; wherein the fuze and the fuze setter are incompatible in a way that prevents the fuze setter from performing a fuze setting operation on the fuze; and a fuze setter adapter configured to matingly engage and communicate with the fuze and the fuze setter such that the fuze setting operation is able to occur.

In another aspect, an exemplary embodiment of the present disclosure may provide a fuze setter adapter, comprising a first interface adapted to couple with a fuze; a second interface adapted to couple with a fuze setter, where the fuze setter is incompatible with the fuze; a processor control operatively engaged with the first interface and the second interface; wherein programming provided in the processor control establishes communication between the fuze and the fuze setter and enables fuze setting to occur.

In one exemplary embodiment, each of the first interface and the second interface is one or more of an electrical signal interface, an electrical power interface, and a communications interface. In one example, each of the first interface and the second interface is one or more of a wireless interface and a direct connect interface. In one example, the wireless interface is one of an inductive coil, a Radio Frequency (RF) transceiver, a Height of Burst (HoB) sensor, and an optical transceiver. In one example, the direct connect interface is one of a contact pad, a continuous contact ring, a segmented contact ring, and a contact pin. In one example, the fuze setter adapter includes a first mechanical interface adapted to engage the fuze; and a second mechanical interface adapted to engage the fuze setter.

In another aspect, an exemplary embodiment of the present disclosure may provide a fuze setting system, comprising a fuze adapted to be engaged with a projectile; a fuze setter; wherein the fuze and the fuze setter are incompatible in at least one way that prevents fuze setting; and a fuze setter adapter configured to matingly engage with the fuze and the fuze setter; said fuze setter adapter including a processor control that establishes communication between the fuze and the fuze setter such that fuze setting occurs.

In one example, the fuze setting system includes a fuze interface provided on the fuze; a fuze setter interface provided on the fuze setter; wherein the fuze interface and the fuze setter interface are incompatible; a first interface provided on the fuze setter adapter that couples with the fuze interface; and a second interface provided on the fuze setter adapter that couples with the fuze setter interface; and wherein the processor control is engaged with the first and second interface. In one example, the fuze interface, the fuze setter interface, the first interface, and the second interface are all electrical signal interfaces and the processor control enables bi-directional communication between the fuze setter and the fuze. In one example, the fuze interface, the fuze setter interface, the first interface, and the second interface are all electrical power interfaces; and the processor control enables electrical power to be transferred from the fuze setter to the fuze.

BRIEF DESCRIPTION OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
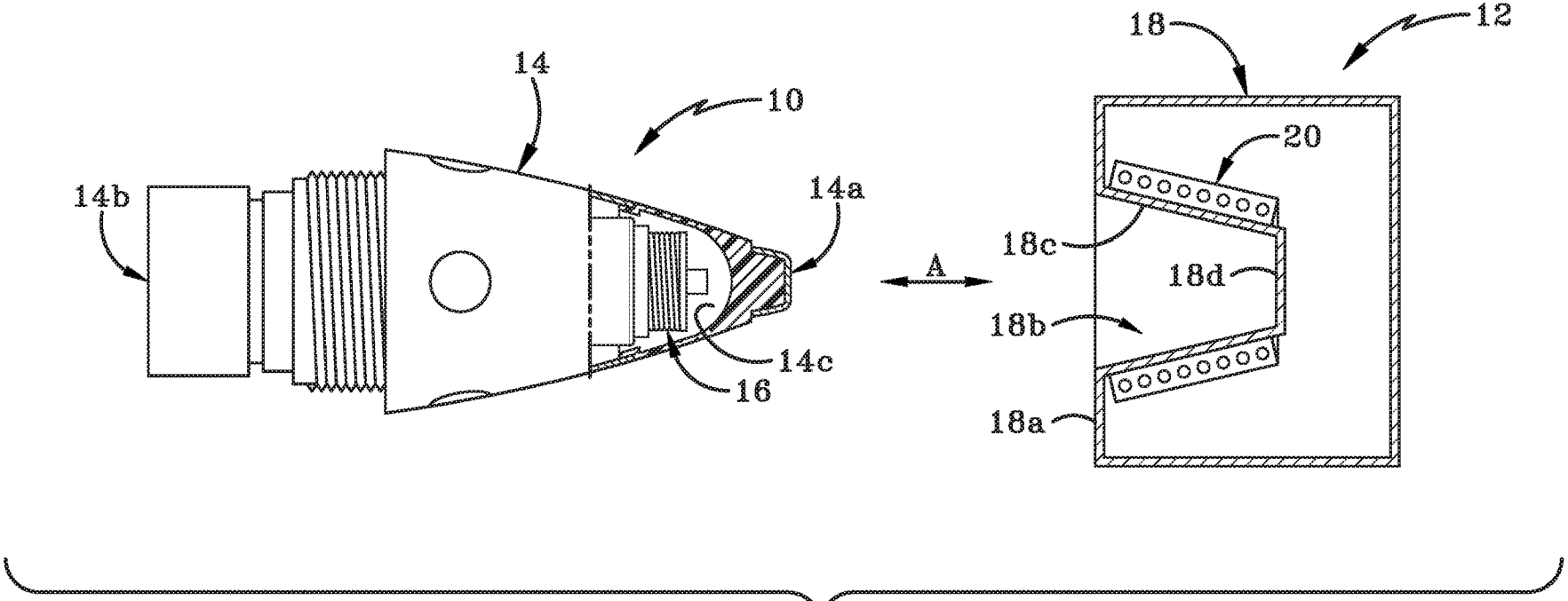
FIG. 1 PRIOR ART
FIG. 1 is a diagrammatic, partial side elevation, longitudinal section of a PRIOR ART legacy fuze and a compatible PRIOR ART legacy fuze setter.

FIG. 1 shows a fuze setting system that includes a PRIOR ART legacy fuze 10 and a PRIOR ART legacy fuze setter 12. The PRIOR ART legacy fuze 10 will be referred to hereafter as "LF 10" and the PRIOR ART legacy fuze setter will be referred to hereafter as "LFS 12". The system uses an inductive interface for communications and electrical power transfer between LF 10 and LFS 12. LFS 12 and LF 10 are compatible with each other and LFS 12 is able to be utilized to perform a fuze setting operation on LF 10.

LF 10 includes a housing 14 having a front end 14*a* and a rear end 14*b*. The housing 14 defines an, interior compartment 14*c*. A region of LF 10, including rear end 14*b*, is configured to be engaged with a projectile (not shown). A nose region of LF 10, including front end 14*a*, is tapered and configured to be engaged with a LFS 12. An inductive interface coil 16 is provided within compartment 14*c* of the nose region. It will be understood that coil 16 is operatively engaged with an electronic system provided on LF 10.

LFS 12 includes a housing 18 having a wall 18*a* with an opening to a chamber 18*b* defined therein. Chamber 18*b* is bounded and defined by an inwardly extending and tapered sidewall 18*c* and an end wall 18*d* and is shaped to receive the nose region of LF 10 therein. An inductive coil 20 is provided within LFS 12 with that coil 20 being located adjacent to interior wall 18*b*.

As indicated by the arrow "A", LF 10 is selectively inserted into chamber 18*b* of LFS 12. When LF 10 is received within chamber 18*b*, an inductive interface is formed via inductive coupling of inductive coil 16 and inductive coil 20. The inductive interface is utilized for communications and electrical power transfer between LFS 12 and LF 10. In particular, the inductive interface is used to alternately transfer communications and electrical power between LFS 12 and LF 10. Because of the alternating nature of the communications and electrical power transfer in this system, a relatively long time is required to transfer the necessary data and power from LFS 12 to LF 10.

LF 10 and LFS 12 are compatible with respect to a mechanical interface, i.e., the nose region of the LF 10 is complementary to the chamber 14*c* in LFS 12 and is able to be received therein. The inductive coil 16 in LF 10 inductive coil 20 in LFS 12 are configured to inductively couple and permit power and data to move from LFS 12 to LF 10. LFS 12 is sufficiently compatible with LF 10 to perform a fuze setting operation on LF 10.

Figure 2:
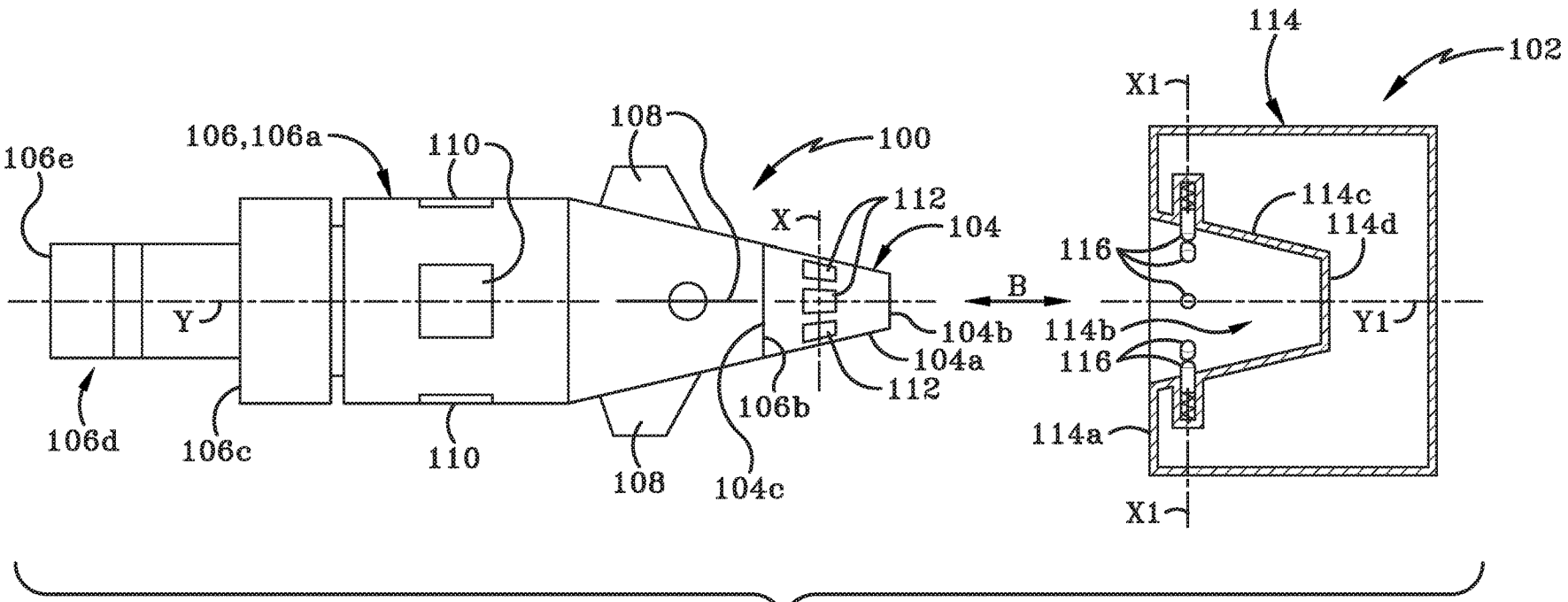
FIG. 2 is a diagrammatic, partial side elevation, longitudinal section of a first embodiment of a next generation fuze and a compatible next generation fuze setter.

"Next generation" fuzes and fuze setters, such as those illustrated in FIG. 2, transfer electrical power and communications differently from LS 10 and LFS 12. A number of next generation fuzes and next generation fuze setters are disclosed in PCT application number PCT/US2019/014682, filed Jan. 23, 2019, and in U.S. patent application Ser. No. 16/294,505 filed Mar. 6, 2019. In particular, a plurality of embodiments of direct connect next generation fuzes and fuze setters is disclosed in PCT/US2019/014682. These direct connect fuzes and fuze setters transfer electrical power and high speed communications and data through complementary electrical contacts provided on the fuze and fuze setter. With respect to the present disclosure, the fuzes illustrated in FIGS. 2 through 11 and FIG. 18A, and the fuze setter illustrated in FIGS. 17A through 17E, and FIG. 18B, are examples of next generation direct connect fuzes and fuze setters disclosed in PCT/US2019/014682.

U.S. Ser. No. 16/294,505 discloses a plurality of embodiments of next generation fuzes and fuze setters that communicate wirelessly, i.e., through induction coils, Radio Frequency (RF) transceivers, optical transceivers, and/or Height of Burst (HoB) sensors. These devices enable wireless transfer of electrical power as well as high speed communications and data. With respect to this disclosure, the fuzes illustrated in FIGS. 12A through 15 and the fuze setters illustrated in FIGS. 17F through 18A, are examples of next generation wireless fuzes and fuze setters disclosed in U.S. Ser. No. 16/294,505.

It should be understood that the direct connect next generation fuzes and next generation fuze setters, and the wireless next generation fuzes and next generation fuze setters illustrated and discussed herein are exemplary only and other, differently configured next generation fuzes and fuze setters may be utilized with the fuze setter adapter that is the subject of the present disclosure. Some details of the structure and functioning of the exemplary next generation fuzes and fuze setters is provided herein. For more complete information as to the structure and function of these next generation fuzes and fuze setters, the referenced PCT and US patent applications may be reviewed. In the following description, the term "next generation fuze" will be referred to hereafter by the acronym "NGF", the term "next generation fuze setter" will be referred to by the acronym "NGFS", and the term "fuze setter adapter" will be referred to herein by the acronym "FSA".

FIG. 2 is a side elevation view of a first embodiment of a NGF 100 and a first embodiment of a NGFS 102 that is compatible with NGF 100 and is typically used to perform a fuze setting operation on NGF 100. NGF 100 and NGFS 102 are exemplary of next generation fuzes and fuze setters that utilize an exemplary direct connect interface for communications and electrical power transfer.

NGF 100 includes a radome housing 104 and a fuze body 106 that are operatively engaged with each other. Radome housing 104 includes an exterior sidewall 104*a*, a front end 104*b*, and a rear end 104*c*. Sidewall 104*a* and front end 104*b* bound and define an interior cavity within which various components are housed. Radome housing 104 forms the nose or nose region of NGF 100. Fuze body 106 includes an exterior sidewall 106*a* having a first end 106*b* (FIG. 2), a second end 106*c* and an extension 106*d* that extends rearwardly from second end 106*c*. Extension 106*d* is of a smaller circumference than sidewall 106*a* and is adapted to be received within a cavity of a projectile body. The projectile body is fabricated from a material, such as metal, that is structurally sufficient to enable projectile 10 to carry an explosive charge. Together, NGF 100 and the projectile body comprise a guided projectile. The sidewall 106*a* of NGF 100 bounds and defines an interior cavity within which a number of components are housed. First end 106*b* of fuze body 106 is operatively engaged with rear end 104*c* of radome housing 104 or be integrally formed therewith. NGF 100 has a longitudinal axis "Y" extending between front end 104*b* of radome housing 104 and an end 106*e* of extension 106*d*. Extension 106*d* of fuze body 106 is coupled to a coupling region of the projectile body. The engagement between NGF 100 and the projectile body is one that permits NGF 100 to rotate relative to the projectile body and about longitudinal axis "Y".

Referring still to FIG. 2, one or more canards 108 are provided on fuze body 106. Canards 108 are utilized to alter the trajectory of the projectile while in flight and are operatively engaged with a control actuation system (not shown) located within fuze body 106. Although not illustrated herein, it will be understood that NGF 100 may include various systems within radome housing 104 and fuze body 106. These systems typically will include a guidance, navigation, and control (GNC) assembly that includes a Global Positioning System (GPS) receiver. At least one GPS antenna 110 (FIG. 2) is provided on an exterior surface of the sidewall 106*a*. The GNC assembly may include a plurality of other sensors, including, but not limited to, laser guided sensors, electro-optical sensors, imaging sensors, inertial navigation systems (INS), inertial measurement units (IMU), and any other sensors suitable or necessary to navigate and guide the projectile to a location programmed during fuze setting. NGF 100 typically includes at least one non-transitory computer-readable storage medium and at least one processor or microprocessor housed within fuze body 106. The storage medium may include instructions encoded thereon that, when executed by the processor or microprocessor, implements various functions and operations to aid in guidance, navigation and control of the guided projectile. A power source, such as a battery, is operatively engaged with any of the aforementioned components that require power to operate. In some examples, some of the above-mentioned components may be omitted from NGF 100. In other examples, additional components may be included in NGF 100. Some or all of the components are operatively engaged with each other via wiring. It will be understood that any type of connection may be provided between the various components within NGF 100.

NGF 100 includes a first configuration of electrical contacts and NGFS 102 includes a complementary electrical contact configuration. The first embodiment electrical contact configurations of NGF 100 and NGFS 102 form an electrical interface between NGF 100 and NGFS 102. The electrical interface enables power and/or data to be transferred from NGFS 102 to NGF 100 during a fuze setting operation. FIG. 2 shows that the first configuration of electrical contacts on NGF 100 comprises a plurality of electrical contact pads 112 provided on the exterior surface of sidewall 104*a* of radome housing 104. Contact pads 112 are utilized as a direct connect interface for both communications and electrical power transfer.

A single segmented ring of contact pads 112 with any desired number of discrete, spaced-apart contact pads is provided. The segmented ring shown in FIG. 2 includes eight discrete electrical contact pads 112. In one example, the electrical contact pads 112 comprise two power electrical contact pads, two loopback electrical contact pads, two Time Mark Indicator (TMI) electrical contact pads, and two serial communications electrical contact pads. One electrical contact pad 112 is provided for each signal. Electrical contact pads 112 are operatively engaged with an electronic system of NGF 100 via wiring. For example, each electrical contact pad 112 is operatively engaged with one or more of the computer readable storage medium, the processor, the battery and any other electronic components on NGF 100. The TMI electrical contact pads, for example, are utilized in the transfer of GPS time signals from NGFS 102 to NGF 100, allowing NGF 100 to synchronize to GPS time. TMI signals are only relevant to examples of NGF 100 that utilize GPS. In other examples of NGF 100, these TMI electrical contact pads are used for other purposes, or they can be omitted.

The location of electrical contact pads 112 on sidewall 104*a* as illustrated in FIG. 2 helps to avoid obscuration of any Height of Burst (HoB) sensor transmitter located within radome housing 104. There is furthermore more surface area available on sidewall 104*a* than on front end 104*b* and therefore the use of larger electrical contact pads 112 is possible than if the electrical contact pads were placed on front end 104*a*. Electrical contact pads 112 are shown positioned closer to rear end 104*c* of radome housing 104, thus providing a shorter electrical path length to electronics within radome housing 104. Placing electrical contact pads 112 on sidewall 104*a* makes them more readily accessed by NGFS 102 if the fuze setter utilizes a nose approach, a side approach, or a clamshell approach for engaging with NGF 100. The placement of contact pads 112 on sidewall 104*a* also helps to accommodate larger mechanical misalignments between contact pads 112 and complementary electrical contacts provided on NGFS 102. (The electrical contacts on NGFS 102 will be described later herein.) Furthermore, placing electrical contact pads 112 on sidewall 104*a* may allow for higher electrical current carrying ability (for power/ground signals). Since there are eight electrical contact pads 112, the connection to electronics within radome housing 104 is simplified.

Electrical contact pads 112 are applied to sidewall 104*a* in any suitable manner. One suitable manner may be through contact metallization. In one example, electrical contact pads 112 may be bonded to the exterior surface of sidewall 104*a* using an adhesive. In one example, a recess is defined in the exterior surface of sidewall 104*a* for each electrical contact pad 112 and an associated electrical contact pad is placed into each recess. In one example, an outermost surface of the electrical contact pad 112 within a recess is substantially flush with the exterior surface of the sidewall 104*a*. In one example, an outermost surface of the electrical contact pad 112 within a recess is located a short distance outwardly beyond the exterior surface of the sidewall 104*a*. In one example, an outermost surface of the electrical contact pad 112 within a recess is located a short distance inwardly from the exterior surface of the sidewall 104*a*. Electrical contact pads 112 are arranged in a rotationally symmetric pattern. This rotationally symmetric pattern aids in accommodating an unknown rotational orientation of NGF 100 when the fuze is engaged by NGFS 102. Providing electrical contact pads 112 in a rotationally symmetric pattern also helps to avoid the need to physically rotationally orient NGF 100 prior to engagement with NGFS 102.

FIG. 2 shows electrical contact pads 112 arranged in pattern on the sidewall 104*a*. Electrical contact pads are arranged an annular ring that circumscribes the exterior surface of sidewall 104*a* and are spaced circumferentially from each other around the circumference of sidewall 104*a*. In one example, the electrical contact pads 112 are spaced at regular intervals around the circumference of sidewall 104*a*. In one example, adjacent electrical contact pads 112 are separated from each other by a space or by a section of sidewall 104*a*. Each electrical contact pad 112 and each space extends longitudinally rearwardly away from front end 104*a*. In one example, each electrical contact pad 112 is generally rectangularly-shaped when sidewall 104*a* is viewed from the side. In one example, electrical contact pads 112 are aligned with each other along a vertical plane "X" that is oriented at right angles to longitudinal axis "Y".

NGFS 102 includes a housing 114 having a wall 114*a* defining an opening to a port 114*b*. Port 114*b* is bounded and defined by an interior sidewall 114*c* and an interior front wall 114*d* of NGFS 102. The sidewall 114*c* and front wall 114*d* are shaped to be complementary to the exterior surfaces of a nose region of NGF 100. Port 114*b* is of slightly greater dimensions than the nose region of NGF 100 so that the nose region is received within port 114*b*. The nose region of NGF 100 is introduced into port 114*b* through the opening defined in wall 114*a* either manually or by an autoloader.

NGFS 102 includes a plurality of electrical contacts configured to come into direct contact with contact pads 112 of NGF 100 to form an direct connect interface. Electrical contacts 116 are arranged in a pattern complementary to the pattern of electrical contact pads 112 on NGF 100. As illustrated, electrical contacts 116 are arranged in an annular ring that circumscribes an interior surface of sidewall 114*c* that bounds port 114*b*. Contacts 116 are spaced circumferentially from each other around the circumference of sidewall 114*c*. In one example, the contacts 116 are spaced at regular intervals around the circumference of sidewall 114*c*. In one example, adjacent contacts 116 are separated from each other by a space or by a section of sidewall 114*c*.

Electrical contacts 116 may be of any construction that will establish an electrical connection with electrical contact pads 112. In one example, the electrical contacts 116 on NGFS 102 are spring contacts such as axially aligned electrical contacts 116 (e.g. pogo electrical contact pins) or any other configuration of spring contact that provides mechanical compliance and wiping action. The electrical contacts 116 are used for transfer of electrical power or signals. It will be understood that the electrical contacts 116 on NGFS 102 are not limited to electrical contact pins but may be of any other desired construction. Electrical contacts 116 are capable of transferring power or data to electrical contact pads 112.

Electrical contacts 116 are arranged in a pattern substantially identical to the pattern of electrical contact pads 112 on NGF 100. Electrical contacts 116 arranged radially on NGFS 102 are capable of extending outwardly beyond the interior surface of sidewall 114*c* and into port 114*b*. Electrical contacts 116 are aligned with each other along a vertical plane "X1" that is oriented at right angles to the longitudinal axis "Y1" of fuze setter port 114*b*. Electrical contacts 116 are arranged in a circular pattern. In one example there are equivalent numbers of electrical contact pads 112 on NGF 100 and electrical contacts 116 on NGFS 102. In other words, there is a one-to-one ratio between electrical contact pads 112 and electrical contacts 116. Electrical contacts 116 are operatively engaged with the electronics within NGFS 102 and are utilized to transfer power and/or data to NGF 100.

The placement of electrical contacts 116 on sidewall 114*c* is such that when radome housing 104 is received in port 114*b*, electrical contacts 116, and electrical contact pads 112 will come sufficiently into alignment and contact with each other that an electrical interface is formed between them. Each electrical contact pad 112 engages a corresponding electrical contact pin 116 on NGFS 102 that is unassigned to a signal. In one example, power will be transferred from NGFS 102 to NGF 100 via the interface formed between electrical contacts 116 and electrical contact pads 112. In one example, data will be transferred or shared between NGFS 102 and NGF 100 via the interface formed between electrical contacts 116 and electrical contact pads 112. In one example, data will be bi-directionally shared between NGFS 102 and NGF 100 via this interface.

The placement of electrical contact pads 112 relative to the placement of electrical contacts 116 and thereby the development of the electrical interface is such that no matter the rotational orientation of NGF 100 relative to projectile body 20 (and to NGFS 102), power and/or data is able to be transferred across the interface. The illustrated and described configuration of electrical contact pads 112 and electrical contacts 116 negates the need for a specific physical orientation of NGF 100 to be adopted relative to NGFS 102 before power/and or data is able to be transferred between NGFS 102 and NGF 100. When NGF 100 is placed on an autoloader and is engaged by NGFS 102, the fuze rotational position is initially undefined relative to NGFS 102.

In one example, feedthroughs on each of electrical contact pads 112 can be used to bring electrical signals through to the interior of the radome housing 104, e.g. via wiring 44, where electrical contact can be made using conventional techniques. These feedthroughs allow fuze setting to occur. In other words, the feedthroughs permit downloading of programs that include targeting information into NGF 100. The feedthroughs also enable power to be transferred to NGF 100. The feedthroughs are engaged with the electronic system of NGF 100. The system of NGF 100 and NGFS 102 is able to use fuze setting for other purposes. For example, the system may be used for periodic monitoring of the fuze while the fuze is in storage, and/or reprogramming the fuze operating software in a more efficient manner. The system may also be used as a general communications interface for purposes including status query, and for checking fuze configuration, including part number, serial number, and revision. The interface may further be used to initiate built-in testing and other diagnostic tests of NGF 100, and may have NGF 100 report back the results of the test. In other examples, the disclosed interface may also be utilized to test equipment used to support various diagnostic, maintenance and upgrade and repair functions. The test equipment could incorporate an interface akin to what is used on NGF 100 and NGFS 102.

NGF 100 and NGFS 102 are compatible with respect to a mechanical interface, i.e., the nose region of the NGF 100 is complementary to the NGFS 102 and is able to be received therein. NGF 100 and NGFS 102 are compatible with respect to an electrical signal interface, electrical power interface and electrical communication interface in that the contact pads 112 of NGF 100 and electrical contacts 116 of NGFS 102 are configured to communicate with each other. NGFS 102 is sufficiently compatible with NGF 100 to perform a fuze setting operation on NGF 100.

Figure 3A:
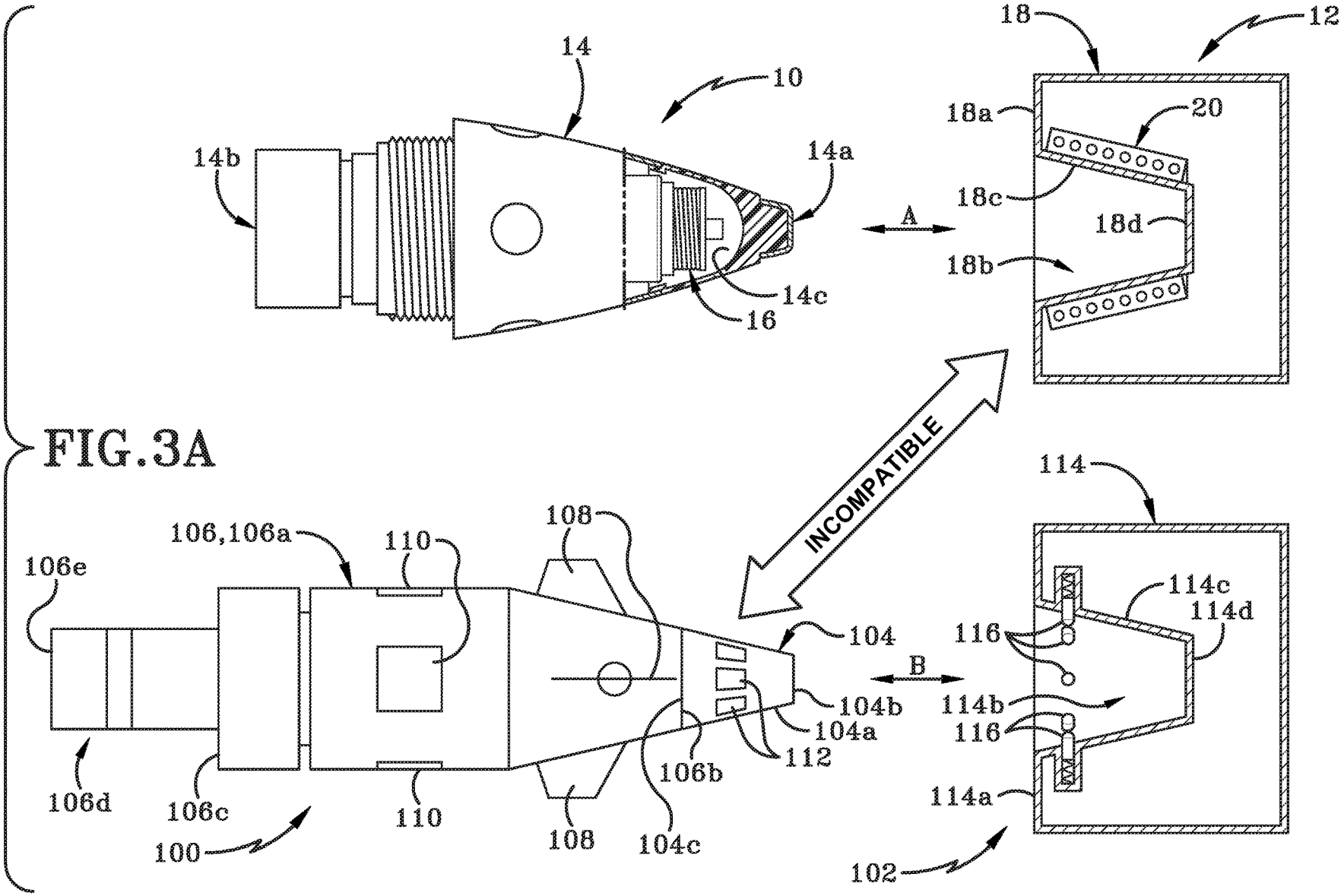
FIG. 3A is a diagrammatic, partial side elevation, longitudinal section of the PRIOR ART legacy fuze and the PRIOR ART legacy fuze setter shown in FIG. 1 as well as the first embodiment next generation fuze and next generation fuze setter of FIG. 2, and showing that there is incompatibility between the next generation fuze and the PRIOR ART legacy fuze setter.

FIG. 3A is a diagrammatic longitudinal section of LF 10 and LFS 12 located on the drawing sheet above the exemplary NGF 100 and NGFS 102. This figure is provided to show that there is inherent incompatibility between the NGF 100 and the LFS 12. In particular, the legacy induction coil 20 of LFS 12 is incapable of establishing communication and electrical power interfaces with the direct connect electrical contact pads 112 of NGF 100. Additionally, an adequate mechanical interface may not be able to be formed because of the different shape of the nose region of NGF 100 and the chamber defined by LFS 12. LFS 12 is unable to perform a fuze setting operation on NGF 100 because of this incompatibility.

Figure 3B:
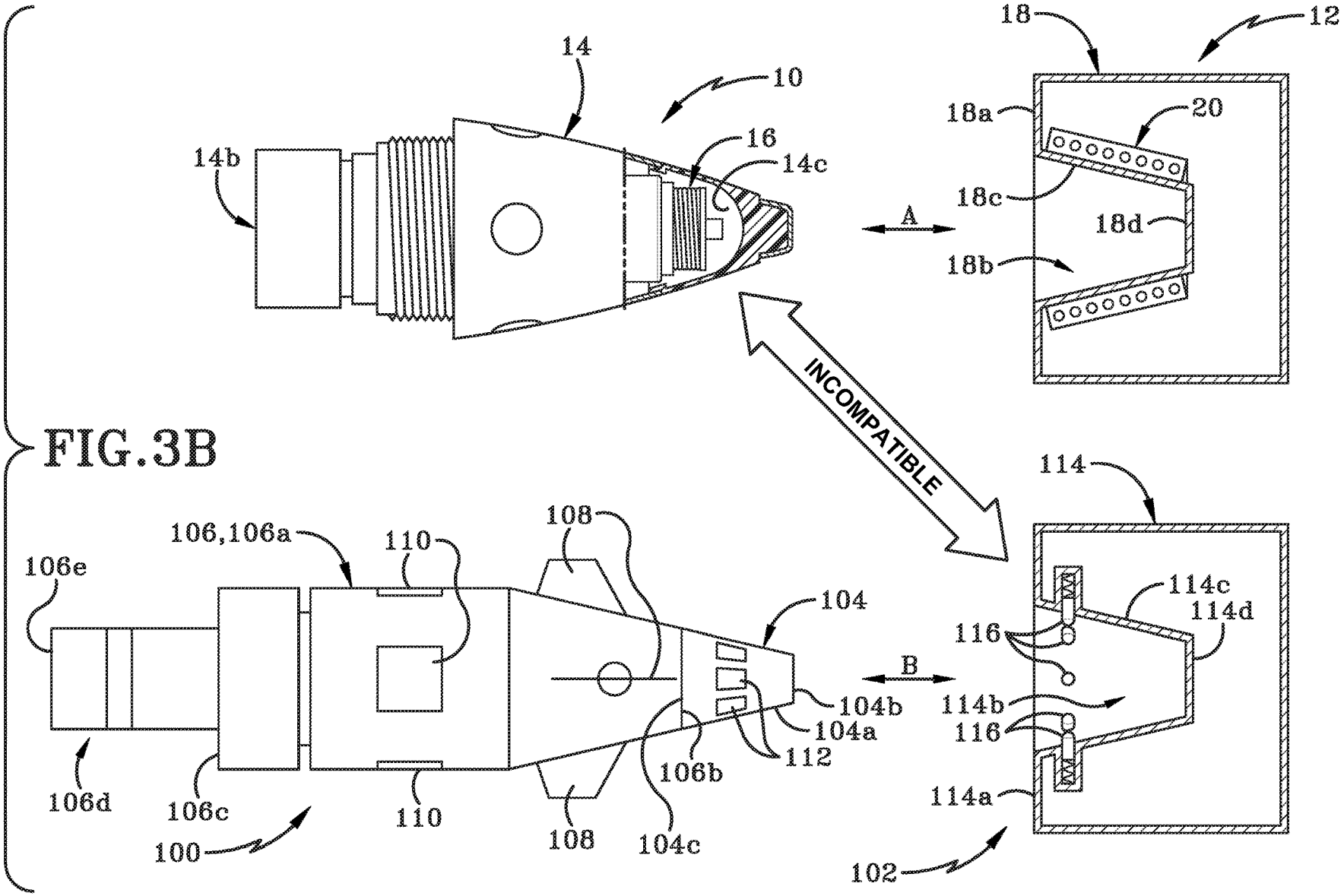
FIG. 3B is a diagrammatic, partial side elevation, longitudinal section of the PRIOR ART legacy fuze and PRIOR ART legacy fuze setter of FIG. 1 as well as the first embodiment next generation fuze and next generation fuze setter of FIG. 2, and showing there is incompatibility between the PRIOR ART legacy fuze and the next generation fuze setter.

Similarly, FIG. 3B is a side elevation view of LF 10 and LFS 12 located on the drawing sheet above the exemplary NGF 100 and NGFS 102. This figure is provided to show that there is inherent incompatibility between the LF 10 and NGFS 102. In particular, the direct connect electrical contacts 116 of NGFS 102 are inherently incapable of establishing communication and electrical power interfaces with the legacy induction coil 16 of LF 10. Additionally, an adequate mechanical interface may not be able to be formed because of the different shape of the nose region of LS 10 and the chamber defined by NGFS 102. NGFS 102 is therefore unable to perform a fuze setting operation on LF 10 because of this incompatibility.

In order to resolve the inherent incompatibility between various fuzes and fuze setters and to enable a fuze setter to perform a fuze setting operation on an incompatible fuze, a fuze setter adapter in accordance with the present disclosure is described hereafter and is shown in the attached figures.

An example of the fuze setter adapter disclosed herein is capable of being coupled with and establishing engagement and communication between a fuze and an incompatible fuze setter. The fuze and fuze setter are incompatible in at least one aspect relative to each other. Aspects that cause incompatibility include but are not necessarily limited to, that a mechanical interface is not possible because of a difference in an exterior shape of the nose region of the fuze relative to a chamber defined in the fuze setter; one of the fuze and fuze setter utilizes direct connect technology and the other of the fuze and fuze setter utilizes wireless technology, one of the fuze and fuze setter utilizes legacy technology and the other of the fuze and fuze setter utilizes next generation technology; or the fuze and fuze setter transmit and receive data at different rates. Data is typically communicated between fuze and fuze setter via a set of messages, each message defined to transmit a defined set of data. For example, a status message to communicate status, a control message to communicate a command to be executed, etc. Each message comprises a message header and a data block. The structure of the message (size, data content, location of specific data elements within the data block) must be commonly understood between both fuze and fuze setter. The fuze and fuze setter might therefore be incompatible if the structure of the messages from the fuze setter, for example, was not understood by the fuze. Another factor that results in incompatibility between fuze setter and fuze is that the fuze and fuze setter have different power capabilities, e.g., the fuze setter provides either a higher or lower electrical voltage than the fuze requires to operator, or provides Alternating Current (AC) power via an inductive interface where the fuze requires Direct Current (DC power, in which case electrical voltage conversion is necessary. In other instances, the fuze setter may output a DC voltage different (either higher or lower) than what the fuze requires to operate. Many other factors could affect compatibility between fuze and fuze setter and thereby prevent fuze setting from being able to occur. The fuze setter adapter disclosed herein is provided to resolve these incompatibility issues. For example, one of the functions of the fuze setter adapter in accordance with the present disclosure would be to receive messages from the fuze setter, extract the data, and reformat the data into a message format compatible with what the fuze is expecting, and vice versa from fuze to fuze setter as necessary. In other examples where the fuze and fuze setter have different power capabilities, the fuze setter adapter would accept the input power from the fuze setter and convert it into a form compatible with what the fuze requires.

In accordance with an aspect of the present disclosure, an example of a fuze setter adapter is disclosed herein that is capable of being coupled with and establishing communication and electrical power interfaces between a legacy fuze and an incompatible next generation fuze setter. As will be further discussed herein the fuze setter adapter is configured to be interposed between the legacy fuze and the next generation fuze setter and to be matingly engaged therewith.

In accordance with an aspect of the present disclosure, an example of a fuze setter adapter is disclosed that is capable of being coupled with and establishing communication and electrical power interfaces between a next generation fuze and an incompatible next generation fuze setter. As will be further discussed herein this example of the fuze setter adapter is configured to be interposed between the next generation fuze and the next generation fuze setter and to be matingly engaged therewith.

In accordance with an aspect of the present disclosure, an example of a fuze setter adapter is disclosed that is capable of being coupled with and establishing communication and electrical power interfaces between any fuze and any fuze setter that are incompatible with each other because of their physical shapes. As will be further discussed herein this example of the fuze setter adapter is configured to be interposed between the fuze and fuze setter and to be matingly engaged therewith.

Although the narrative of this disclosure largely addresses legacy versus next generation fuzes and fuze setters, it will be understood that a fuze setter adapter in accordance with the present disclosure may be utilized with a variety of different families of fuzes that would otherwise be incompatible with a fuze setter designed for one type of fuze only, and vice versa. Thus, in accordance with an aspect of present disclosure, one example of a fuze setter is able to communicate with a variety of different fuze types by individually and independently engaging an appropriate fuze setter adapter between each of the different fuzes and the fuze setter. In other words, in this particular example, the fuze setter adapter will only couple with a single fuze and a single fuze setter. In other exemplary embodiments, a single fuze type could be programmed across a variety of otherwise incompatible fuze setters if a compatible fuze setter adapter in accordance with the present disclosure is used. Again, in this particular embodiment, each of the different fuze setters will be individually and independently coupled with the fuze setter adapter so that one fuze and fuze setter is engaged with the fuze setter adapter. Later in this disclosure, a fuze setter adapter is disclosed that is able to be utilized as a general or universal fuze setter adapter that resolves incompatibility between a variety of different fuzes and fuze setters. In yet another exemplary embodiment, a fuze setter adapter has one interface to a fuze setter and multiple fuze interfaces that are configured to accommodate more than one type of fuze, and vice versa. In the latter example, the fuze setter adapter would have one interface to a particular fuze type, and multiple interfaces to support different fuze setters.

FIGS. 4 through 11 show a variety of next generation fuzes that include various electrical contact pad arrangements that are able to be interfaced with a common fuze setter through the provision of an example of a fuze setter adapter in accordance with the present disclosure. The common fuze setter illustrated in these figures is LFS 12 (FIG. 1) but it will be understood that any a different fuze setter may be utilized as the common fuze setter provided appropriate changes are made to the fuze setter adapter that is utilized. This will be explained in greater detail below.

Referring now to FIGS. 3A, 3B, and 4A through 4C, there is shown LFS 12 and a NGF 100 that are inherently incompatible. A first embodiment of a FSA 130 in accordance with an aspect of the present disclosure is utilized to interface between NGF 100 and LFS 12. In other words, FSA 130 enables LFS 12 and NGF 100 to matingly engage with other and establish communication with each other.

FSA 130 has a first region 130A configured to engage with NGF 100 and a second region 130B configured to engage with LFS 12. FSA 130 includes a housing 132. Housing 132 in first region 130A of FSA 130 includes a wall 132*a* that defines an opening to a port 132*b* defined by housing 132. In particular, port 132*b* is bounded and defined by an inwardly extending and tapered sidewall 132*c* and an end wall 132*d*. Port 132*b* is shaped and sized to be complementary to the nose region of NGF 100 and to physically receive the nose region therein. Port 132*b* comprises a first mechanical interface provided on FSA 130 and is utilized to matingly engage with NGF 100.

The first region 130A of FSA 130 includes a plurality of electrical contacts 134 that are of a substantially identical construction, placement and function as electrical contacts 116 of the aforementioned NGFS 102 (FIG. 2). Electrical contacts 134 are configured to selectively extend into cavity 132*b* of fuze setter adapter and come into direct contact with contact pads 112. When radome housing 104 is physically received in port 132*b*, there is direct contact between electrical contacts 134 and contact pads 112 and this results in a high power, low speed interface for efficient electrical power transfer from FSA 130 to NGF 100 and high speed bi-directional communication between FSA 130 and NGF 100.

Figure 4A:
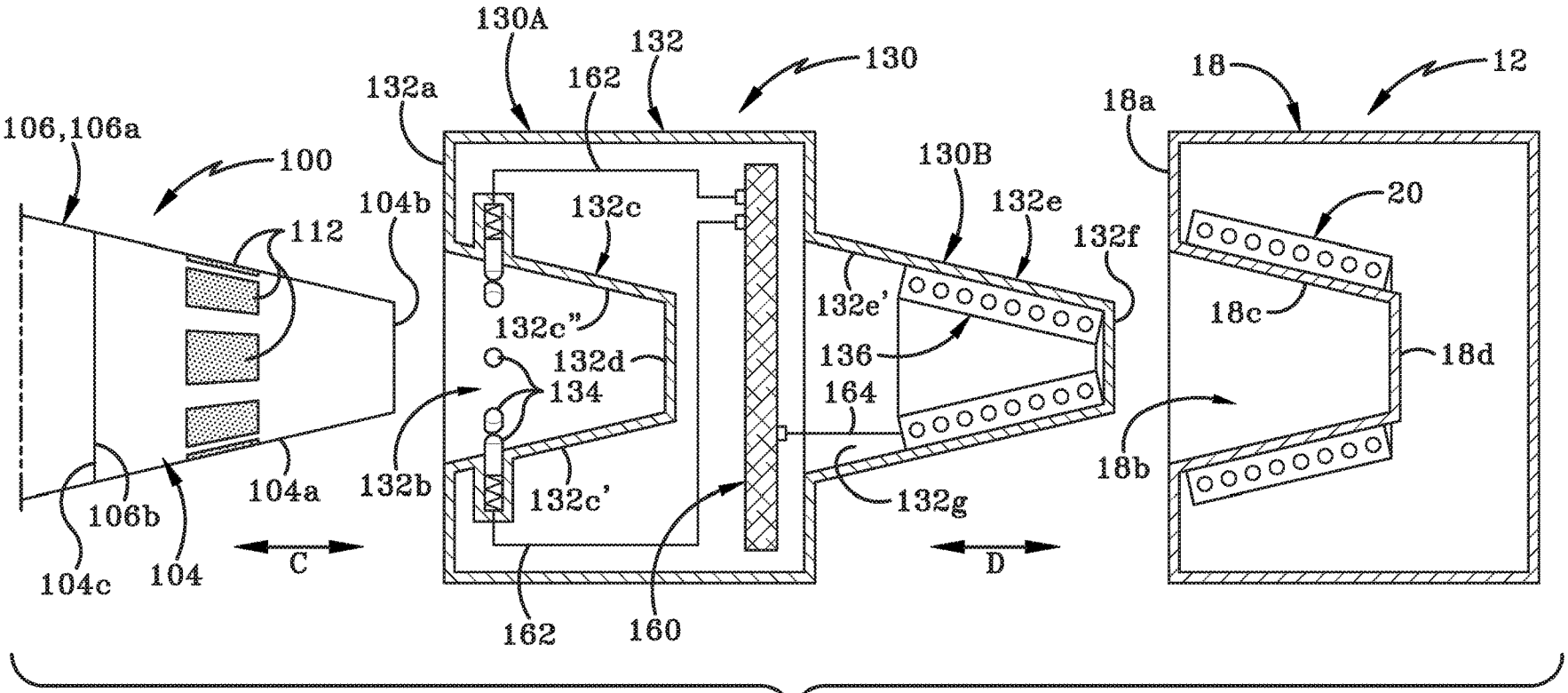
FIG. 4A is a diagrammatic, partial side elevation, longitudinal section of a nose region of the first embodiment next generation fuze, the incompatible legacy fuze setter, and a first embodiment of a fuze setter adapter in accordance with the present disclosure shown disengaged from each other.

Second region 130B of FSA 130 comprises a connector region that is complementary in shape and size to the Chamber 18*b* defined by LFS 12. The second region 130B, i.e., the connector region, comprises a second mechanical interface provided on FSA 130 and is utilized to matingly engage the fuze setter adapter and LFS 12. The second region 130B is configured to be physically received within chamber 18*b* of LFS 12. The connector region as illustrated in FIG. 4A is complementary in shape to chamber 18*b* and includes a tapered sidewall 132*e* and an end wall 132*f*. Sidewall 132*e* includes an interior surface 132*e*' that bounds and defines an interior compartment 132*g*. Second region 130B of FSA 130 is provided with a single fuze setter adapter induction coil 136 located within interior compartment 132*g*, adjacent the interior surface 132*e*' of sidewall 132*e*. Fuze setter adapter induction coil 136 is of a type that is compatible with induction coil 20 of LFS 12. Induction coil 136 is capable of electrical power transfer and data/communications with induction coil 20. When second region 130B of FSA 130 is received within chamber 18*b*, an electrical and communications interface is established between induction coil 20 and induction coil 136 that enables electrical power to be transferred from LFS 12 to FSA 130 and that further enables bidirectional data communication between LFS 12 and FSA 130.

In accordance with another aspect of the present disclosure, FSA 130 includes a processor control 160 operatively engaged with electrical contacts 134 by wiring 162. Processor control 160 includes a processor, memory, and programming to manage communications and power distribution between NGF 100 and LFS 12. It will be understood that the wiring 162 illustrated herein diagrammatically is representative of the connectivity between processor control 160 and electrical contacts 134. Processor control 160 is also operatively engaged with the single fuze setter adapter induction coil 136 by wiring 164. It will be understood that the wiring 164 illustrated herein diagrammatically is representative of the connectivity between processor control 160 and the induction coil 136. The processor control 160 includes control and electrical power electronics that enable NGF 100 and the LFS 12 to be placed in communication with each other and that further allows the LFS 12 to perform a fuze setting operation on NGF 100. The manner in which processor control 160 connects the electronics of LFS 12 and NGF 100 will be discussed later herein.

Figure 4B:
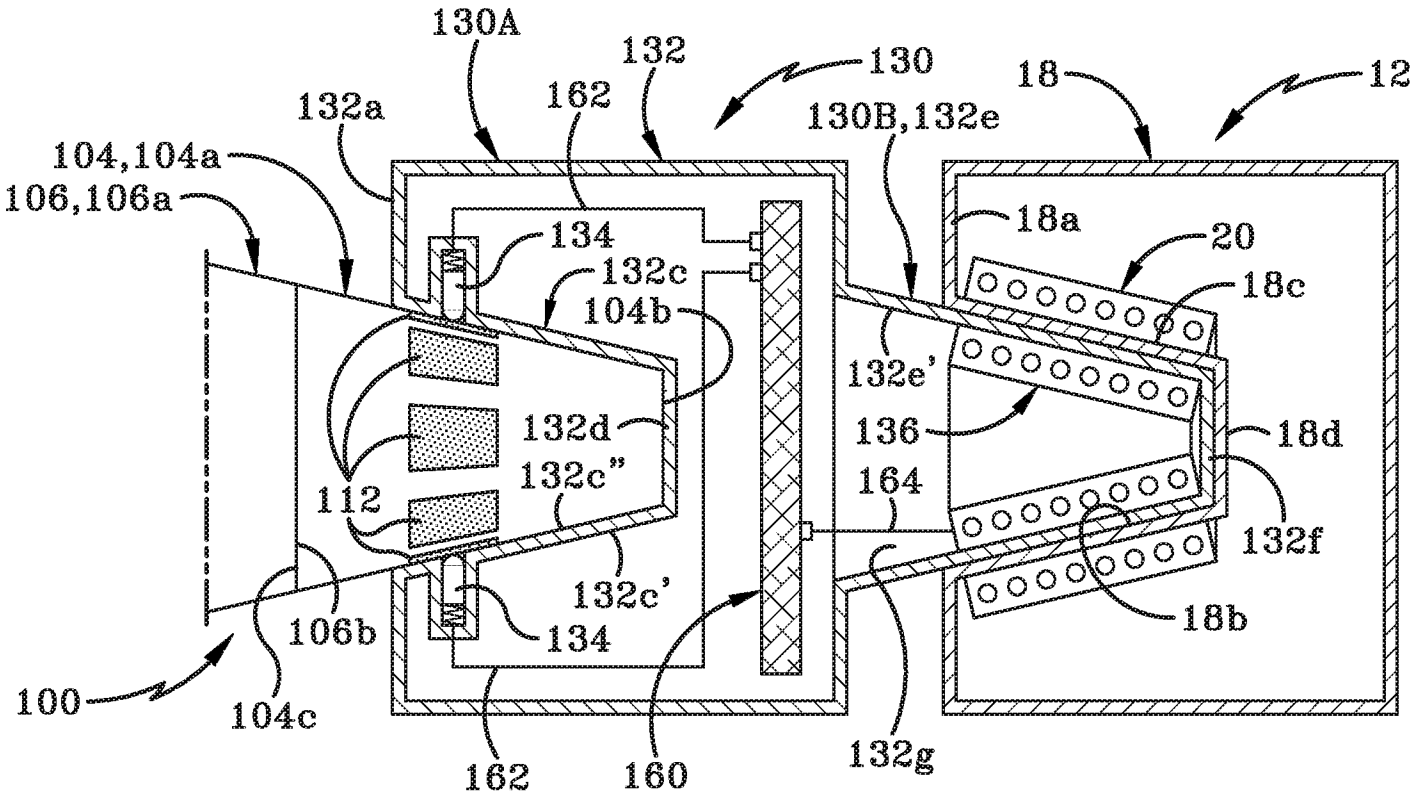
FIG. 4B is a diagrammatic, partial side elevation, longitudinal section of the nose region of the first embodiment next generation fuze and the incompatible legacy fuze setter engaged with the fuze setter adapter of FIG. 4A.

FIG. 4B shows NGF 100 mechanically received within port 132*b* of FSA 130 and shows second region 130B of FSA 130 mechanically received within chamber 18*b* of LFS 12. FIG. 4B further shows an electrical power and communications interface formed between contact pads 112 of NGF 100 and electrical contacts 134 of FSA 130. FIG. 4B additionally shows an electrical power and communications interface formed between fuze setter adapter induction coil 136 and legacy fuze setter induction coil 20. The direction arrows "C" in FIG. 4A are provided to show that NGF 100 is selectively inserted into port 132*b* in FSA 130 and is selectively removed from port 132*b*. The direction arrows "D" in FIG. 4A are provided to show that second region 130B of FSA 130 is selectively inserted into the chamber 18*b* of LFS 12 and is selectively removed from chamber 18*b*.

Figure 4C:
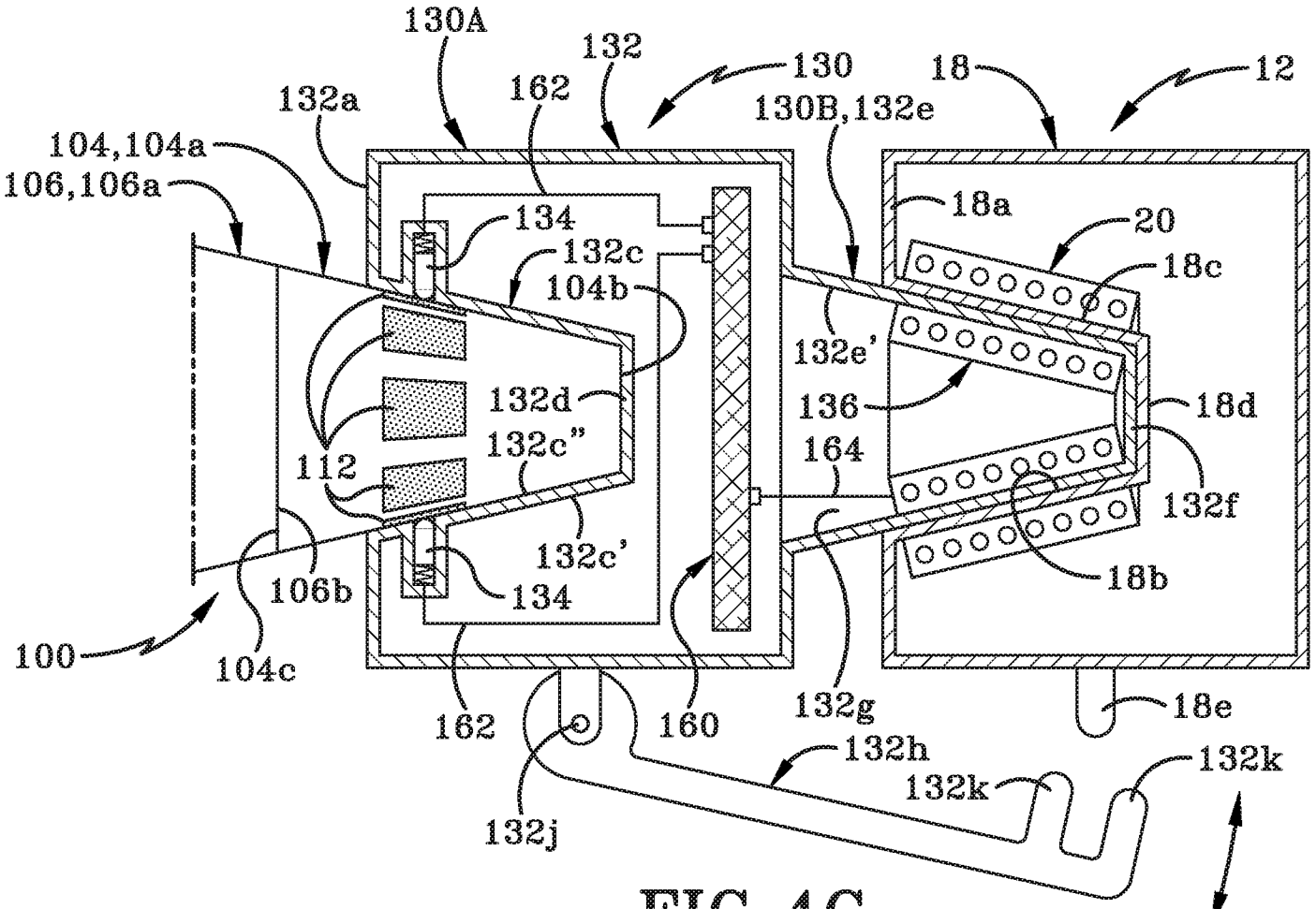
FIG. 4C is a diagrammatic, partial side elevation, longitudinal section similar to FIG. 4B but further showing a retention arm provided on the fuze setter adapter and a locking member provided on the legacy fuze setter.

FIG. 4C illustrates a retention arm 132*h* that is pivotally engaged with the housing 132 of FSA 130 by a pivot pin 132*j*. Retention arm 132*h* is able to be pivoted in a first direction and into interlocking engagement with a locking member 18*e* on LFS 12 in order to hold FSA 130 in mechanical engagement with LFS 12. Retention arm 132*h* is able to be pivoted in a second direction and out of engagement with locking member 18*e* when it is desired to disengage fuze setter adapter 12 from LFS 12. The arrow "E" is provided to show the selectively pivotal motion of retention arm 132*h* either toward locking member 18*e* or away from locking member 18*e*. It will be understood that retention arm 132*h* and locking member 18*e* are exemplary of any type of locking mechanism that may be utilized to hold a fuze setter adapter in engagement with a fuze setter. Although not shown in any of the figures, it will be further understood that a locking mechanism for holding a fuze to fuze setter adapter may also be provided.

FIGS. 5 to 9 show a plurality of different examples of direct connect communications interface type fuzes that are able to be placed in electrical power and data communication with LFS 12 by complementary configured fuze setter adapters in accordance with aspects of the present disclosure. Each fuze setter adapter is designed to have a first region that is compatible and complementary to the fuze in question and to have a second region that is compatible and complementary with the LFS 12. It will be understood that the configurations of the various fuzes and therefore of the first regions of the various fuze setter adapters is exemplary only and should not be construed as limiting the scope of the present disclosure. It will be further understood that the configuration of the processor control and the wiring provided in the various fuze setter adapters and the functioning thereof may vary based on the specific arrangement of electrical contact pads and electrical contacts provided on the fuze and the fuze setter adapter. However, the purpose of the processor control and wiring in the following examples remains the same, i.e., to operatively engage the LFS 12 with the various fuzes.

Figure 5:
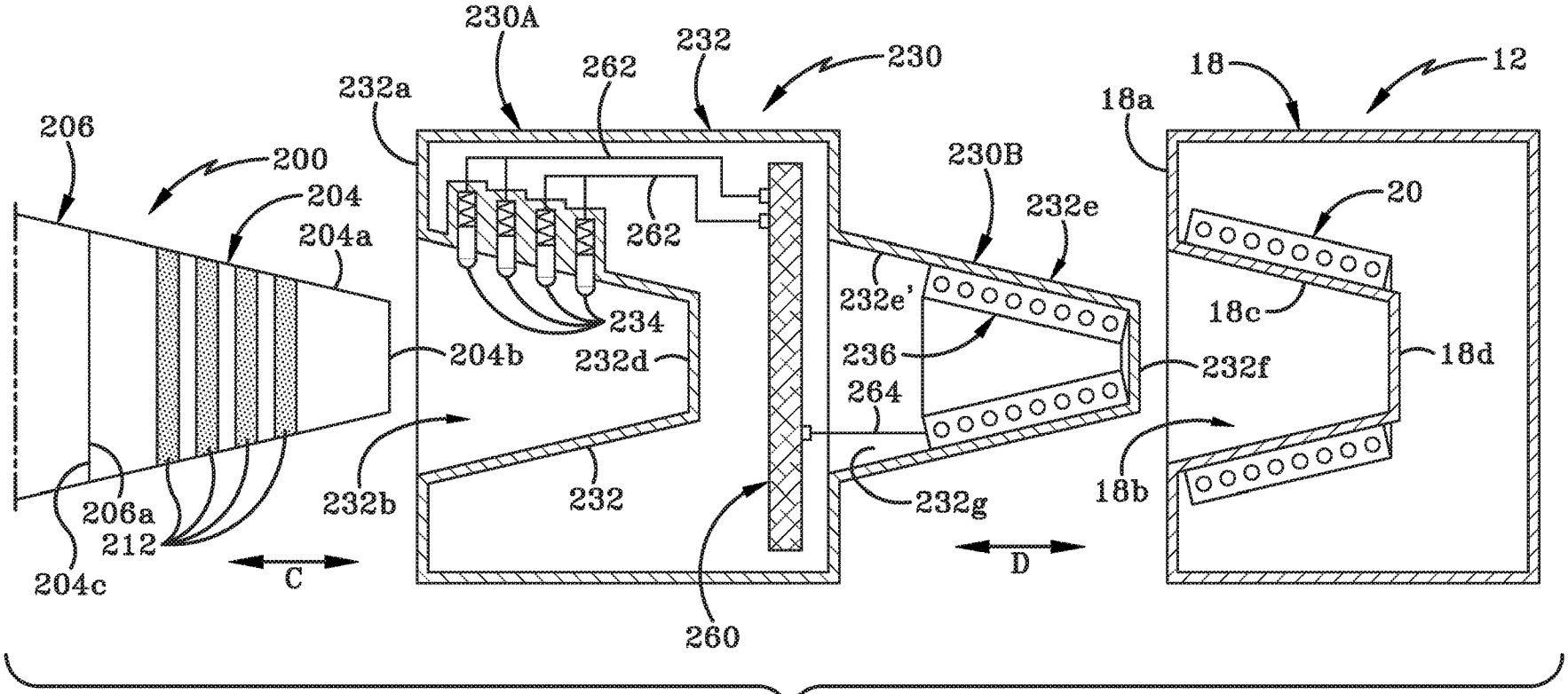
FIG. 5 is a diagrammatic, partial side elevation, longitudinal section of a nose region of a second embodiment next generation fuze, the incompatible legacy fuze setter, and a second embodiment of a fuze setter adapter in accordance with the present disclosure, shown disengaged from each other.

FIG. 5 shows a second embodiment of a NGF 200 and a second embodiment of a FSA 230 in accordance with the present disclosure. FSA 230 is capable of operatively engaging NGF 200 with LFS 12.

FIG. 5 shows only a portion of the nose region of NGF 200. NGF 200 includes a radome housing 204 and a fuze body 206 that are operatively engaged with each other. Radome housing 204 includes an exterior sidewall 204*a*, a front end 204*b*, and a rear end 204*c*. Radome housing 204 defines an interior cavity (not shown) within which various components may be housed. Rear end 204*c* of radome housing 204 is engaged with front end 206*a* of fuze body 206.

A plurality of electrical contacts are provided on an exterior surface of sidewall 204*a* of radome housing 204. These electrical contacts are in the form of a plurality of longitudinally spaced-apart annular contact rings or bands 212. The contact rings 212 are located a distance longitudinally rearwardly of front end 204*b* and are operatively engaged with the electronics of NGF 200. Contact rings 212 function in substantially the same manner as contact pads 112.

FSA 230 has a first region 230A configured to engage with NGF 100 and a second region 230B configured to engage with LFS 12. FSA 230 includes a housing 232. Housing 232 in first region 230A of FSA 230 includes a wall 232*a* that defines an opening to a port 232*b* defined by housing 232. In particular, port 232*b* is bounded and defined by an inwardly extending and tapered sidewall 232*c* and an end wall 232*d*. Port 232*b* is shaped and sized to be complementary to the nose region of NGF 200 and to physically receive the nose region therein.

The first region 230A of FSA 230 includes a plurality of electrical contacts 234 that are of a substantially identical construction and function as electrical contacts 116, 134 of the aforementioned NGFS 102 and FSA 130, respectively. Electrical contacts 234, however, are positioned differently to electrical contacts 134 in that they are located spaced longitudinally from each other along sidewall 232*c*. The number and the location of each contact pad 234 is complementary to the number and location of the contact rings 212 on radome housing 204. Each electrical contact 234 is configured to selectively extend into cavity 232*b* of fuze setter adapter 232. When radome housing 204 is physically received in port 232*b*, there is direct contact between electrical contacts 234 and contact rings 212 and this results in a high power, low speed interface for efficient electrical power transfer from FSA 230 to NGF 200 and for high speed bi-directional communication between FSA 230 and NGF 200.

Second region 230B of FSA 230 comprises a connector region that is complementary in shape and size to the chamber 18*b* defined by LFS 12. The second region 230B is configured to be physically received within chamber 18*b*. The connector region as illustrated in FIG. 5 includes a tapered sidewall 232*e* and an end wall 232*f*. Sidewall 232*e* includes an interior surface 232*e*' that bounds and defines an interior compartment 232*g*. Second region 230B of FSA 230 is provided with a single fuze setter adapter induction coil 236 located within interior compartment 232*g*, adjacent the interior surface 232*e*' of sidewall 232*e*. Fuze setter adapter induction coil 236 is of a type that is compatible with induction coil 20 of LFS 12. Induction coil 236 is capable of electrical power transfer and data/communications with induction coil 20. When second region 230B of FSA 230 is received within chamber 18*b*, an electrical and communications interface is established between induction coil 20 and induction coil 236 that enables electrical power to be transferred from LFS 12 to FSA 230 and that further enables bidirectional data communication between LFS 12 and FSA 230.

In accordance with an aspect of the present disclosure, FSA 230 includes a processor control 260 operatively engaged with electrical contacts 234 by wiring 262. Processor control 260 is also operatively engaged with the induction coil 236 by wiring 264. The processor control 260 includes a processor, memory and control and electrical power electronics that effectively connects contact rings 212 with induction coil 20 and thereby enables NGF 200 and the LFS 12 to be placed in communication with each other. The processor includes programming for operatively linking and controlling the various power and signal interfaces of NGF 200 and LFS 12, and those within FSA 230 so that fuze setting is able to occur. Processor control 260 further enables the LFS 12 to perform a fuze setting operation on NGF 200.

The direction arrows "C" in FIG. 5 are provided to show that NGF 200 is selectively inserted into port 232*b* in FSA 230 and is selectively removed from port 232*b*. The direction arrows "D" in FIG. 5 are provided to show that second region 230B of FSA 230 is selectively inserted into the chamber 18*b* of LFS 12 and is selectively removed from chamber 18*b*. Although not illustrated herein, it will be understood that locking mechanisms may be provided to secure FSA 230 to NGF 200 and LFS 12.

Figure 6:
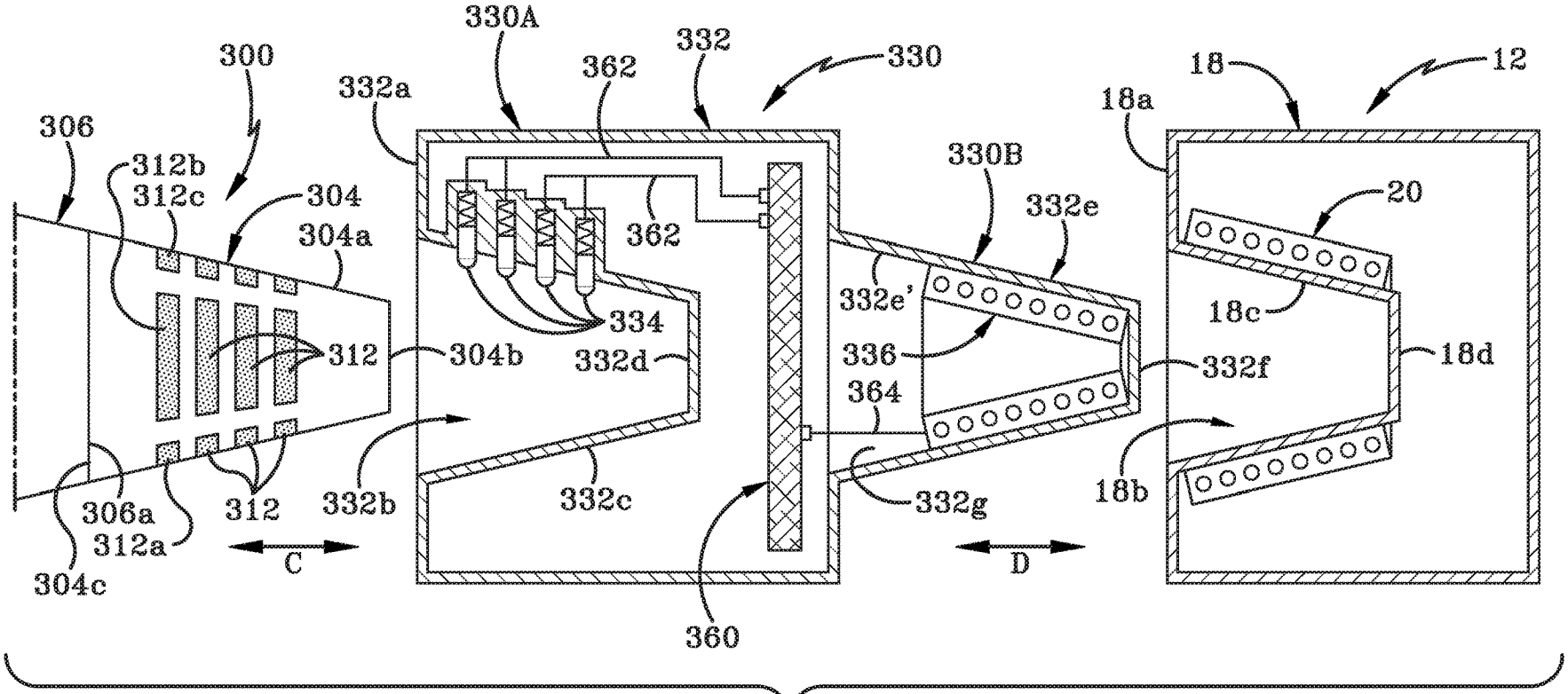
FIG. 6 is a diagrammatic, partial side elevation, longitudinal section of a nose region of a third embodiment next generation fuze, the incompatible legacy fuze setter, and a third embodiment of a fuze setter adapter in accordance with the present disclosure, shown disengaged from each other.

FIG. 6 shows a third embodiment of a NGF 300 and a third embodiment of FSA 330 in accordance with the present disclosure. FSA 330 is capable of operatively engaging NGF 300 with LFS 12. FIG. 6 shows only a portion of the nose region of NGF 300. NGF 300 includes a radome housing 304 and a fuze body 306 that are operatively engaged with each other. Radome housing 304 includes an exterior sidewall 304*a*, a front end 304*b*, and a rear end 304*c*. Radome housing 304 defines an interior cavity (not shown) within which various components may be housed. Rear end 304*c* of radome housing 304 is engaged with front end 306*a* of fuze body 306.

A plurality of electrical contacts are provided on an exterior surface of sidewall 304*a* of radome housing 304. These electrical contacts are in the form of a plurality of longitudinally spaced-apart annular rings or bands 312. Bands 312 differ from contact rings 212 in that instead of being a substantially continuous ring around the circumference of sidewall 304*a*, each and 312 is segmented. In other words, each annular band 312 is comprised of a plurality of segments, such as 312*a*, 312*b*, 312*c*, that are circumferentially spaced-apart from each other. The segmented bands 312 are located a distance longitudinally rearwardly of front end 304*b* of radome housing 304 and are operatively engaged with the electronics of NGF 300. Segmented bands 312 function in substantially the same manner as contact pads 112 and contact rings 212.

FSA 330 has a first region 130A configured to engage with NGF 300 and a second region 130B configured to engage with LFS 12. FSA 330 includes a housing 332. Housing 332 in first region 130A of FSA 330 includes a wall 332*a* that defines an opening to a port 332*b* defined by housing 332. In particular, port 332*b* is bounded and defined by an inwardly extending and tapered sidewall 332*c* and an end wall 332*d*. Port 332*b* is shaped and sized to be complementary to the nose region of NGF 300 and to physically receive the nose region therein. Port 332*b* comprises a first mechanical interface provided on FSA 330 and is utilized to matingly engage with NGF 300.

Electrical contacts 334 of FSA 330 are spaced longitudinally from each other along sidewall 332*c* so that each electrical contact 334 is capable of direct contact with the various segments of one of the segmented bands 312 of NGF 300. FSA 330 places NGF 300 in communication with LFS 12 when NGF 300 is received in port 332*b* and second region 330B of FSA 330 is received in chamber 18*b* of LFS 12. The manner in which processor control 360 connects the electronics of LFS 12 and NGF 300 will be discussed later herein.

The direction arrows "C" in FIG. 6 are provided to show that NGF 300 is selectively inserted into port 332*b* in FSA 330 and is selectively removed from port 332*b*. The direction arrows "D" in FIG. 6 are provided to show that second region 330B of FSA 330 is selectively inserted into the chamber 18*b* of LFS 12 and is selectively removed from chamber 18*b*. Although not illustrated herein, it will be understood that locking mechanisms may be provided to secure FSA 330 to NGF 300 and LFS 12.

Figure 7A:
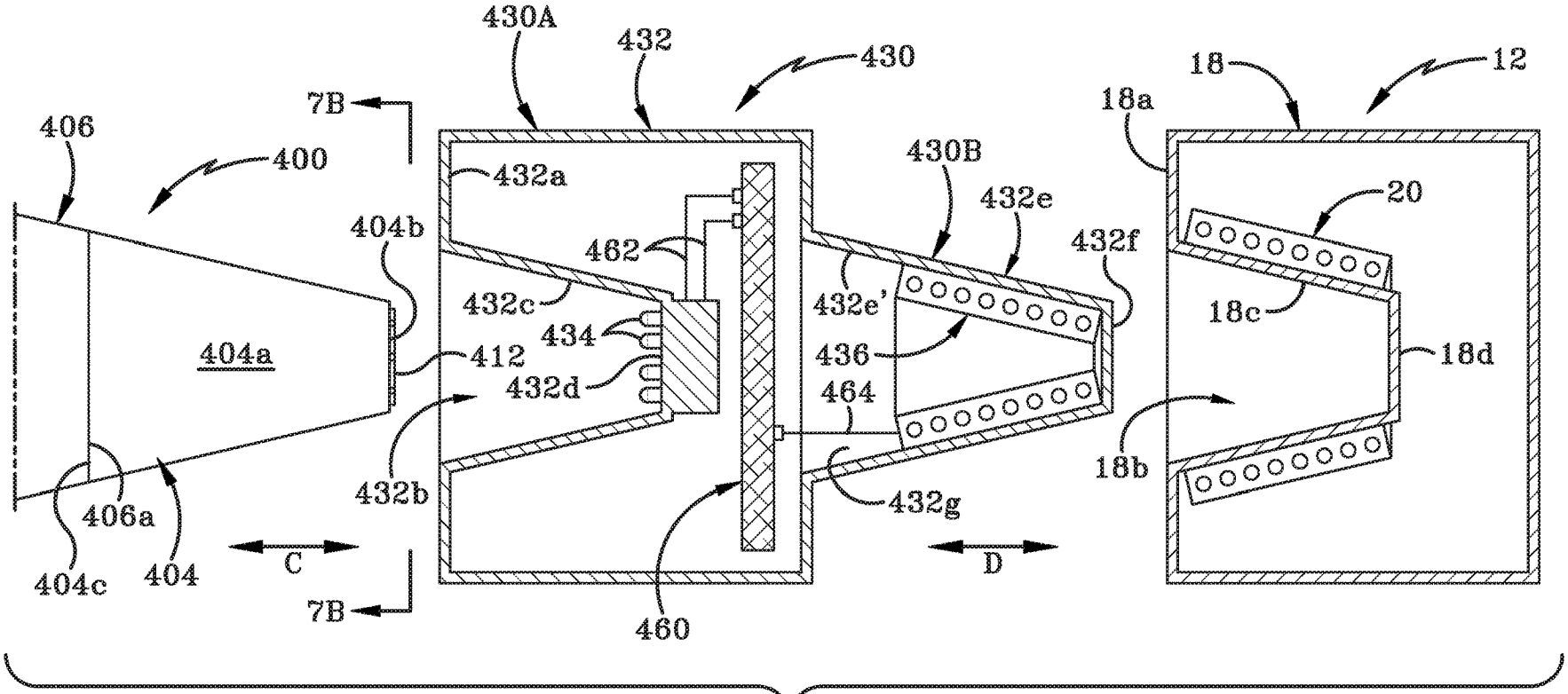
FIG. 7A is a diagrammatic, partial side elevation, longitudinal section of a nose region of a fourth embodiment next generation fuze, the incompatible legacy fuze setter, and a fourth embodiment of the fuze setter adapter in accordance with the present disclosure, shown disengaged from each other.
Figure 7B:
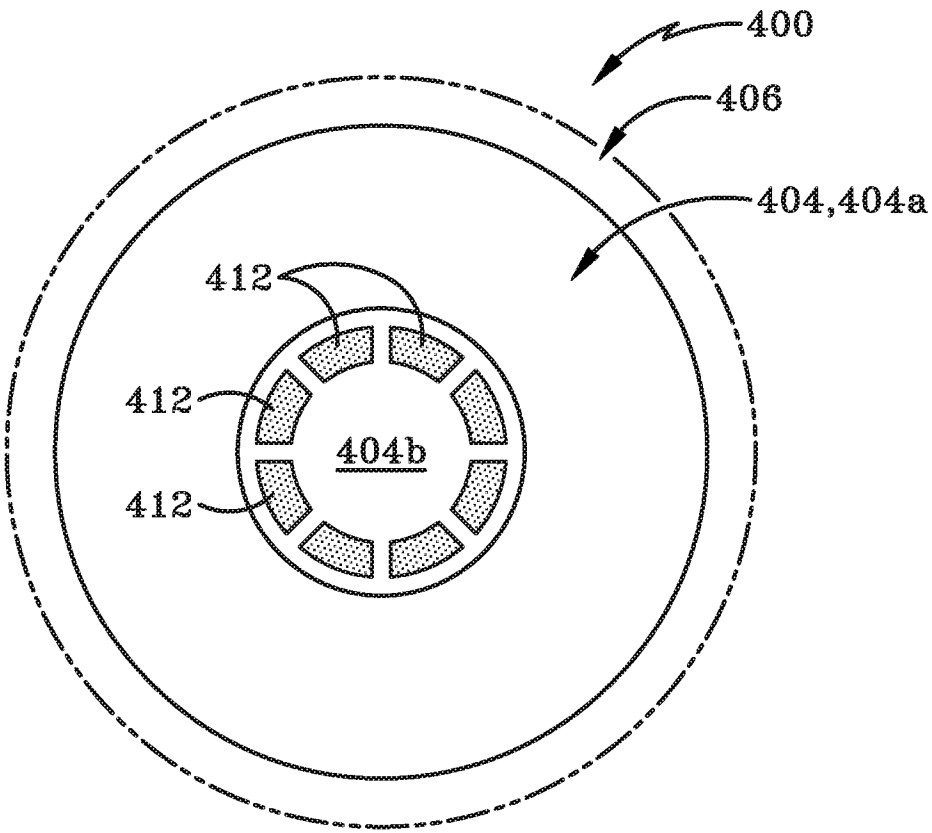
FIG. 7B is a front elevation view of the fourth embodiment next generation fuze taken along line 7B-7B of FIG. 7.

FIGS. 7A and 7B show a fourth embodiment of a NGF 400 and a third embodiment of FSA 430 in accordance with the present disclosure. FSA 430 is capable of operatively engaging NGF 400 with LFS 12.

FIGS. 7A and 7B show only a portion of the nose region of NGF 400. NGF 400 includes a radome housing 404 and a fuze body 406 that are operatively engaged with each other. Radome housing 404 includes an exterior sidewall 404*a*, a front end 404*b*, and a rear end 404*c*. Radome housing 404 defines an interior cavity (not shown) within which various components may be housed. Rear end 404*c* of radome housing 404 is engaged with front end 406*a* of fuze body 406.

A plurality of electrical contacts 412 are provided on front end 404*b* of radome housing 404. Electric contacts 412 provide a direct connect interface for both communications and electrical power transfer. These electrical contacts 412 are arranged in a circular pattern (FIG. 7B). Contacts 412 are spaced circumferentially from each other such that the plurality of electrical contacts 412 forms a single segmented ring on front end 404*b*. Electrical contacts 412 are operatively engaged with the electronics of NGF 400 and function in substantially the same manner as any of the contact pads 112, contact rings 212, and bands 312.

FSA 430 has a first region 430A configured to engage with NGF 400 and a second region 430B configured to engage with LFS 12. FSA 430 includes a housing 432. Housing 432 in first region 430A of FSA 430 includes a wall 432*a* that defines an opening to a port 432*b* defined by housing 432. In particular, port 432*b* is bounded and defined by an inwardly extending and tapered sidewall 432*c* and an end wall 432*d*. Port 432*b* is shaped and sized to be complementary to the nose region of NGF 400 and to physically receive the nose region therein.

The first region 430A of FSA 430 includes a plurality of electrical contacts 434 that are of a substantially identical construction and function as electrical contacts 116 of the aforementioned NGFS 102 (FIG. 2). Electrical contacts 434 are configured to selectively extend into cavity 432*b* of fuze setter adapter and come into direct contact with contact pads 412. In particular, electrical contacts 434 are provided on end wall 432*d* so that when front end 404*b* of radome housing 404 is moved to a position adjacent end wall 432*d*, electrical contacts 434 will directly come into contact with contact pads 412. Although not illustrated herein, it will be understood that electrical contacts 434 will be arranged in a circular pattern that is complementary to the circular arrangement of contact pads 412 illustrated in FIG. 7B. When radome housing 104 is physically received in port 432*b*, there is direct contact between electrical contacts 434 and contact pads 412 and this results in a high power, low speed interface for efficient electrical power transfer from FSA 430 to NGF 400 and high speed bi-directional communication between FSA 430 and NGF 400.

Second region 430B of FSA 430 comprises a connector region that is complementary in shape and size to the chamber 18*b* defined by LFS 12. The second region 430B is configured to be physically received within chamber 18*b*. The connector region as illustrated in FIG. 7A includes a tapered sidewall 432*e* and an end wall 432*f*. Sidewall 432*e* includes an interior surface that bounds and defines an interior compartment 432*g*. Second region 430B of FSA 430 is provided with a single fuze setter adapter induction coil 436 located within interior compartment 432*g*, adjacent the interior surface of sidewall 432*e*. Fuze setter adapter induction coil 436 is of a type that is compatible with induction coil 20 of LFS 12. Induction coil 436 is capable of electrical power transfer and data/communications with induction coil 20. When second region 430B of FSA 430 is received within chamber 18*b*, an electrical and communications interface is established between induction coil 20 and induction coil 436 that enables electrical power to be transferred from LFS 12 to FSA 430 and that further enables bidirectional data communication between LFS 12 and FSA 430.

In accordance with another aspect of the present disclosure, FSA 430 includes a processor control 460 operatively engaged with electrical contacts 434 by wiring 462. Processor control 460 is also operatively engaged with the single fuze setter adapter induction coil 436 by wiring 464. The processor control 460 includes control and electrical power electronics that enable NGF 400 and the LFS 12 to be placed in communication with each other and that further allows the LFS 12 to perform a fuze setting operation on NGF 400. The manner in which processor control 460 connects the electronics of LFS 12 and NGF 400 will be discussed later herein.

The direction arrows "C" in FIG. 7A are provided to show that NGF 400 is selectively inserted into port 432*b* in FSA 430 and is selectively removed from port 432*b*. The direction arrows "D" in FIG. 7A are provided to show that second region 430B of FSA 430 is selectively inserted into the chamber 18*b* of LFS 12 and is selectively removed from chamber 18*b*. Although not illustrated herein, it will be understood that locking mechanisms may be provided to secure FSA 430 to NGF 400 and LFS 12.

Figure 8:
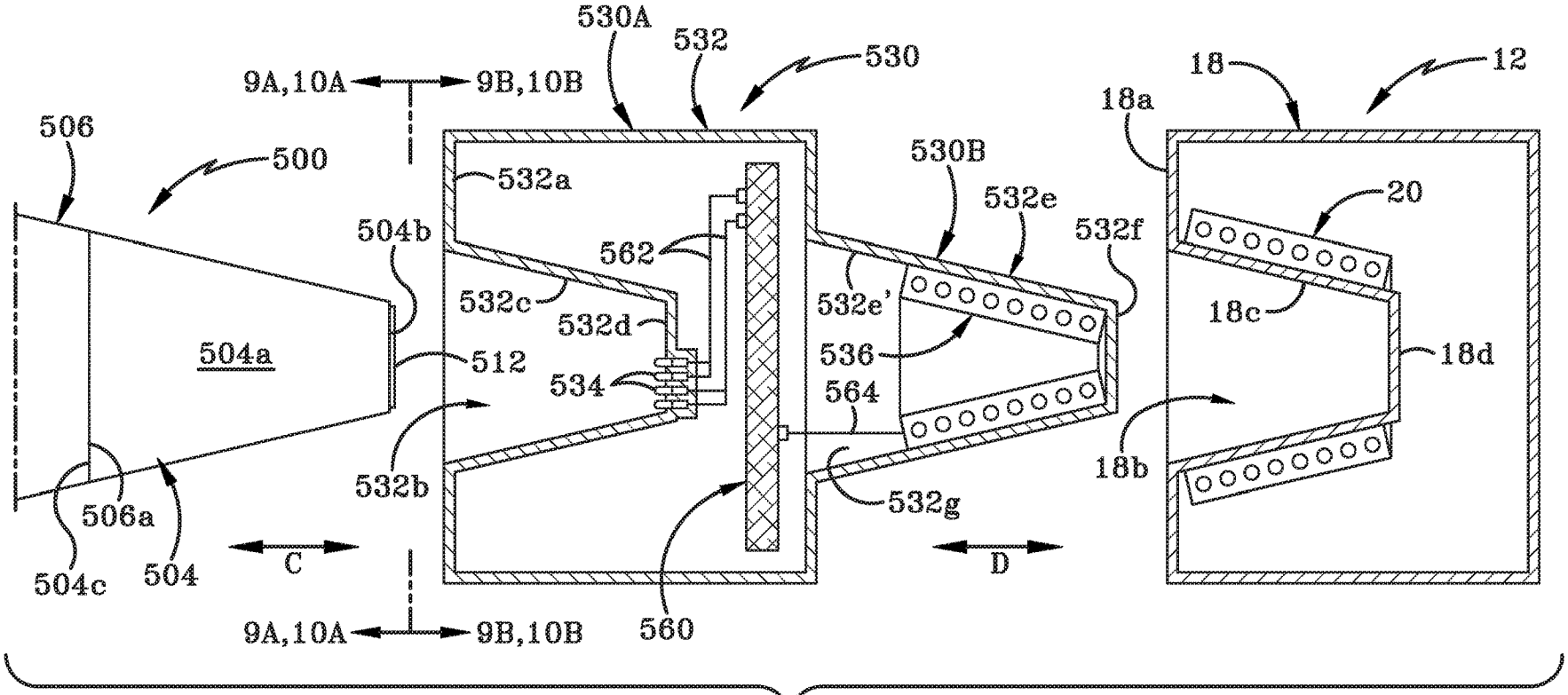
FIG. 8 is a diagrammatic, partial side elevation, longitudinal section of a nose region of a fifth embodiment next generation fuze, the incompatible legacy fuze setter, and a fifth embodiment of a fuze setter adapter in accordance with the present disclosure, shown disengaged from each other.

FIG. 8 shows a fifth embodiment of a NGF 500 and a fourth embodiment of FSA 530 in accordance with the present disclosure. FSA 530 is capable of operatively engaging NGF 500 with LFS 12.

FIG. 8 shows only a portion of the nose region of NGF 500. NGF 500 includes a radome housing 504 and a fuze body 506 that are operatively engaged with each other. Radome housing 504 includes an exterior sidewall 504*a*, a front end 504*b*, and a rear end 504*c*. Radome housing 504 defines an interior cavity (not shown) within which various components may be housed. Rear end 504*c* of radome housing 504 is engaged with front end 506*a* of fuze body 506.

Figure 9B:
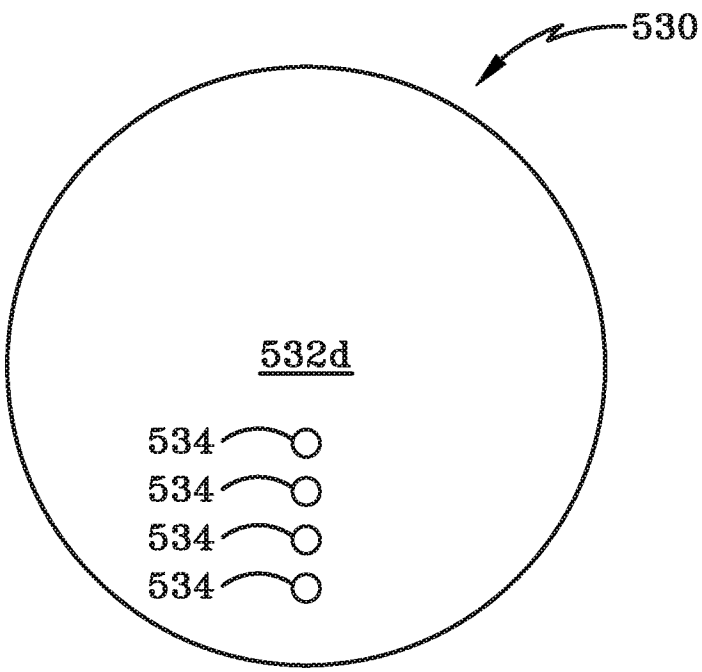
FIG. 9B is a rear end elevation view of the fifth embodiment fuze setter adapter taken along line 9B-9B of FIG. 8.
Figure 9A:
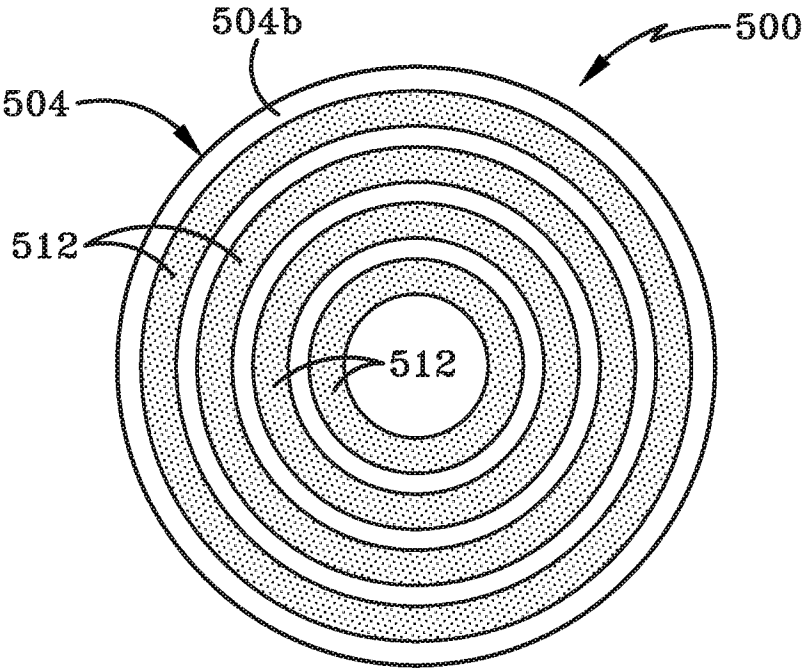
FIG. 9A is a front end elevation view of the fifth embodiment next generation fuze taken along line 9A-9A of FIG. 8.
Figure 10B:
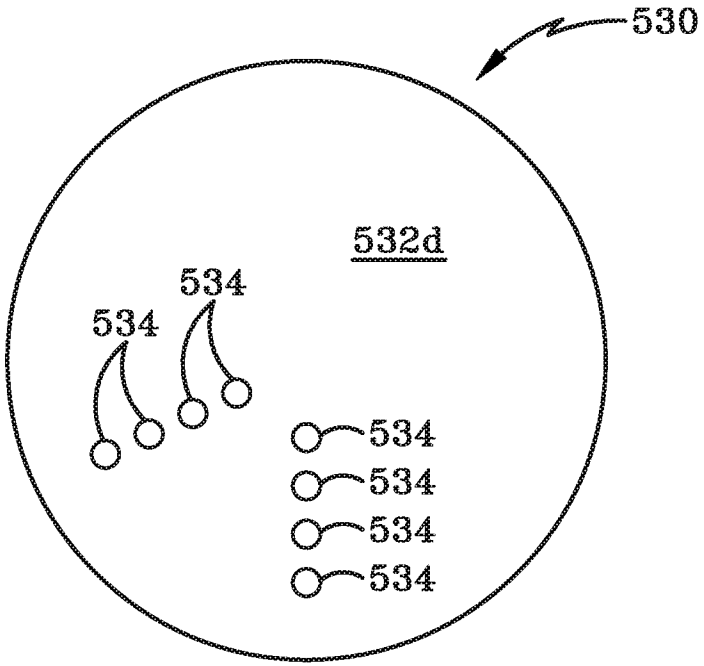
FIG. 10B is a rear end elevation view of a complementary variation of the fifth embodiment fuze setter adapter taken along line 10B-10B of FIG. 8.
Figure 10A:
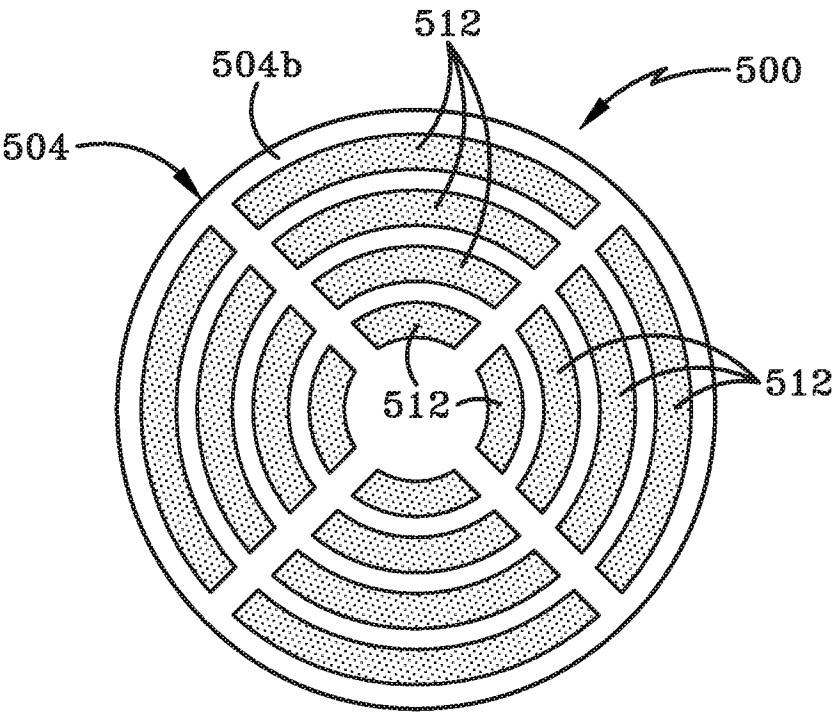
FIG. 10A is a front end elevation view of a variation of the fifth embodiment next generation fuze taken along line 10A-10A of FIG. 8.

A plurality of electrical contacts 512 are provided on front end 504*b* of radome housing 504. Electric contacts 512 provide a direct connect interface for both communications and electrical power transfer. FIG. 9A shows electrical contacts 512 arranged in a plurality of radially spaced-apart, continuous circular contact rings. FIG. 10A shows electrical contacts 512 arranged in a multiple segmented contact bands 512. The electrical contacts 512 shown in either of FIGS. 9A and 10A are operatively engaged with the electronics of NGF 500 and function in substantially the same manner as any of the contact pads and contact rings 112, 212, 312, and 412.

FSA 530 has a first region 530A configured to engage with NGF 500 and a second region 530B configured to engage with LFS 12. FSA 530 includes a housing 532. Housing 532 in first region 530A of FSA 530 includes a wall 532*a* that defines an opening to a port 532*b* defined by housing 532. In particular, port 532*b* is bounded and defined by an inwardly extending and tapered sidewall 532*c* and an end wall 532*d*. Port 532*b* is shaped and sized to be complementary to the nose region of NGF 500 and to physically receive the nose region therein.

The first region 530A of FSA 530 includes a plurality of electrical contacts 534 that are of a substantially identical construction and function as electrical contacts 116 of the aforementioned NGFS 102 (FIG. 2). Electrical contacts 534 are configured to selectively extend into cavity 532*b* of fuze setter adapter and come into direct contact with contact pads 512. In particular, electrical contacts 534 are provided on end wall 532*d* so that when front end 504*b* of radome housing 504 is moved to a position adjacent end wall 532*d*, electrical contacts 534 will directly come into contact with contact pads 512. FIG. 9B illustrates a configuration of electrical contacts 534 when electrical contacts 512 are arranged in substantially continuous rings shown in FIG. 9A. FIG. 10B illustrates a configuration of electrical contacts 534 when electrical contacts 512 are arranged in segmented rings shown in FIG. 10A. When radome housing 504 is physically received in port 532*b*, there is direct contact between electrical contacts 534 and contact pads 512 and this results in a high power, low speed interface for efficient electrical power transfer from FSA 530 to NGF 500 and high speed bi-directional communication between FSA 530 and NGF 500.

Second region 530B of FSA 530 comprises a connector region that is complementary in shape and size to the chamber 18*b* defined by LFS 12. The second region 530B is configured to be physically received within chamber 18*b*. The connector region as illustrated in FIG. 8 includes a tapered sidewall 532*e* and an end wall 532*f*. Sidewall 532*e* includes an interior surface 532*e*' that bounds and defines an interior compartment 532*g*. Second region 530B of FSA 530 is provided with a single fuze setter adapter induction coil 536 located within interior compartment 532*g*, adjacent the interior surface 532*e*' of sidewall 532*e*. Fuze setter adapter induction coil 536 is of a type that is compatible with induction coil 20 of LFS 12. Induction coil 536 is capable of electrical power transfer and data/communications with induction coil 20. When second region 530B of FSA 530 is received within chamber 18*b*, an electrical and communications interface is established between induction coil 20 and induction coil 536 that enables electrical power to be transferred from LFS 12 to FSA 530 and that further enables bidirectional data communication between LFS 12 and FSA 530.

In accordance with another aspect of the present disclosure, FSA 530 includes a processor control 560 operatively engaged with electrical contacts 534 by wiring 562. Processor control 560 is also operatively engaged with the single fuze setter adapter induction coil 536 by wiring 564. The processor control 560 includes control and electrical power electronics that enable NGF 500 and the LFS 12 to be placed in communication with each other and that further allows the LFS 12 to perform a fuze setting operation on NGF 500. The manner in which processor control 560 connects the electronics of LFS 12 and NGF 500 will be discussed later herein.

The direction arrows "C" in FIG. 8 are provided to show that NGF 500 is selectively inserted into port 532*b* in FSA 530 and is selectively removed from port 532*b*. The direction arrows "D" in FIG. 8 are provided to show that second region 430B of FSA 430 is selectively inserted into the chamber 18*b* of LFS 12 and is selectively removed from chamber 18*b*. Although not illustrated herein, it will be understood that locking mechanisms may be provided to secure FSA 530 to NGF 500 and LFS 12.

Figure 11:
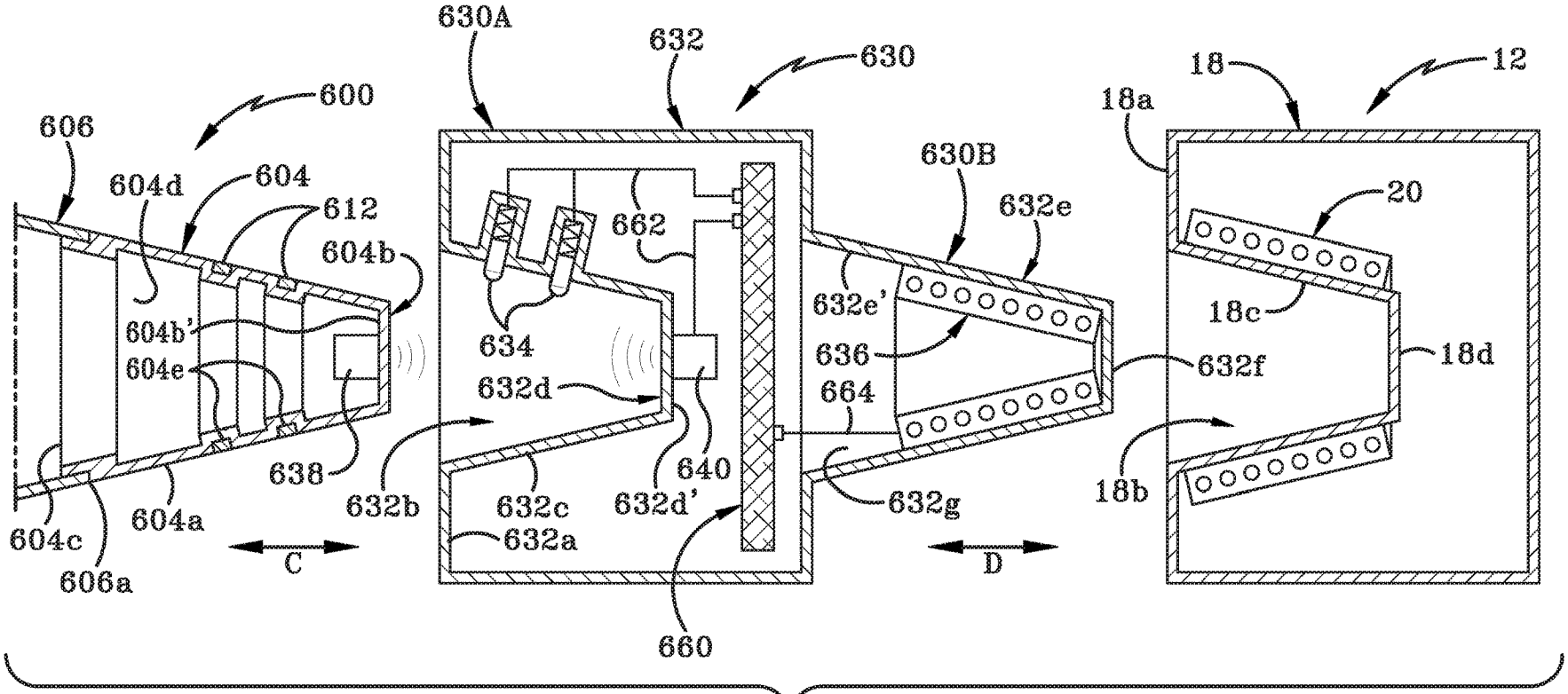
FIG. 11 is a diagrammatic longitudinal section of a nose region of a sixth embodiment next generation fuze, the incompatible legacy fuze setter, and a sixth embodiment of a fuze setter adapter in accordance with the present disclosure, shown disengaged from each other.

FIG. 11 shows a sixth embodiment of a NGF 600 and a fifth embodiment of FSA 630 in accordance with the present disclosure. FSA 630 is capable of operatively engaging NGF 600 with LFS 12, FIG. 11 shows only a portion of the nose region of NGF 600. NGF 600 includes a radome housing 604 and a fuze body 606 that are operatively engaged with each other. Radome housing 604 includes an exterior sidewall 604*a*, a front end 604*b*, and a rear end 604*c*. Radome housing 604 defines an interior cavity (not shown) within which various components may be housed. Rear end 604*c* of radome housing 604 is engaged with front end 606*a* of fuze body 606.

A plurality of grooves 604*e* are defined in sidewall 604*a* of radome housing 604. An electrical contact 612 is provided in each groove 604*e* of radome housing 604. Grooves 604*e* may extend around the entire circumference of sidewall 604*a* and if this is the case then electrical contact 612 seated within groove 604*e* is a substantially continuous contact ring similar to annular contact rings 212 (FIG. 5). In other examples, grooves 604*e* comprises a plurality of segmented groove sections that are spaced circumferentially from each other. If this is the case, then electrical contacts 612 comprise smaller segments that are substantially similar to electrical contacts 312*a*, 312*b*, 312*c* shown in FIG. 6 but are seated with the spaced-apart groove segments. As illustrated in FIG. 11, two longitudinally spaced-apart grooves 604*e* are defined in sidewall 604*a* of radome housing 604. Consequently, two longitudinal spaced-apart electrical contacts 612 are provided on radome housing 604. NGF 600 is also provided with a Radio Frequency (RF) transceiver 638 that is used for communications. RF transceiver 638 is provided adjacent an interior surface 604*b*' of front end 604. Electrical contacts 612 are a direct connect type component that is used for electrical power transfer in a similar manner to any of the contact pads or contact rings 112, 212, 312, 412, 512. Electrical contacts 612 and RF transceiver 638 are operatively engaged with the electronics of fuze.

FSA 630 has a first region 630A configured to engage with NGF 600 and a second region 630B configured to engage with LFS 12. FSA 630 includes a housing 632. Housing 632 in first region 630A of FSA 630 includes a wall 632*a* that defines an opening to a port 632*b* defined by housing 632. In particular, port 632*b* is bounded and defined by an inwardly extending and tapered sidewall 632*c* and an end wall 632*d*. Port 632*b* is shaped and sized to be complementary to the nose region of NGF 600 and to physically receive the nose region therein.

The first region 630A of FSA 630 includes a plurality of electrical contacts 634 that are of a substantially identical construction and function as electrical contacts 116 of the aforementioned NGFS 102 (FIG. 2). Electrical contacts 634 are configured to selectively extend into cavity 632*b* of fuze setter adapter and come into direct contact with contact pads 612 and thereby form a direct connect interface that is used for electrical power transfer. In particular, electrical contacts 634 are provided adjacent sidewall 632*c* in locations that are complementary to the placement of contact pads 612 on NGF 600. When radome housing 604 is physically received in port 632*b*, there is direct contact between electrical contacts 634 and contact pads 612.

In accordance with an aspect of the disclosure, FSA 630 is provided with an RF transceiver 640 that is located within FSA 630 that when radome housing 604 is inserted into port 632*b*, RF transceiver 638 and RF transceiver 640 are able to communicate with each other. RF transceiver 638 and RF transceiver 640 form a wireless interface that is used for data communication. As shown in FIG. 11, RF transceiver 640 is located adjacent an exterior surface 632*d*' of end wall 632*d*. The provision of contact pads 612 and RF transceiver 638 and electrical contacts 634 and RF transceiver 640 results in a high power, low speed interface for efficient electrical power transfer from FSA 630 to NGF 600 and high speed bi-directional communication between FSA 630 and NGF 600.

It will be understood that the positions of the contact pads 612 and RF transceiver 638 in NGF 600 may be swapped so that contact pads 612 are adjacent front end 604*d* and RF transceiver 638 is located adjacent sidewall 604*a*. If this is the case, then the locations of electrical contacts 634 and RF transceiver 640 will also be swapped so that they are in complementary locations in FSA 630 to the positions of contact pads 612 and RF transceiver 638 in NGF 600. In other examples, both of the contact pads 612 and RF transceiver 638 are provided on sidewall 604*a* or both of the contact pads 612 and RF transceiver 638 are provided on front wall 604*d*. In each of these latter instances, the electrical contacts 634 and RF transceiver 640 in FSA 630 will be located in complementary locations so that communication between fuze 630 and fuze setter adapter is able to be established.

Second region 630B of FSA 630 comprises a connector region that is complementary in shape and size to the chamber 18*b* defined by LFS 12. The second region 630B is configured to be physically received within chamber 18*b*. The connector region as illustrated in FIG. 11 includes a tapered sidewall 632*e* and an end wall 632*f*. Sidewall 632*e* includes an interior surface 632*e*' that bounds and defines an interior compartment 632*g*. Second region 630B of FSA 630 is provided with a single fuze setter adapter induction coil 636 located within interior compartment 632*g*, adjacent the interior surface 632*e*' of sidewall 632*e*. Fuze setter adapter induction coil 636 is of a type that is compatible with induction coil 20 of LFS 12. Induction coil 636 is capable of electrical power transfer and data/communications with induction coil 20. When second region 630B of FSA 630 is received within chamber 18*b*, an electrical and communications interface is established between induction coil 20 and induction coil 636 that enables electrical power to be transferred from LFS 12 to FSA 630 and that further enables bidirectional data communication between LFS 12 and FSA 630.

In accordance with another aspect of the present disclosure, FSA 630 includes a processor control 660 operatively engaged with electrical contacts 634 and with the RF transceiver 640 by wiring 662. Processor control 660 is also operatively engaged with the single fuze setter adapter induction coil 636 by wiring 664. The processor control 660 includes control and electrical power electronics that enable NGF 600 and the LFS 12 to be placed in communication with each other and that further allows the LFS 12 to perform a fuze setting operation on NGF 600. The manner in which processor control 660 connects the electronics of LFS 12 and NGF 600 will be discussed later herein.

The direction arrows "C" in FIG. 11 are provided to show that NGF 600 is selectively inserted into port 432*b* in FSA 430 and is selectively removed from port 432*b*. The direction arrows "D" in FIG. 11 are provided to show that second region 430B of FSA 430 is selectively inserted into the chamber 18*b* of LFS 12 and is selectively removed from chamber 18*b*. Although not illustrated herein, it will be understood that locking mechanisms may be provided to secure FSA 630 to NGF 600 and LFS 12.

FIGS. 12A through 15 show a variety of next generation fuzes that include various wireless interfaces for communications and electrical power transfer, and which are able to be interfaced with a common fuze setter through the provision of a fuze setter adapter in accordance with the present disclosure. The common fuze setter shown in these figures is LFS 12 but it will be understood that a different fuze setter may be selected as the common fuze setter.

Figure 12A:
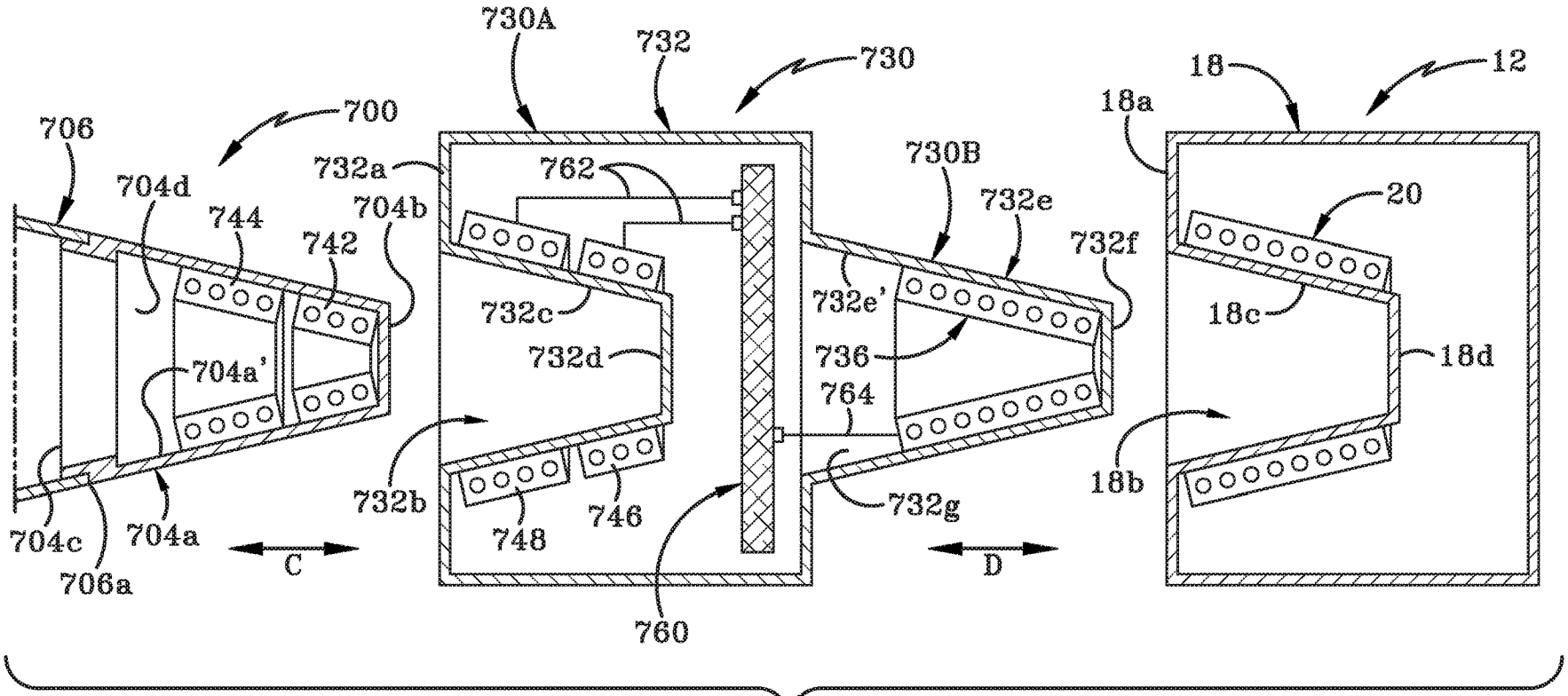
FIG. 12A is a diagrammatic longitudinal section of a nose region of a seventh embodiment next generation fuze, the incompatible legacy fuze setter, and a seventh embodiment of a fuze setter adapter in accordance with the present disclosure, shown disengaged from each other.
Figure 12B:
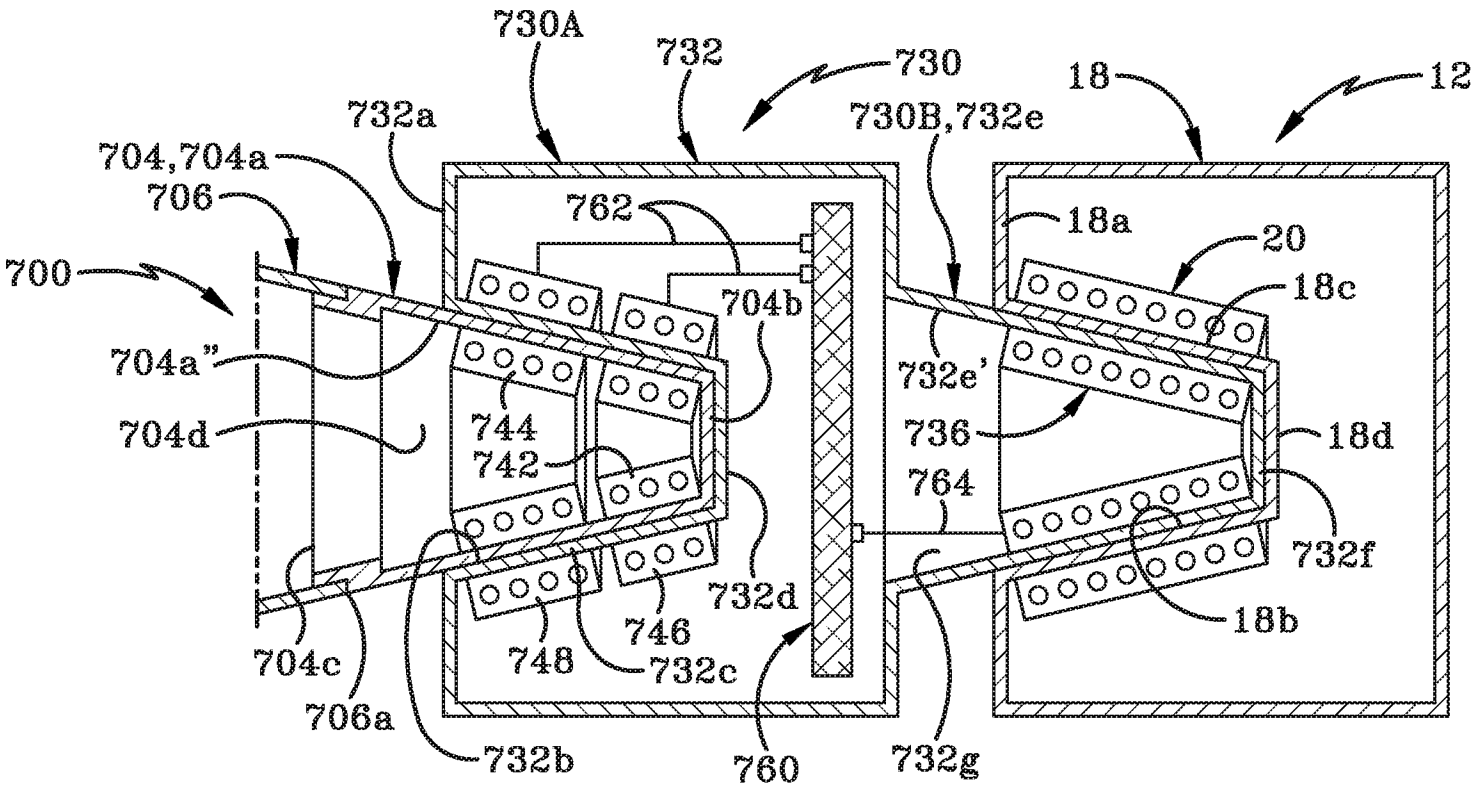
FIG. 12B is a diagrammatic longitudinal section of the nose region of the seventh embodiment next generation fuze and the incompatible legacy fuze setter engaged with the seventh embodiment fuze setter adapter of FIG. 12A.
Figure 12C:
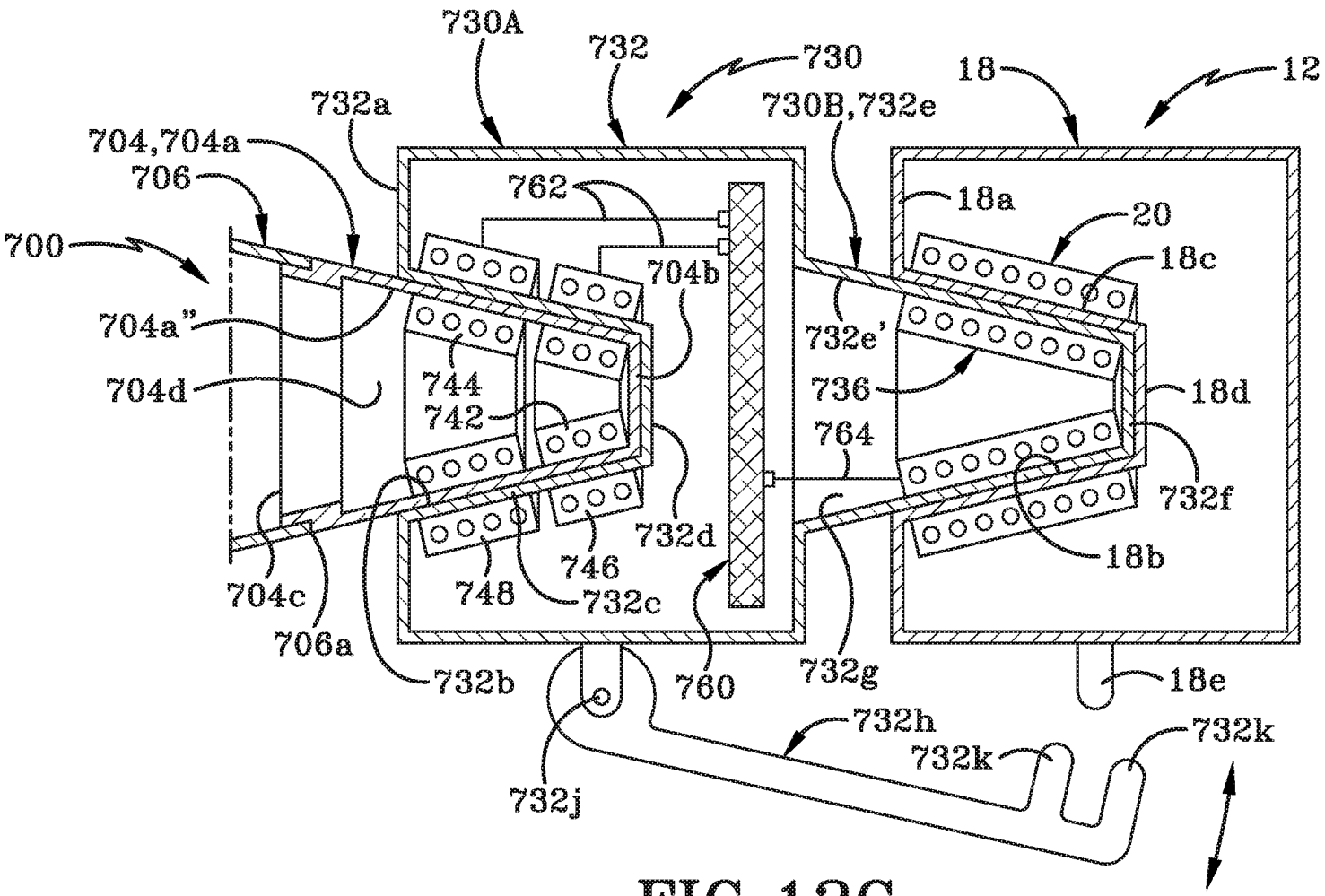
FIG. 12C is a diagrammatic longitudinal section similar to FIG. 12B but further showing a retention arm provided on the fuze setter adapter and a locking member provided on the legacy fuze setter.

FIGS. 12A through 12C show a nose region of a seventh embodiment of a next generation fuze, generally indicated at 700 and a LFS 12. The figures also show a sixth embodiment of a FSA 730 that is able to be used to physically and electronically connect NGF 700 and LFS 12 so that a fuze setting operation is able to occur. NGF 700 is an example from U.S. Ser. No. 16/294,505 of a next generation fuze that is capable of wireless electrical power transfer and wireless data communications.

NGF 700 is substantially identical to NGF 100 except for a few features that are discussed further herein. NGF 700 includes a radome housing 704 and a fuze body 706 extending rearwardly from radome housing 704. Radome housing 704 includes a sidewall 704*a*, a front end 704*b*, and a rear end 704*c* that bound and define an interior cavity 704*d*. Although not illustrated herein it will be understood that NGF 700 also includes canards, GPS antennae and various components and sensors within NGF 700 that are all substantially identical to the canards 108, GPS antennae 110 and the various components and sensors previously discussed as being located within the interior of NGF 100.

NGF 700 differs from NGF 100 in that, instead of including a plurality of direct contact electrical contact pads 114 on the radome housing 704, NGF 700 is provided with a first fuze induction coil 742 and a second fuze induction coil 744. The first and second fuze induction coils 742, 744 are located within interior cavity 704*d* of radome housing 704 and in close proximity to the interior surface of sidewall 704*a*. First fuze induction coil 742 is configured to be capable of electrical power transfer and second fuze induction coil 744 is configured to be capable of high speed communications. For this reason, first fuze induction coil 742 may also be referred to herein as a fuze power inductor 742 and the second fuze induction coil 744 may also be referred to herein as a fuze signal inductor 744.

Fuze power inductor 742 and fuze signal inductor 744 are each configured as an annular inductive coil that is positioned within interior cavity 704*d* of radome housing 704. Fuze power inductor 742 and fuze signal inductor 744 are located inwardly from and adjacent to the interior circumferential surface 704*a*' of sidewall 704*a* of radome housing 704. No part of fuze power inductor 742 or of fuze signal inductor 744 extends through sidewall 704*a* to the exterior surface 704*a*" thereof. In other words, the exterior surface 704*a*" of sidewall 704*a* is substantially continuous and uninterrupted between front wall 704*b* and rear end 704*c*. Fuze power inductor 742 and fuze signal inductor 744 are longitudinally spaced a distance apart from each other. Fuze power inductor 742 and fuze signal inductor 744 may be operatively engaged with various appropriate components housed within interior cavity 704*d* of radome housing 704 or within fuze body 706, such as the previously described fuze power supply and microprocessor.

It will be understood that either of fuze power inductor 742 and fuze signal inductor 744 may be located closest to front wall 704*b* and the other of fuze power inductor 742 and fuze signal inductor 744 is then located further away from front wall 704*b*.

In one example, fuze power inductor 742 and fuze signal inductor 744 share a common lead, in effect being realized as a single, center-tapped coil, with one tap being used for power transfer and the other for bidirectional communications.

As is evident from FIG. 12A, this dual coil configuration of NGF 700 is, incompatible with the single induction coil 20 of LFS 12. In accordance with an aspect of the present disclosure, a first embodiment of a FSA 730 is proposed that enables operational engagement between NGF 700 and LFS 12. FSA 730 operatively engages NGF 700 and LFS 12 in such a way that LFS 12 is able to perform a fuze setting operation on NGF 700; i.e., electrical power and communications and data signals are able to be transferred between LFS 12 and NGF 700.

FSA 730 has a first region 730A configured to engage with NGF 700 and a second region 730B configured to engage with LFS 12. FSA 730 includes a housing 732. The first region 730A of FSA 730 includes a wall 732*a* that defines an opening to a port 732*b* defined by housing 732. In particular, port 732*b* is bounded and defined by an inwardly extending and tapered sidewall 732*c* and an end wall 732*d*. Port 732*b* is shaped and sized to be complementary to the nose region of NGF 700 and to physically receive the nose region therein.

FSA 730 differs from the fuze setter adapters disclosed above in that it does not include any direct connect communications interface type electrical connector regions. Instead, first region 730A of FSA 730 includes a first fuze setter adapter induction coil 746 and a second fuze setter adapter induction coil 748. First fuze setter adapter induction coil 746 is configured to be capable of electrical power transfer. Second fuze setter adapter induction coil 748 is configured to be capable of high speed communications. For these reasons, first fuze setter adapter induction coil 746 may also be referred to herein as fuze setter adapter power inductor 746 and the second fuze setter adapter induction coil 748 may be referred to herein as fuze setter adapter signal inductor 748.

Fuze setter adapter power inductor 746 and fuze setter adapter signal inductor 748 may each be an annular inductive coil that is positioned outwardly from and adjacent to the interior circumferential surface 732*c*' of sidewall 732*c* of FSA 730. No part of fuze setter adapter power inductor 746 or of fuze setter adapter signal inductor 748 may extend through sidewall 732*c* to the exterior surface 732*c*" thereof and into cavity 732*c*. The exterior surface 732*c*" of sidewall 732*c* is therefore free of any obstructions or breaks. Fuze setter adapter power inductor 746 and fuze setter adapter signal inductor 748 may be longitudinally spaced from each other. Fuze setter adapter power inductor 746 is positioned to matingly align with fuze power inductor 742 and fuze setter adapter signal inductor 748 is positioned to matingly align with fuze setter adapter signal inductor 748 when fuze 704 is received in port 732*b*. Each of fuze setter adapter power inductor 746 and fuze setter adapter signal inductor 748 may be configured as annular coils that will circumscribe fuze power inductor 742 and fuze signal inductor 744, respectively, when radome housing 704 of NGF 700 is inserted into port 732*b*. It will be understood that if the locations of fuze power inductor 742 and fuze signal inductor 744 are swapped in position relative to what is illustrated in FIG. 12A, then fuze setter adapter power inductor 746 and fuze setter adapter signal inductor 748 will be similarly swapped in position. In one example, fuze setter adapter power inductor 746 and fuze setter adapter signal inductor 748 may share a common lead, in effect being realized as a single, center-tapped coil, with one tap being used for power transfer and the other for bidirectional communications.

When radome housing 704 is received in port 732*b*, there is inductive coupling between fuze power inductor 742 and fuze setter adapter power inductor 746 and this results in a high power, low speed interface for efficient electrical power transfer from FSA 730 to NGF 700. Additionally, there is inductive coupling between fuze signal inductor 744 and fuze setter adapter signal inductor 748 and this results in a high speed, lower power coupling for bidirectional data communications between FSA 730 and NGF 700.

Second region 730B of FSA 730 comprises a connector region that is complementary in shape and size to the chamber 18*b* defined by LFS 12. The second region 730B is configured to be physically received within chamber 18*b*.

The connector region as illustrated in FIG. 12A includes a tapered sidewall 732*e* and an end wall 732*f*. Sidewall 732*e* includes an interior surface 732*e*' that bounds and defines an interior compartment 732*g*.

Second region 730B of FSA 730 is provided with a single fuze setter adapter induction coil 736 located within interior compartment 732*g*, adjacent the interior surface 732*e*' of sidewall 732*e*. Fuze setter adapter induction coil 736 is of a type that is compatible with induction coil 20 of LFS 12. Induction coil 736 is capable of electrical power transfer and data/communications transfer with induction coil 20.

In accordance with another aspect of the present disclosure, FSA 730 also includes a processor control 760 operatively engaged with fuze setter adapter power inductor 746 and fuze setter adapter signal inductor 748 by wiring 762. It will be understood that the wiring 762 illustrated herein diagrammatically is representative of the connectivity between processor control 760 and the inductors 746, 748. Processor control 760 is also operatively engaged with the single fuze setter adapter induction coil 736 by wiring 764. It will be understood that the wiring 764 illustrated herein diagrammatically is representative of the connectivity between processor control 760 and the inductor 736. The processor control 760 includes control and electrical power electronics that enable NGF 700 and the LFS 12 to be placed in communication with each other and that further allows the LFS 12 to perform a fuze setting operation on NGF 700. The manner in which processor control 760 connects the electronics of LFS 12 and NGF 700 will be discussed later herein.

FIG. 12B shows NGF 700 mechanically received within port 732*b* of FSA 730 and second region 7308 of FSA 730 mechanically received within chamber 18*b* of LFS 12. FIG. 12B further shows an electrical power interface formed between fuze power inductor 742 and fuze setter adapter power inductor 746; and a communications interface formed between fuze communications inductor 744 and fuze setter adapter communications inductor 748. FIG. 12B additionally shows a power and communications interface formed between fuze setter adapter induction coil 736 and legacy fuze setter induction coil 20. The direction arrows "C" are provided to show that NGF 700 is selectively inserted into port 732*b* in FSA 730 and is selectively removed from port 732*b*. The direction arrows "D" are provided to show that second region 730B of FSA 730 is selectively inserted into the chamber 18*b* of LFS 12 and is selectively removed from chamber 18*b*.

FIG. 12C illustrates a retention arm 732*h* that is pivotally engaged with the housing 732 of FSA 730 by a pivot pin 732*j*. Retention arm 732*h* is able to be pivoted in a first direction and into interlocking engagement with a locking member 18*e* on LFS 12 in order to hold FSA 730 in mechanical engagement with LFS 12. Retention arm 732*h* is able to be pivoted in a second direction and out of engagement with locking member 18*e* when it is desired to disengage fuze setter adapter 12 from LFS 12. The arrow "E" is provided to show the selectively pivotal motion of retention arm 732*h* either toward locking member 18*e* or away from locking member 18*e*. It will be understood that retention arm 732*h* and locking member 18*e* are exemplary of any type of locking mechanism that may be utilized to hold a fuze setter adapter in engagement with a fuze setter. Although not shown in any of the figures, it will be further understood that a locking mechanism for holding a fuze to fuze setter adapter may also be provided.

Figure 13:
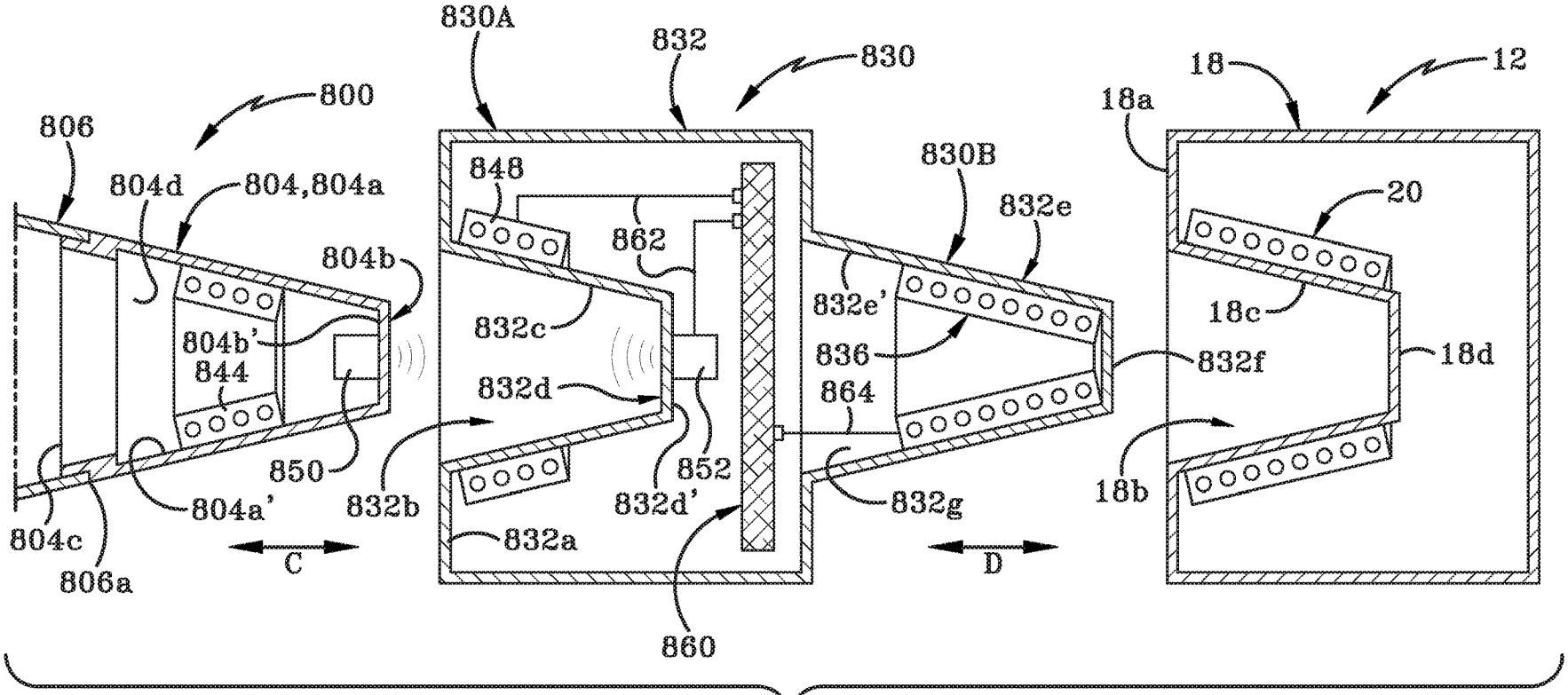
FIG. 13 is a diagrammatic longitudinal section of a nose region of an eighth embodiment next generation fuze, the incompatible legacy fuze setter, and an eighth embodiment of a fuze setter adapter in accordance with the present disclosure, shown disengaged from each other.

FIG. 13 is diagrammatic longitudinal section of an eighth embodiment of a NGF 800, a LFS 12, and a seventh embodiment of a FSA 830 in accordance with the present disclosure. FSA 830 is used to operationally engage NGF 800 and LFS 12 with each other.

NGF 800 is substantially identical to NGF 700 except for a few features that are discussed further herein. NGF 800 includes a radome housing 804 and a fuze body 806 extending rearwardly from radome housing 804. Radome housing 804 includes a sidewall 804*a*, a front end 804*b*, and a rear end 804*c* that bound and define an interior cavity 804*d*. A front end 806*a* of fuze body 806 extends rearwardly from rear end 804*c* of radome housing 804. Although not illustrated herein it will be understood that NGF 800 also includes canards, GPS antennae and various components and sensors as previously discussed. Instead of first and second induction coils 742, 744 that are present in NGF 700, NGF 800 has a single induction coil 844 and an RF transceiver 850. RF transceiver 850 is of a type that communicates wirelessly, e.g. RF transceiver 850 may be a BLUETOOTH® transceiver. In another example, the RF transceiver 850 may be a custom-built RF transceiver for the specific application of fuze setting utilizing a fuze setter adapter. RF transceiver 850 is used for communications and induction coil 844 is utilized for electrical power transfer. As is evident from FIG. 13, both of the induction coil 844 and the RF transceiver 850 are located adjacent interior surfaces 804*a*' of sidewall 804*a* and 804*b*' of front end 804*b*, respectively. No part of the induction coil 844 or RF transceiver 850 extends through the associated sidewall 804*a* and front end 804*b*. By including the wireless interface within the cavity of FSA 830, the interface can be very low power because of the close proximity between transmitter and receiver. Also, the fuze setter adapter may be designed to provide shielding, such that Radio Frequency energy (or optical energy as will be described later herein) is not broadcast into the environment. Each of these elements helps to ensure a high degree of data security and covertness in that little to no energy escapes into the ambient environment where it may be detected.

FSA 830 has a first region 830A configured to engage with NGF 800 and a second region 830B configured to engage with LFS 12. FSA 830 differs from the fuze setter adapters disclosed above in a number of ways that will be discussed hereafter. FSA 830 includes a housing 832. The first region 830A of FSA 830 includes a wall 832*a* that defines an opening to a port 832*b* defined by housing 832. In particular, port 832*b* is bounded and defined by an inwardly extending and tapered sidewall 832*c* and an end wall 832*d*. Port 832*b* is shaped and sized to be complementary to the nose region of NGF 800 and to physically receive the nose region therein.

The first region 830A of FSA 830 includes a fuze setter adapter induction coil 848 and an RF transceiver 852 instead of first fuze setter adapter induction coil 746 and a second fuze setter adapter induction coil 748 provided on FSA 730. As is evident from FIG. 13 both of the fuze setter adapter induction coil 848 and RF transceiver 852 are located adjacent an interior surface of sidewall 832*c* and end wall 832*d*, respectively, and no part of coil 848 or transceiver 852 extends through the associated sidewall or front wall and into port 832*b*. Fuze setter adapter induction coil 848 and RF transceiver 852 are configured so as to be capable of transferring electrical power and high speed communications to induction coil 844 and RF transceiver 850, respectively.

Second region 830B of FSA 830 is substantially identical to second region 730B of FSA 730. Second region 830B of FSA 830 comprises a connector region that is complementary in shape and size to the chamber 18*b* defined by LFS 12. The second region 830B is configured to be physically received within chamber 18*b*. The connector region as illustrated in FIG. 13 includes a tapered sidewall 832*e* and an end wall 832*f*. Sidewall 832*e* includes an interior surface 832*e*' that bounds and defines an interior compartment 832*g*. Second region 830B of FSA 830 is provided with a single fuze setter adapter induction coil 836 located within interior compartment 832*g*, adjacent the interior surface 832*e*' of sidewall 832*e*. Fuze setter adapter induction coil 836 is of a type that is compatible with induction coil 20 of LFS 12. Induction coil 836 is capable of electrical power transfer and data/communications transfer with induction coil 20.

Fuze setter adapter induction coil 848 and RF transceiver 852 are connected to a processor control 860 by wiring 862. Processor control 860 is operatively engaged with fuze setter adapter induction coil 836 by wiring 864. The processor control 860 includes control and electrical power electronics that enable NGF 800 and the LFS 12 to be placed in communication with each other and that further allows the LFS 12 to perform a fuze setting operation on NGF 800. Processor control 860 is substantially identical to processor control 760 except in any aspects for the control and functioning of RF transceiver 852. The manner in which processor control 860 connects the electronics of LFS 12 and NGF 800 will be discussed later herein.

The arrows "C" shows that NGF 800 may be physically introduced into port 832*b* for fuze setting and may be removed therefrom once fuze setting is completed. The arrows "D" shows that FSA 830 may be physically introduced into chamber 18*b* of legacy fuze 18 for fuze setting and may be removed therefrom once fuze setting is completed. Although not illustrated herein, it will be understood that locking mechanisms may be provided to secure FSA 830 to NGF 800 and LFS 12.

Figure 14:
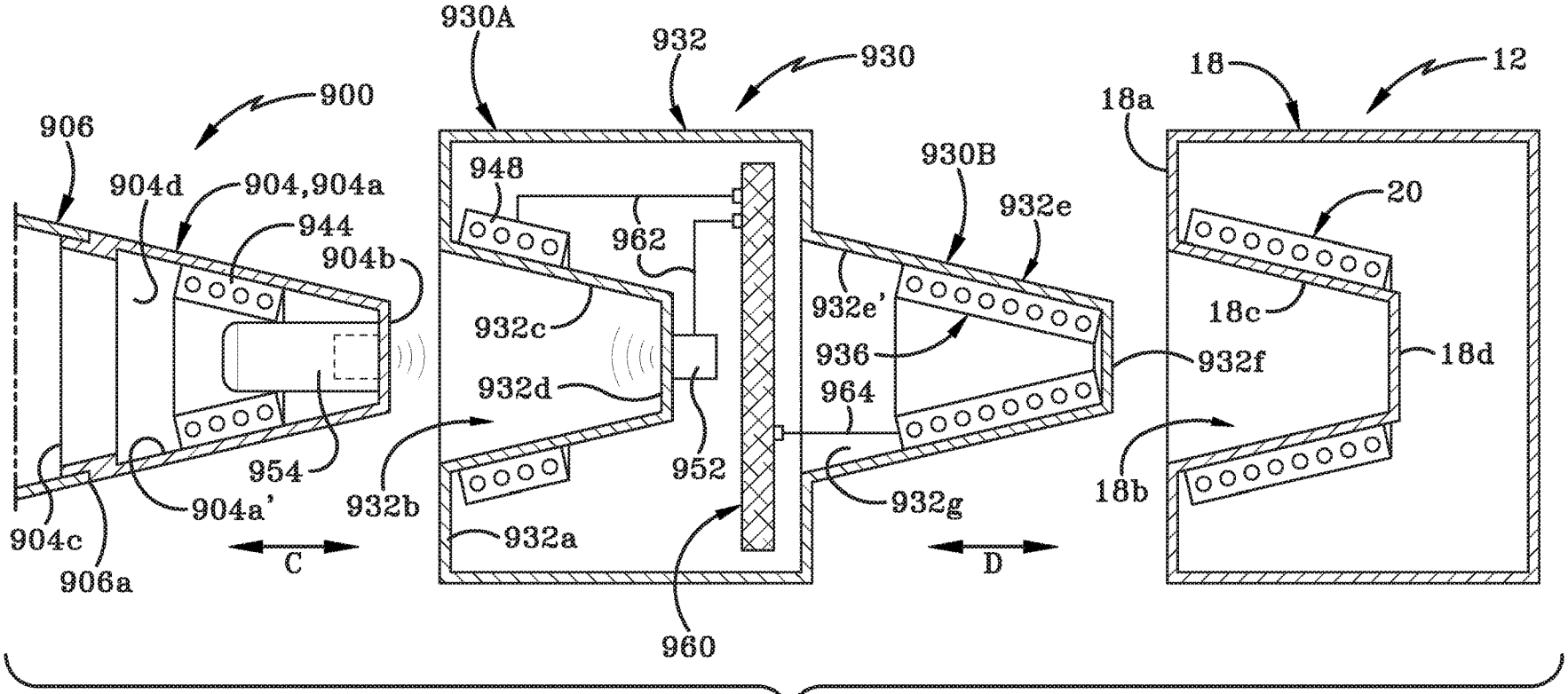
FIG. 14 is a diagrammatic longitudinal section of a nose region of a ninth embodiment next generation fuze, the incompatible legacy fuze setter, and a ninth embodiment of the fuze setter adapter, shown disengaged from each other.

FIG. 14 is diagrammatic longitudinal section of a ninth embodiment of a NGF 900, a LFS 12, and a ninth embodiment of a FSA 930 in accordance with the present disclosure. FSA 930 is used to operationally engage NGF 900 and LFS 12 with each other.

NGF 900 is substantially identical to NGF 800 except for a few features that are discussed further herein. NGF 900 includes a radome housing 904 and a fuze body 906 extending rearwardly from radome housing 904. Radome housing 904 includes a sidewall 904*a*, a front end 904*b*, and a rear end 904*c* that bound and define an interior cavity 904*d*. A front end 906*a* of fuze body 906 extends rearwardly from rear end 904*c* of radome housing 904. Although not illustrated herein it will be understood that NGF 900 also includes canards, GPS antennae and various components and sensors as previously discussed.

NGF 900 has a single induction coil 944 and a Height of Burst (HoB) sensor 954 instead of RF transceiver 850 or a second induction coil. HoB sensor 954 is a Height of Burst sensor that has transmitting and receiving capability (i.e., $T_x/R_x$ capability). HoB sensor 954 is used for communications and induction coil 944 is utilized for electrical power transfer. As is evident from FIG. 14, both induction coil 944 and HoB sensor 954 are located adjacent interior surfaces 904*a*' of sidewall 904*a* and 904*b*' of front end 904*b*, respectively. No part of the induction coil 944 or of HoB sensor 954 extends through the associated sidewall 904*a* and front end 904*b*.

FSA 930 has a first region 930A configured to engage with NGF 900 and a second region 930B configured to engage with LFS 12. FSA 930 includes a housing 932. The first region 930A of FSA 930 includes a wall 932*a* that defines an opening to a port 932*b* defined by housing 932. In particular, port 932*b* is bounded and defined by an inwardly extending and tapered sidewall 932*c* and an end wall 932*d*. Port 932*b* is shaped and sized to be complementary to the nose region of NGF 900 and to physically receive the nose region therein. FSA 930 is substantially identical to FSA 830 in that first region 930A includes a fuze setter adapter induction coil 948 and an RF transceiver 952. As is evident from FIG. 14 both of the fuze setter adapter induction coil 948 and RF transceiver 952 are located adjacent an interior surface of sidewall 932*c* and end wall 932*d*, respectively, and no part of coil 948 or transceiver 952 extends through the associated sidewall or front wall and into port 932*b*. Fuze setter adapter induction coil 948 and RF transceiver 952 are configured so as to be capable of transferring electrical power and high speed communications to induction coil 944 and to HoB sensor 954, respectively.

Second region 930B of FSA 930 is substantially identical to second region 830B of FSA 830. Second region 930B of FSA 930 comprises a connector region that is complementary in shape and size to the chamber 18*b* defined by LFS 12. The second region 930B is configured to be physically received within chamber 18*b*. The connector region as illustrated in FIG. 14 includes a tapered sidewall 932*e* and an end wall 932*f*. Sidewall 932*e* includes an interior surface 932*e*' that bounds and defines an interior compartment 932*g*. Second region 930B of FSA 930 is provided with a single fuze setter adapter induction coil 936 located within interior compartment 932*g*, adjacent the interior surface 932*e*' of sidewall 932*e*. Fuze setter adapter induction coil 936 is of a type that is compatible with induction coil 20 of LFS 12. Induction coil 936 is capable of electrical power transfer and data/communications transfer with induction coil 20.

Fuze setter adapter induction coil 948 and RF transceiver 952 are connected to a processor control 960 by wiring 962. Processor control 960 is operatively engaged with fuze setter adapter induction coil 936 by wiring 964. The processor control 960 includes control and electrical power electronics that enable NGF 900 and the LFS 12 to be placed in communication with each other and that further allows the LFS 12 to perform a fuze setting operation on NGF 900. Processor control 960 is substantially identical to processor control 860 except in any aspects for the control and functioning of RF transceiver 952 and its interaction with HoB sensor 954. The manner in which processor control 960 connects the electronics of LFS 12 and NGF 900 will be discussed later herein.

The arrows "C" shows that NGF 900 may be physically introduced into port 932*b* for fuze setting and may be removed therefrom once fuze setting is completed. The arrows "D" shows that FSA 930 may be physically introduced into chamber 18*b* of legacy fuze 18 for fuze setting and may be removed therefrom once fuze setting is completed. Although not illustrated herein, it will be understood that locking mechanisms may be provided to secure FSA 930 to NGF 900 and LFS 12.

Figure 15A:
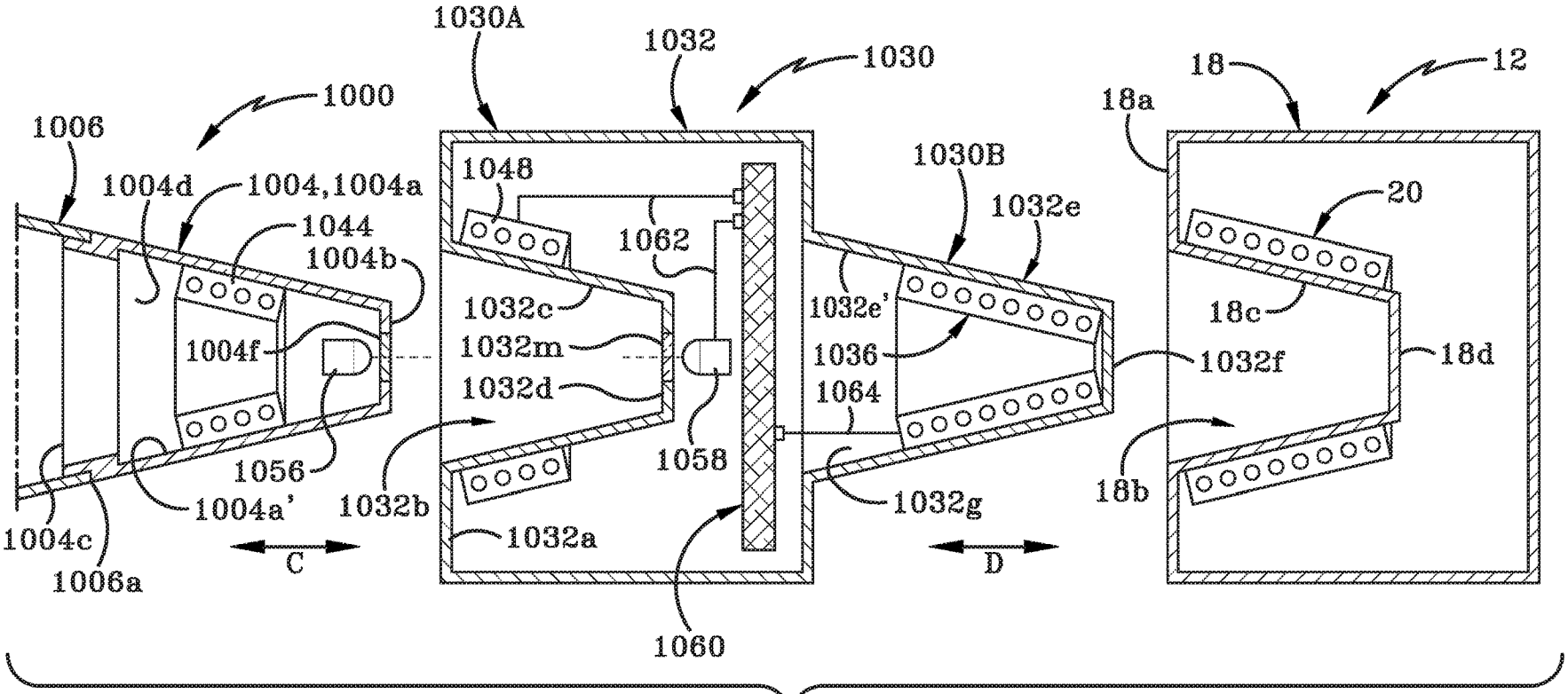
FIG. 15A is a diagrammatic longitudinal section of a nose region of a tenth embodiment next generation fuze, the incompatible legacy fuze setter, and a tenth embodiment of a fuze setter adapter in accordance with the present disclosure, shown disengaged from each other.
Figure 15B:
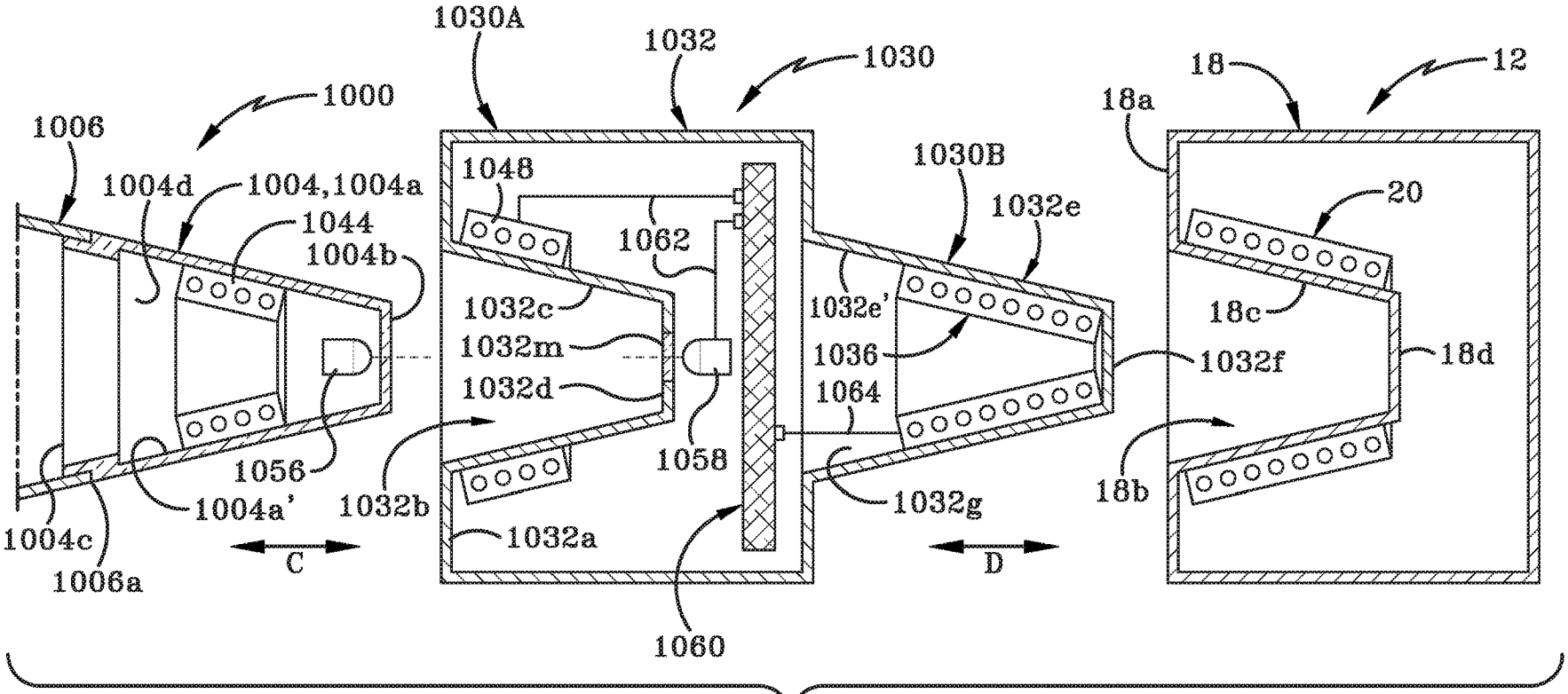
FIG. 15B is a diagrammatic longitudinal section of a nose region of a variation of the tenth embodiment next generation fuze, the incompatible legacy fuze setter, and the tenth embodiment fuze setter adapter, shown disengaged from each other.

FIGS. 15A and 15B are diagrammatic longitudinal section views of a tenth embodiment of a NGF 1000, a LFS 12, and a tenth embodiment of a FSA 1030 in accordance with the present disclosure. FSA 1030 is used to operationally engage NGF 1000 and LFS 12 with each other.

NGF 1000 is substantially identical to NGF 900 except for a few features that are discussed further herein. NGF 1000 includes a radome housing 1004 and a fuze body 1006 extending rearwardly from radome housing 1004. Radome housing 1004 includes a sidewall 1004*a*, a front end 1004*b*, and a rear end 1004*c* that bound and define an interior cavity

1004*d*. A front end 1006*a* of fuze body 1006 extends rearwardly from rear end 1004*c* of radome housing 1004. Although not illustrated herein it will be understood that NGF 1000 also includes canards, GPS antennae and various components and sensors as previously discussed.

NGF 1000 has a single induction coil 1044 and an optical transceiver 1056 instead of a HoB sensor 954, RF transceiver 850, or a second induction coil. Optical transceiver 1056 is an interface used for communications and induction coil 1044 is an interface used for electrical power transfer. As is evident from FIGS. 15A and 15B, both induction coil 1044 and optical transceiver 1056 are located adjacent interior surfaces 1004*a*' of sidewall 1004*a* and 1004*b*' of front end 1004*b*, respectively. No part of the induction coil 1044 or of optical transceiver 1056 extends through the associated sidewall 1004*a* and front end 1004*b*.

FIG. 15A illustrates a first example of NGF 1000 where front end 1004*b* of radome housing 1004 includes a transparent window 1004*f* therein. Optical transceiver 1056 is located adjacent window 1004*f* so that optical signals may be transmitted or received through window 1004*f*. FIG. 15B illustrates a second example of NGF 1000 where substantially the entire front end 1004*b* of radome housing 1004 is fabricated from a transparent material that permits optical signals to be transmitted or received therethrough.

FSA 1030 has a first region 1030A configured to engage with NGF 1000 and a second region 1030B configured to engage with LFS 12. FSA 1030 includes a housing 1032. The first region 1030A of FSA 1030 includes a wall 1032*a* that defines an opening to a port 1032*b* defined by housing 1032. In particular, port 1032*b* is bounded and defined by an inwardly extending and tapered sidewall 1032*c* and an end wall 1032*d*. Port 1032*b* is shaped and sized to be complementary to the nose region of NGF 1000 and to physically receive the nose region therein. FSA 1030 differs from FSA 930 in that first region 1030A includes a fuze setter adapter induction coil 1048 and an optical transceiver 1058 instead of an RF transceiver 952. As is evident from FIGS. 15A and 15B, both of the fuze setter adapter induction coil 1048 and optical transceiver 1058 are located adjacent an interior surface of sidewall 1032*c* and end wall 1032*d*, respectively. No part of coil 1048 or transceiver 952 extends through the associated sidewall or front wall and into port 1032*b*. A transparent window 1032*m* is provided in end wall 1032*d* and optical transceiver 1058 is located proximate window 1032*m* so that optical signals are able to be transmitted or received through window 1032*m*. Although not illustrated, it will be understood that in other examples, end wall 1032*d* is fabricated from a transparent material that permits optical signals to be transmitted or received therethrough. Fuze setter adapter induction coil 1048 and optical transceiver 1058 are configured so as to be capable of transferring electrical power and high speed communications to induction coil 1044 and to optical transceiver 1056, respectively.

Second region 1030B of FSA 1030 is substantially identical to second region 930B of FSA 930. Second region 1030B of FSA 1030 comprises a connector region that is complementary in shape and size to the chamber 18*b* defined by LFS 12. The second region 1030B is configured to be physically received within chamber 18*b*. The connector region as illustrated in FIGS. 15A and 15B includes a tapered sidewall 1032*e* and an end wall 1032*f*. Sidewall 1032*e* includes an interior surface 1032*e*' that bounds and defines an interior compartment 1032*g*. Second region 10308 of FSA 1030 is provided with a single fuze setter adapter induction coil 1036 located within interior compartment 1032*g*, adjacent the interior surface 1032*e*' of sidewall 1032*e*. Fuze setter adapter induction coil 1036 is of a type that is compatible with induction coil 20 of LFS 12. Induction coil 1036 is capable of electrical power transfer and data/communications transfer with induction coil 20.

Fuze setter adapter induction coil 1048 and optical transceiver 1058 are connected to a processor control 1060 by wiring 1062. Processor control 1060 is operatively engaged with fuze setter adapter induction coil 1036 by wiring 1064. The processor control 1060 includes control and electrical power electronics that enable NGF 1000 and the LFS 12 to be placed in communication with each other and that further allows the LFS 12 to perform a fuze setting operation on NGF 1000. Processor control 1060 is substantially identical to processor control 960 except in any aspects for the control and functioning of optical transceiver 1058 and its interaction with optical transceiver 1056. The manner in which processor control 1060 connects the electronics of LFS 12 and NGF 1000 will be discussed later herein.

The arrows "C" shows that NGF 1000 may be physically introduced into port 1032*b* for fuze setting and may be removed therefrom once fuze setting is completed. The arrows "D" shows that FSA 1030 may be physically introduced into chamber 18*b* of legacy fuze 18 for fuze setting and may be removed therefrom once fuze setting is completed. Although not illustrated herein, it will be understood that locking mechanisms may be provided to secure FSA 1030 to NGF 1000 and LFS 12.

Figure 16A:
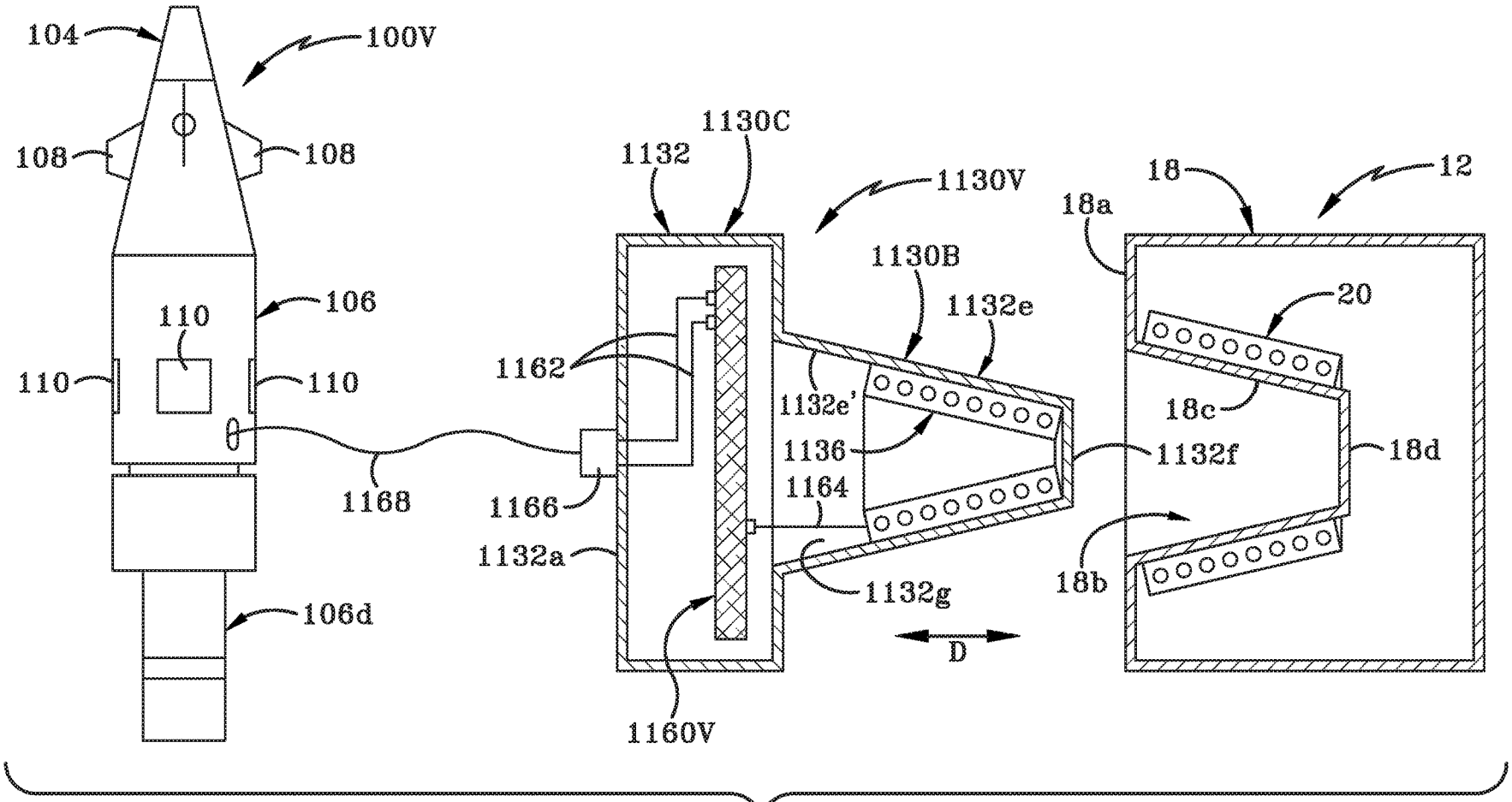
FIG. 16A is a diagrammatic, partial side elevation, longitudinal section of the legacy fuze setter of FIG. 1, an incompatible next generation fuze, and an eleventh embodiment of a fuze setter adapter that is connected to the next generation fuze.

FIG. 16A is a diagrammatic longitudinal section view of an exemplary NGF 100V, a LFS 12, and an eleventh embodiment of a FSA 1130V in accordance with the present disclosure. NGF 100V includes a direct connect interface for both communications and electrical power transfer. However, instead of the direct connect interface being in the form of contact pads or contact rings, a connector region cable is utilized as will be later discussed herein. In other examples, a connector port may be utilized. NGF 100V is either internally powered (e.g. has an internal battery) or is powered via a secondary external source.

FSA 1130V differs from all embodiments of fuze setter adapter disclosed herein in that it does not include a first region that is configured to receive a nose region of NGF 100V therein. FSA 1130V does, however, include a second region 11308 that is configured to mate with LFS 12. FSA 1130V includes a housing 1132 that has a front wall 1132*a* but no port is defined in front wall 1132. Second region 1130B of FSA 1130V is substantially identical to second region 1030B of FSA 1030. Second region 1130B of FSA 1130V comprises a connector region that is complementary in shape and size to the chamber 18*b* defined by LFS 12. The second region 1030B is configured to be physically received within chamber 18*b*. The connector region as illustrated in FIG. 16A includes a tapered sidewall 1132*e* and an end wall 1132*f*. Sidewall 1132*e* includes an interior surface 1132*e*' that bounds and defines an interior compartment 1132*g*. Second region 1130B of FSA 1130V is provided with a single fuze setter adapter induction coil 1136 located within interior compartment 1132*g*, adjacent the interior surface 1132*e*' of sidewall 1132*e*. Fuze setter adapter induction coil 1136 is of a type that is compatible with induction coil 20 of LFS 12. Induction coil 1136 is capable of electrical power transfer and data/communications transfer with induction coil 20. An electrical connector region 1166 is provided on front wall 1132*a* of FSA 1130V. Electrical connector region 1166 provides a location on FSA 1130V for engagement of connector region cable 1168 from NGF 100V.

A processor control 1160V is provided in FSA 1130V. Processor control 1160V is operatively engaged with electrical connector region 1166 by wiring 1162. Processor control 1160V is operatively engaged with fuze setter adapter induction coil 1136 by wiring 1164. The processor control 1160V includes control electronics that enable NGF 100V and the LFS 12 to be placed in communication with each other and that further allows the LFS 12 to perform a fuze setting operation on NGF 100V. The manner in which processor control 1160V connects the electronics of LFS 12 and NGF 100V will be discussed later herein.

The arrows "D" shows that FSA 1130V may be physically introduced into chamber 18*b* of legacy fuze 18 for fuze setting and may be removed therefrom once fuze setting is completed. Although not illustrated herein, it will be understood that locking mechanisms may be provided to secure FSA 1130V to NGF 100V and LFS 12.

Figure 16B:
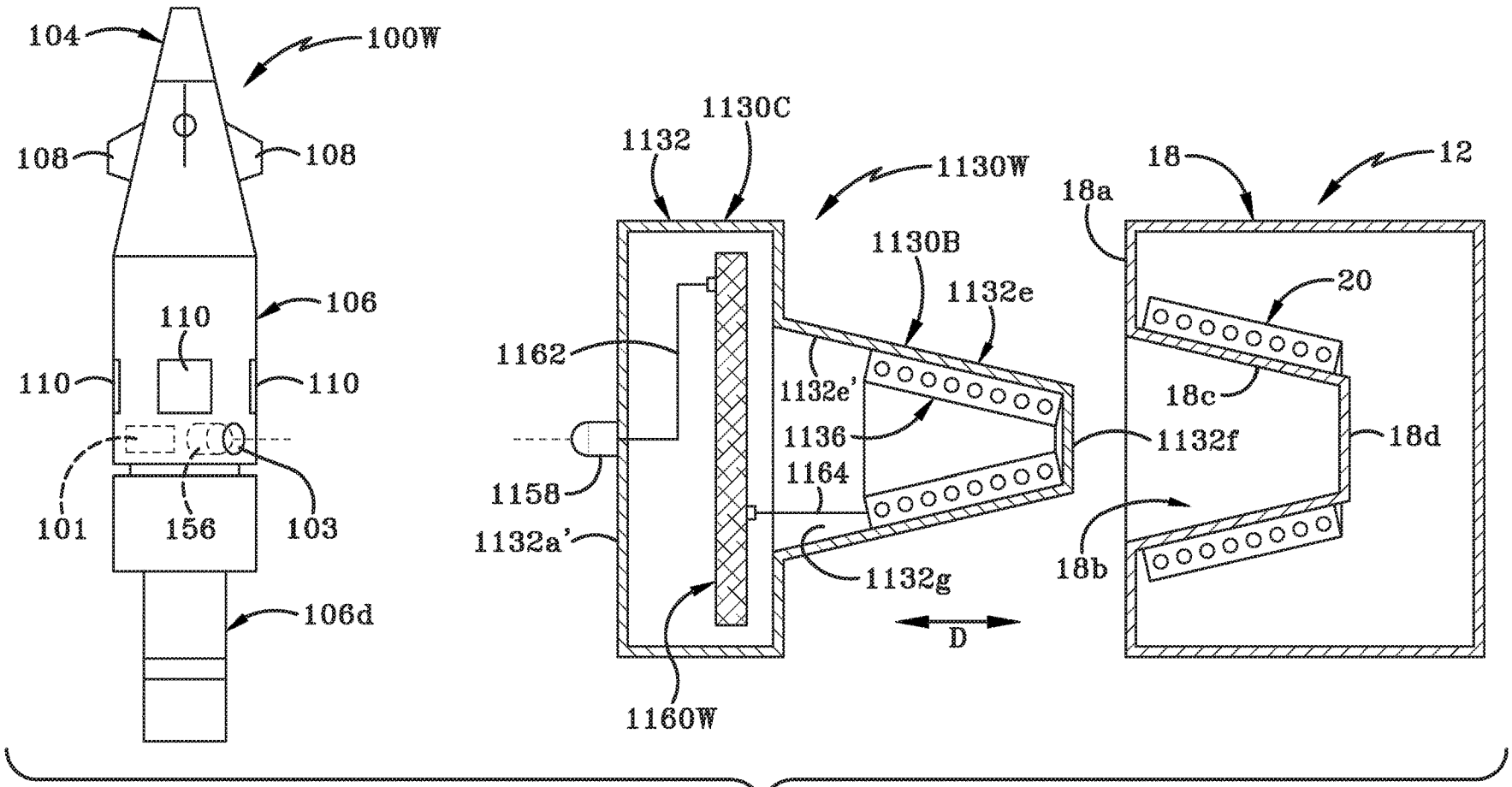
FIG. 16B is a diagrammatic, partial side elevation, longitudinal section of the legacy fuze setter of FIG. 1, an incompatible next generation fuze, and a twelfth embodiment of a fuze setter adapter that is wirelessly connected to the next generation fuze.

FIG. 16B is a diagrammatic longitudinal section view of an exemplary NGF 100W, a LFS 12, and a twelfth embodiment of a FSA 1130W in accordance with the present disclosure. NGF 100W includes a wireless interface for both communications and electrical power transfer. In this particular instance, the wireless interface is illustrated as an optical transceiver 156. Optical transceiver 156 is located within the interior of NGF 100W and adjacent a transparent window 103 through which optical signals are able to be transmitted or received. NGF 100W includes an internal power source 101, such as a battery. The power source 101 is provided because sufficient electrical power to operate NGF 100W may not be able to be transferred over the wireless interface. NGF 100W therefore has the separate source of electrical power 101 and will include a power switch of some type (not shown) to turn the NGF 100W on so that it can function and establish communication with FSA 1130W. NGF 100W may be placed at some distance from FSA 1130W, anticipated to be somewhere from about 1 m up to about 10 m away. It will be understood that instead of an optical transceiver 156 in NGF 100W, an RF transceiver may be utilized and window 103 may be omitted from NGF 100W. It will further be understood that the wireless interface, whether an optical transceiver or a RF transceiver, may be located anywhere on NGF 100W. Utilizing these types of wireless interface may result in data being broadcast into the environment. Thus, encrypted communications or some other form of security would need to be implemented.

FSA 1130W is substantially similar to FSA 1130V in that it does not include a first region configured to receive a nose region of NGF 100W therein. FSA 1130W does, however, include a second region 1130B that is configured to mate with LFS 12. FSA 1130W includes a housing 1132 that has a front wall 1132*a*' but no port is defined in front wall 1132. Second region 1130B of FSA 1130W is substantially identical to second region 1030B of FSA 1030. Second region 1130B of FSA 1130W comprises a connector region complementary in shape and size to the chamber 18*b* defined by LFS 12. The second region 1030B is configured to be physically received within chamber 18*b*. The connector region as illustrated in FIG. 16B includes a tapered sidewall 1132*e* and an end wall 1132*f*. Sidewall 1132*e* includes an interior surface 1132*e*' that bounds and defines an interior compartment 1132*g*. Second region 1130B of FSA 1130W is provided with a single fuze setter adapter induction coil 1136 located within interior compartment 1132*g*, adjacent the interior surface 1132*e*' of sidewall 1132*e*. Fuze setter adapter induction coil 1136 is of a type that is compatible with induction coil 20 of LFS 12. Induction coil 1136 is capable of electrical power transfer and data/communications transfer with induction coil 20. An optical transceiver 1058 is provided adjacent front wall 1132*a*' of FSA 1130W. Optical transceiver 1058 is provided to communicate with optical transceiver 1056 on NGF 100W. While FIG. 16B shows optical transceiver 1058 located on the outside surface of wall 1132*a*', in other instances, the optical transceiver is located adjacent an interior of wall 1132*a*', with the optical energy passing through a transparent window provided in wall 1132*a*', similar to the optical interface described in FIGS. 15A and 15B. It will be understood that if an RF transceiver is provided on NGF 100W, then an RF transceiver will be provided on FSA 1130W to communicate with the RF transceiver on NGF 100W. An RF transceiver on FSA 1130W (or at least the antenna portion thereof) may be located on the exterior surface of wall 1132*a*' or it may be located within the housing and behind wall 1132*a*', with at least a portion of wall 1132*a*' being transparent to RF energy.

A processor control 1160W is provided in FSA 1130W. Processor control 1160W is operatively engaged with optical transceiver 1058 by wiring 1162. Processor control 1160W is operatively engaged with fuze setter adapter induction coil 1136 by wiring 1164. The processor control 1160W includes control electronics that enable NGF 100W and the LFS 12 to be placed in communication with each other and that further allows the LFS 12 to perform a fuze setting operation on NGF 100W. The manner in which processor control 1160V connects the electronics of LFS 12 and NGF 100W will be discussed later herein.

The arrows "D" shows that FSA 1130W may be physically introduced into chamber 18*b* of legacy fuze 18 for fuze setting and may be removed therefrom once fuze setting is completed. Although not illustrated herein, it will be understood that locking mechanisms may be provided to secure FSA 1130W to NGF 100W and LFS 12.

FIGS. 17A through 17I are provided to illustrate that LF 10 (FIG. 1) may be selectively engaged with differently configured next generation fuze setters by using different complementary fuze setter adapters in accordance with the present disclosure. The configuration of the next generation fuze setter dictates the configuration of the complementary fuze setter adapter that is used to enable electrical power transfer and data communications between the next generation fuze setter and the legacy fuze 10.

Figure 17A:
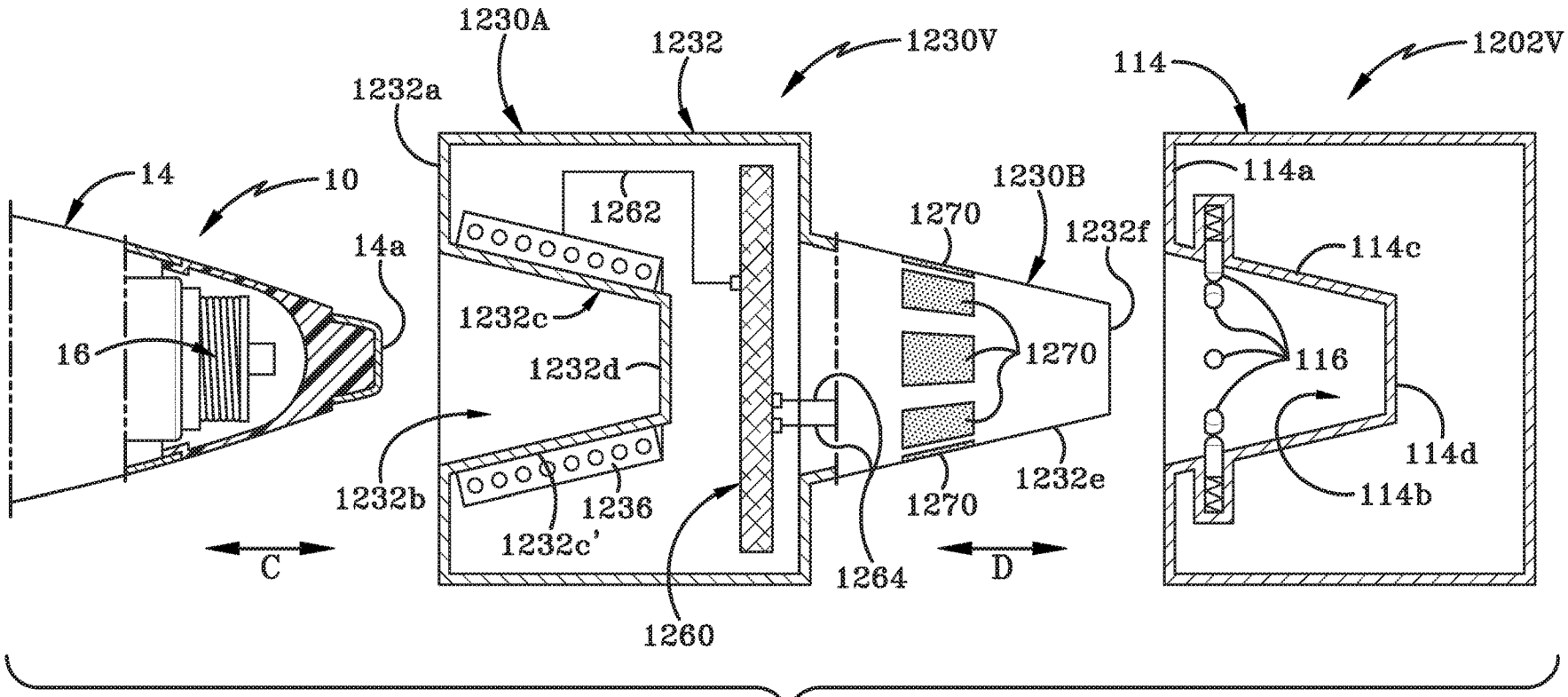
FIG. 17A is a diagrammatic longitudinal section of a nose region of the legacy fuze of FIG. 1, an incompatible fuze setter, and a thirteenth embodiment of a fuze setter adapter in accordance with the present disclosure, shown disengaged from each other.

FIG. 17A shows a next generation fuze setter that is substantially identical to NGFS 102 illustrated in FIG. 2. In accordance with an aspect of the present disclosure, a thirteenth embodiment FSA 1230V is provided that is capable of operatively engaging LF 10 and NGFS 102V.

FSA 1230V has a first region 1230A configured to engage with LF 10 and a second region 1230B configured to engage with NGFS 102V. FSA 1230V includes a housing 1232. The first region 1230A of FSA 1230V includes a wall 1232*a* that defines an opening to a port 1232*b* defined by housing 1232. In particular, port 1232*b* is bounded and defined by an inwardly extending and tapered sidewall 1232*c* and an end wall 1232*d*. Port 1232*b* is shaped and sized to be complementary to the nose region of LF 10 and to physically receive the nose region therein.

FSA 1230V differs from the fuze setter adapters disclosed above in that first region 1230A is provided with a single fuze setter adapter induction coil 1236 located adjacent the surface 1232*c*' of sidewall 1232*c*. Fuze setter adapter induction coil 1236 is of a type that is compatible with induction coil 16 of LF 10. Induction coil 1236 is capable of electrical power transfer and data/communications transfer with induction coil 16.

Second region 1230B of FSA 1230V comprises a connector region that is complementary in shape and size to the port 114*b* defined by NGFS 102V. The second region 1230B is configured to be physically received within port 114*b*. The connector region as illustrated in FIG. 17A includes a tapered sidewall 1232*e* and an end wall 1232*f*. A plurality of contact pads 1270 are provided on the exterior surface of sidewall 1232*e*. Contact pads 1270 are arranged in an aligned circumferential ring and are circumferentially spaced a distance away from each other. Contact pads 1270 are substantially identically the same as contact pads 112 of NGF 100 (FIG. 2). Contact pads 1270 are configured in such a way that when the connector region of second region 1230B is inserted into port 114*b* of NGFS 102V, contact pads 1270 and electrical contacts 116 will be able to communicate with each other.

It will be understood that while FIG. 17A illustrated contact pads 1270 that are substantially identical to contact pads 112 and electrical contacts 116 for communication therewith, any configuration of direct connect communications interface type contact pads illustrated on the next generation fuzes illustrated in FIGS. 5 through 11 may be provided on second region 1230B of FSA 1230V. The configuration of contact pad selected will be one complementary to the specific configuration of the next generation fuze setter. While only one configuration of direct connect next generation fuze setter has been illustrated herein, it will be understood that next generation fuze setters that include electrical contact configurations substantially identical to those shown in the first region of the various fuze setter adapters illustrated in FIGS. 5 through 11 may be utilized. Additionally any other configuration of electrical contact may be provided on a direct connect communications interface type next generation fuze setter and the appropriate complementary contact pad configuration will then be provided on a fuze setter adapter for use therewith.

Referring still to FIG. 17A, FSA 1230V is provided with a processor control 1260 that is operatively engaged with fuze setter adapter induction coil 1236 by wiring 1264. The contact pads 1270 are operatively engaged with processor control 1260 through wiring 1272. The processor control 1260 includes control and electrical power electronics that enable the LF 10 and NGFS 102V to be placed in communication with each other. Processor control 1260 further allows NGFS 102V to perform a fuze setting operation on LF 10. The manner in which processor control 1260 connects the electronics of NGFS 102V and LF 10 will be discussed later herein.

The arrows "C" shows that LF 10 may be physically introduced into port 1232*b* for fuze setting and may be removed therefrom once fuze setting is completed. The arrows "D" shows that FSA 1230V may be physically introduced into port 114*b* of NGFS 102V for fuze setting and may be removed therefrom once fuze setting is completed. Although not illustrated in any of FIGS. 17A through 17I, it will be understood that locking mechanisms may be provided to secure the various fuze setter adapters to the associate fuze and fuze setter.

FIG. 17B through 17E show diagrammatic longitudinal sections of the LF 10 of FIG. 1 with differently configured next generation fuze setters that utilize direct connect interfaces The wiring between the interfaces and the processor control (unnumbered) has been omitted in all of these figures as have other numbers that refer to parts of the fuze setter adapter housing and the fuze setter housing that are the same as those shown in FIG. 17A. All of the fuze setters illustrated in FIGS. 17B through 17E have direct connect interfaces that are incompatible with the induction coil 16 of LF 10. The fuze setter adapters illustrated in FIGS. 17B through 17E are differently configured so as to be able to engage the differently configured fuze setters with LF 10 and thereby enable electrical power and data signals to be transferred between the fuze setter and LF 10.

Figure 17B:
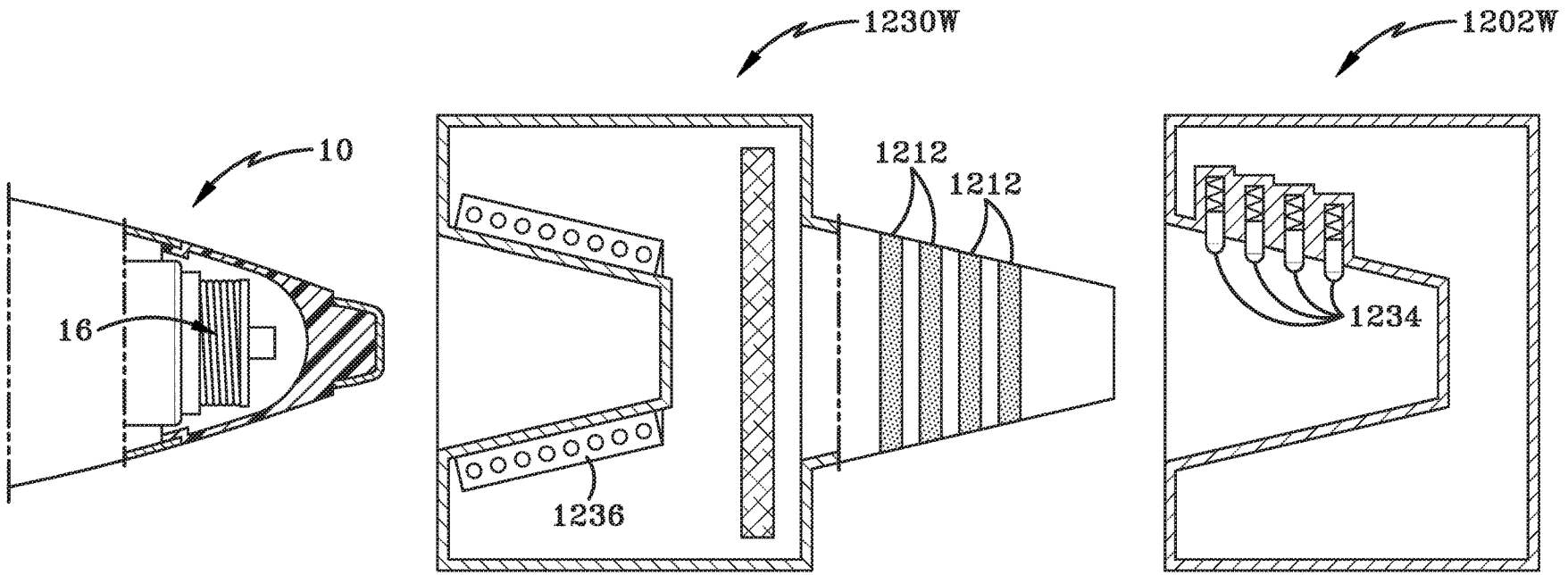
FIG. 17B is a diagrammatic longitudinal section of a nose region of the legacy fuze of FIG. 1, an incompatible fuze setter, and a fourteenth embodiment of a fuze setter adapter in accordance with the present disclosure, shown disengaged from each other.

FIG. 17B shows a fuze setter 1202W that has a plurality of electrical contacts 1234 on the sidewall of the chamber of fuze setter 1202W. The electrical contacts 1234 are in the form of electric contact pins which extend into the chamber. A fourteenth embodiment FSA 1230W in accordance with the present disclosure is received into the chamber. FSA 1230W includes a connector region for engaging fuze setter 1202W. A plurality of continuous contact rings 1212 on the sidewall of the connector region are utilized to establish communication with electrical contacts 1234 on fuze setter 1202W when FSA 1230W is engaged therewith.

Figure 17C:
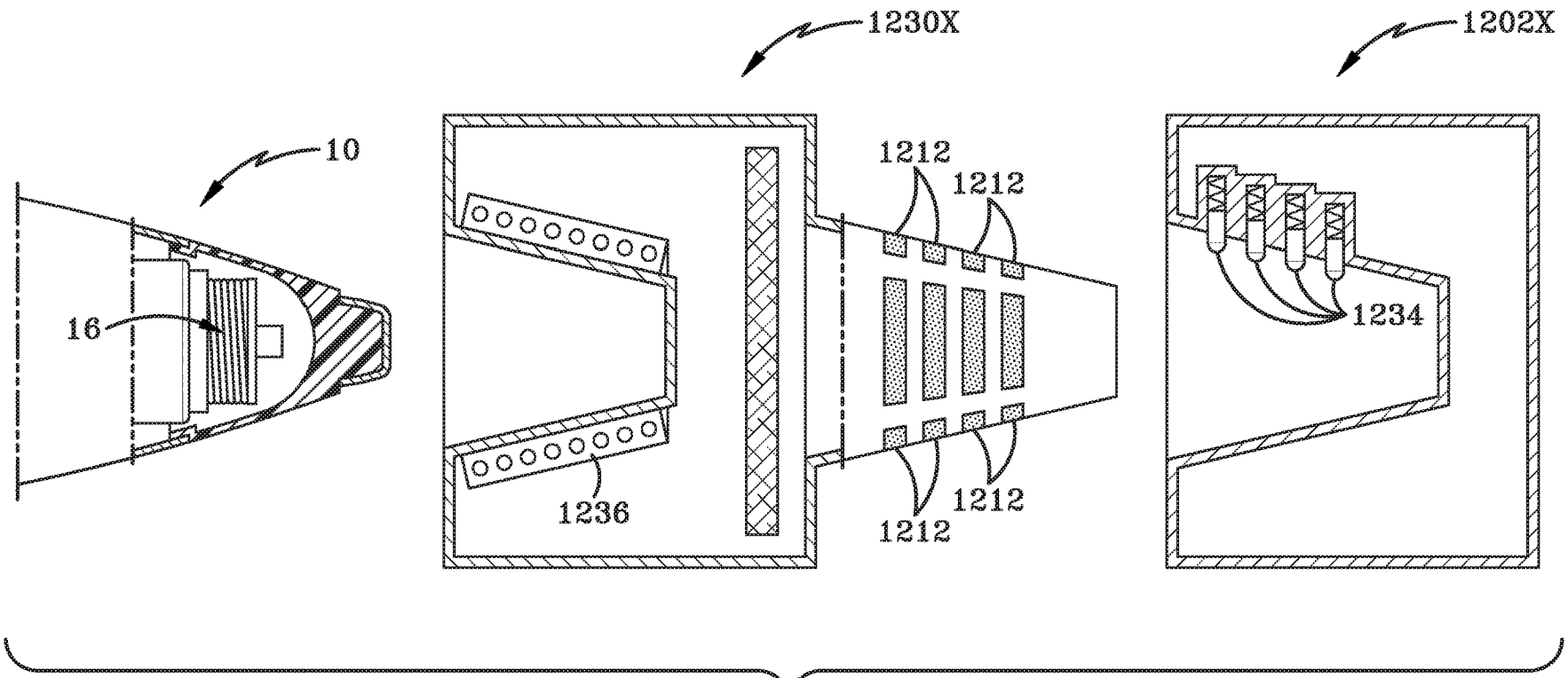
FIG. 17C is a diagrammatic longitudinal section of a nose region of the legacy fuze of FIG. 1, an incompatible fuze setter, and a fifteenth embodiment of a fuze setter adapter in accordance with the present disclosure, shown disengaged from each other.

FIG. 17C shows fuze setter 1202X having a plurality of electrical contacts 1234 on the sidewall of the chamber defined in fuze setter 1202X. The electrical contacts 1234 are in the form of electric contact pins that extend into the chamber. A fifteenth embodiment FSA 1230X in accordance with the present disclosure is received into the chamber. FSA 1230X includes a connector region for engaging fuze setter 1202X. A plurality of segmented contact bands 1212 on the sidewall of the connector region are utilized to establish communication with electrical contacts 1234 when FSA 1230X is engaged with fuze setter 1202X.

Figure 17D:
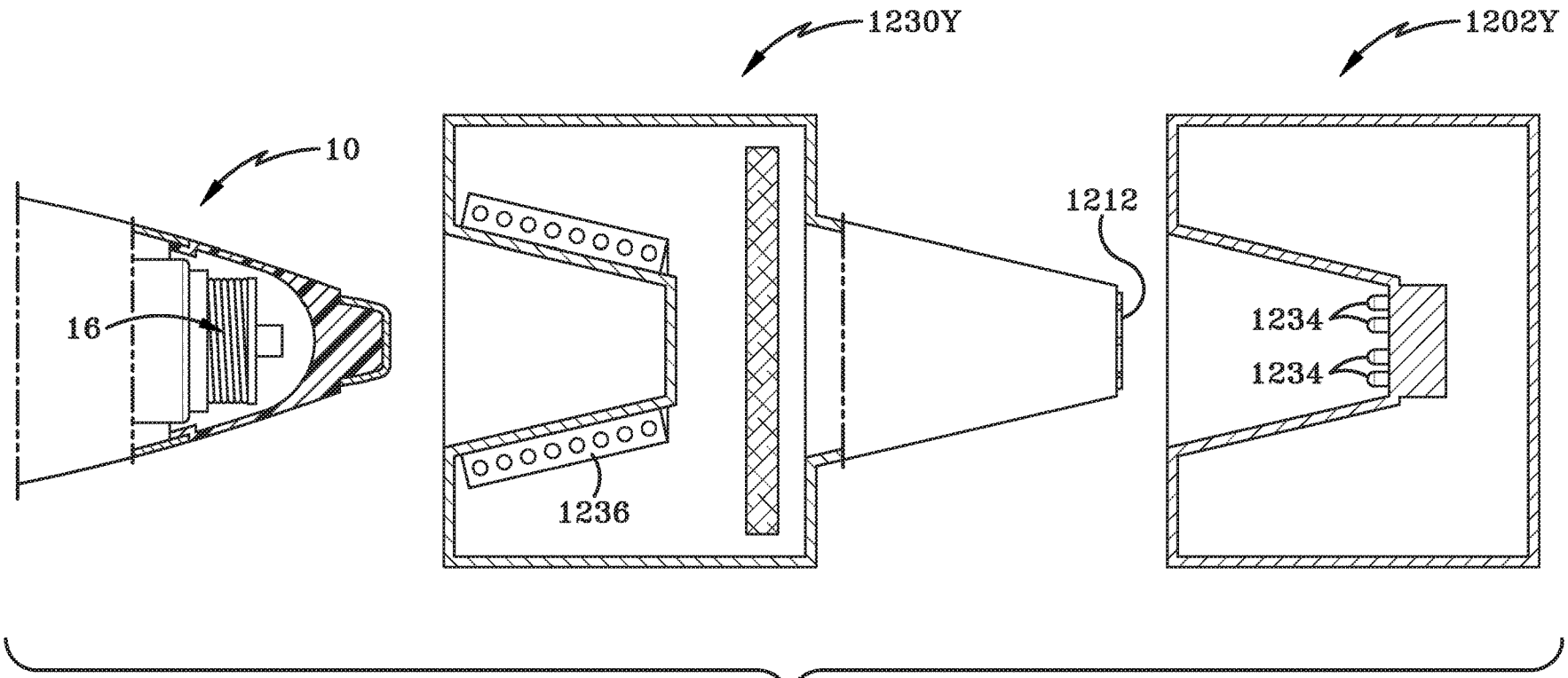
FIG. 17D is a diagrammatic longitudinal section of a nose region of the legacy fuze of FIG. 1, an incompatible fuze setter, and a sixteenth embodiment of a fuze setter adapter in accordance with the present disclosure, shown disengaged from each other.

FIG. 17D shows fuze setter 1202Y with a plurality of electrical contacts 1234 provided on the end wall that defines the chamber defined in fuze setter 1202Y. The electrical contacts 1234 are in the form of electric contact pins that extend into the chamber. A sixteenth embodiment FSA 1230Y in accordance with the present disclosure is received into the chamber. FSA 1230Y includes a connector region for engaging fuze setter 1202Y. Contact pads 1212 provided on the front end of the connector region are utilized to establish communication with electrical contacts 1234 when FSA 1230Y is engaged with fuze setter 1202Y.

Figure 17E:
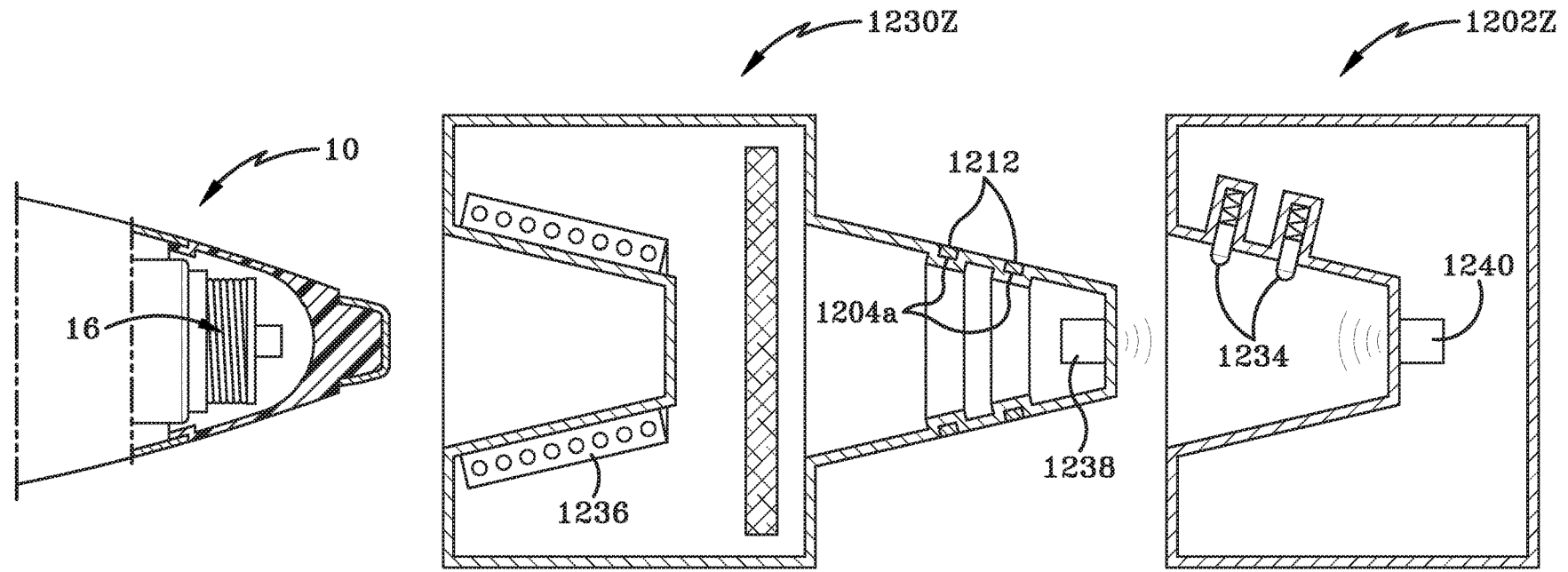
FIG. 17E is a diagrammatic longitudinal section of a nose region of the legacy fuze of FIG. 1, an incompatible fuze setter, and a seventeenth embodiment of a fuze setter adapter in accordance with the present disclosure, shown disengaged from each other.

FIG. 17E shows fuze setter 1202Z having a plurality of electrical contacts 1234 on the sidewall of the chamber defined in fuze setter 1202Z. The electrical contacts 1234 are in the form of electric contact pins that extend into the chamber. An RF transceiver 1240 is located adjacent an interior end wall of the chamber. A seventeenth embodiment FSA 1230Z in accordance with the present disclosure is received into the chamber. FSA 1230Z includes a connector region for engaging fuze setter 1202Z. A plurality of contact rings 1212 are located within grooves 1204*a* defined in the sidewall of the connector region. The contact rings 1212 are provided to establish communication with electrical contacts 1234 when FSA 1230Z is engaged with fuze setter 1202Z. An RF transceiver 1238 is located adjacent an interior surface of the front end of the connector region on FSA 1230Z. When the connector region of FSA 1230Z is received within the chamber of fuze setter 1202Z, the RF transceivers 1238, 1240 will establish communication with each other.

Figure 17F:
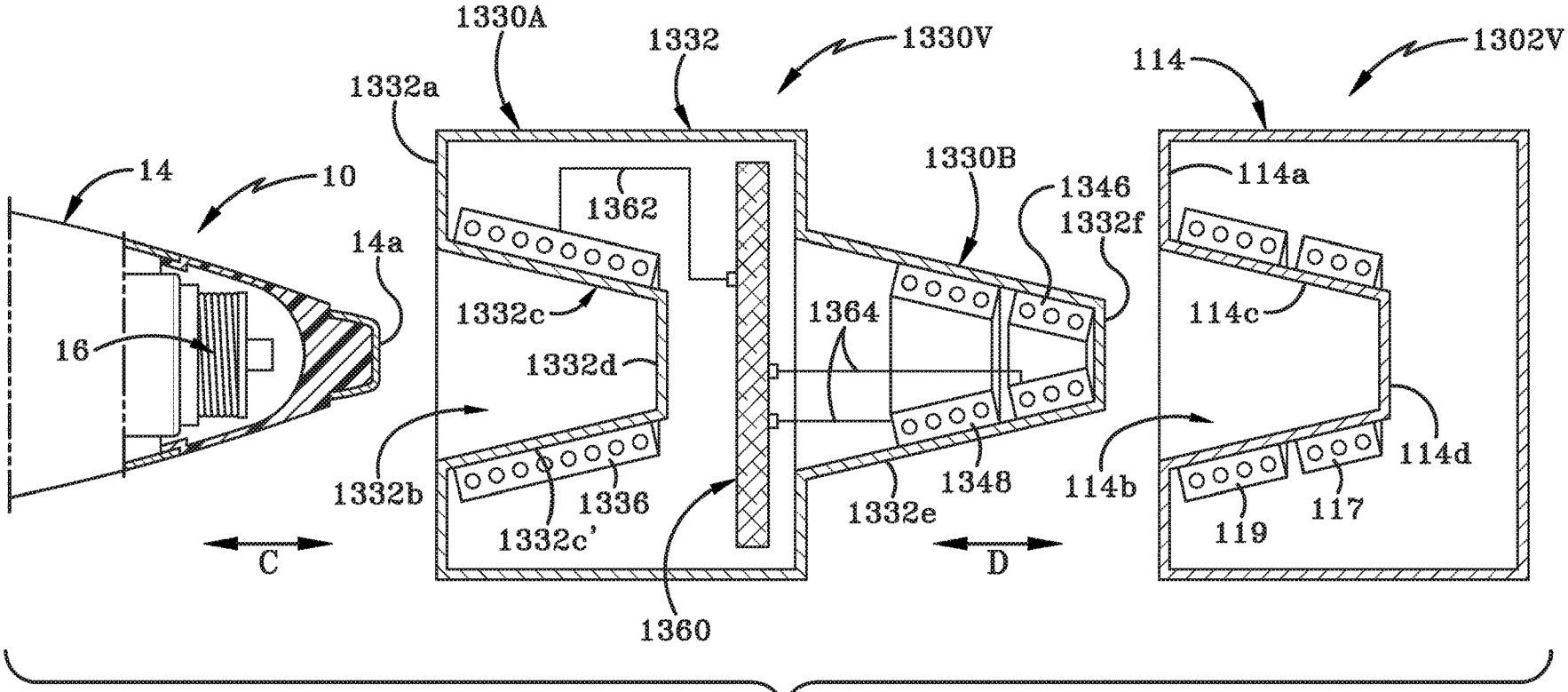
FIG. 17F is a diagrammatic longitudinal section of a nose region of the legacy fuze of FIG. 1, an incompatible fuze setter, and an eighteenth embodiment of a fuze setter adapter in accordance with the present disclosure, shown disengaged from each other.
Figure 17G:
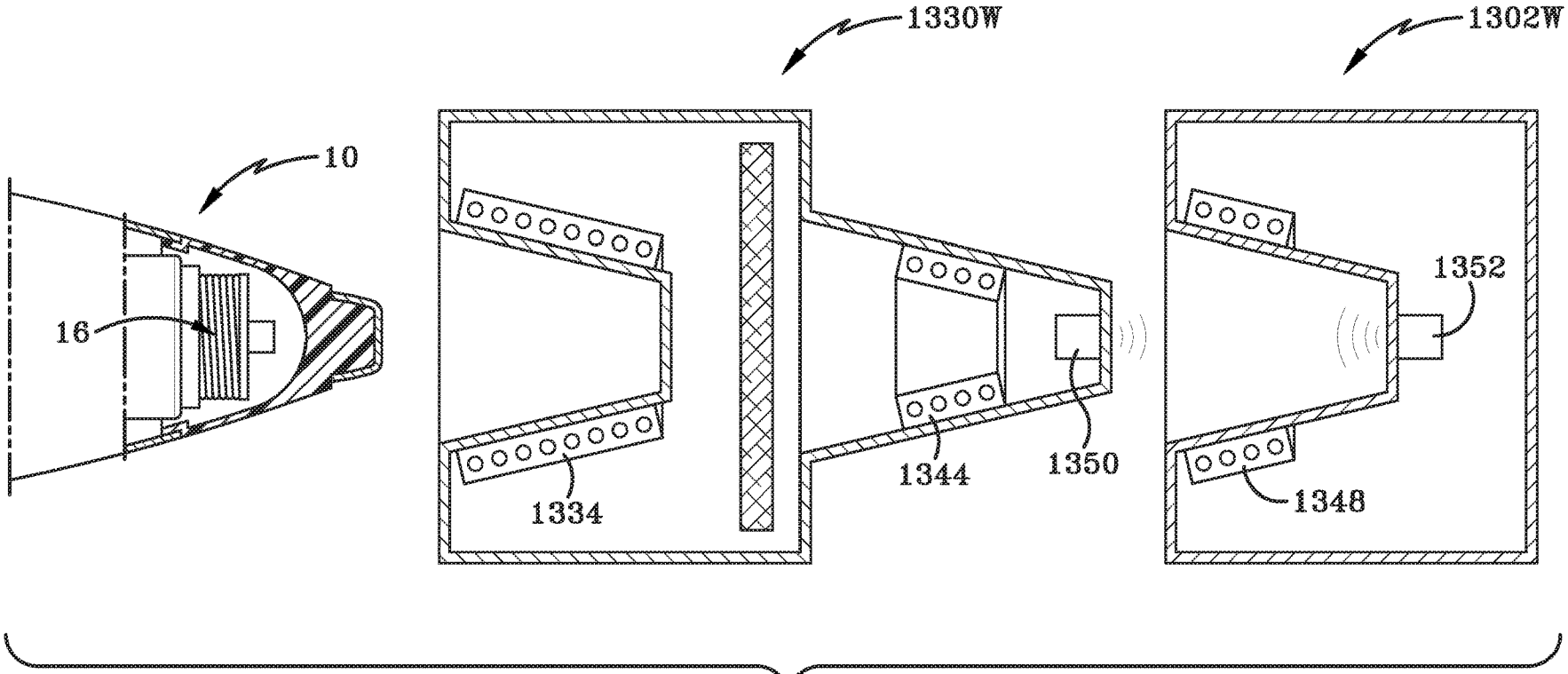
FIG. 17G is a diagrammatic longitudinal section of a nose region of the legacy fuze of FIG. 1, an incompatible fuze setter, and a nineteenth embodiment of a fuze setter adapter in accordance with the present disclosure, shown disengaged from each other.
Figure 17H:
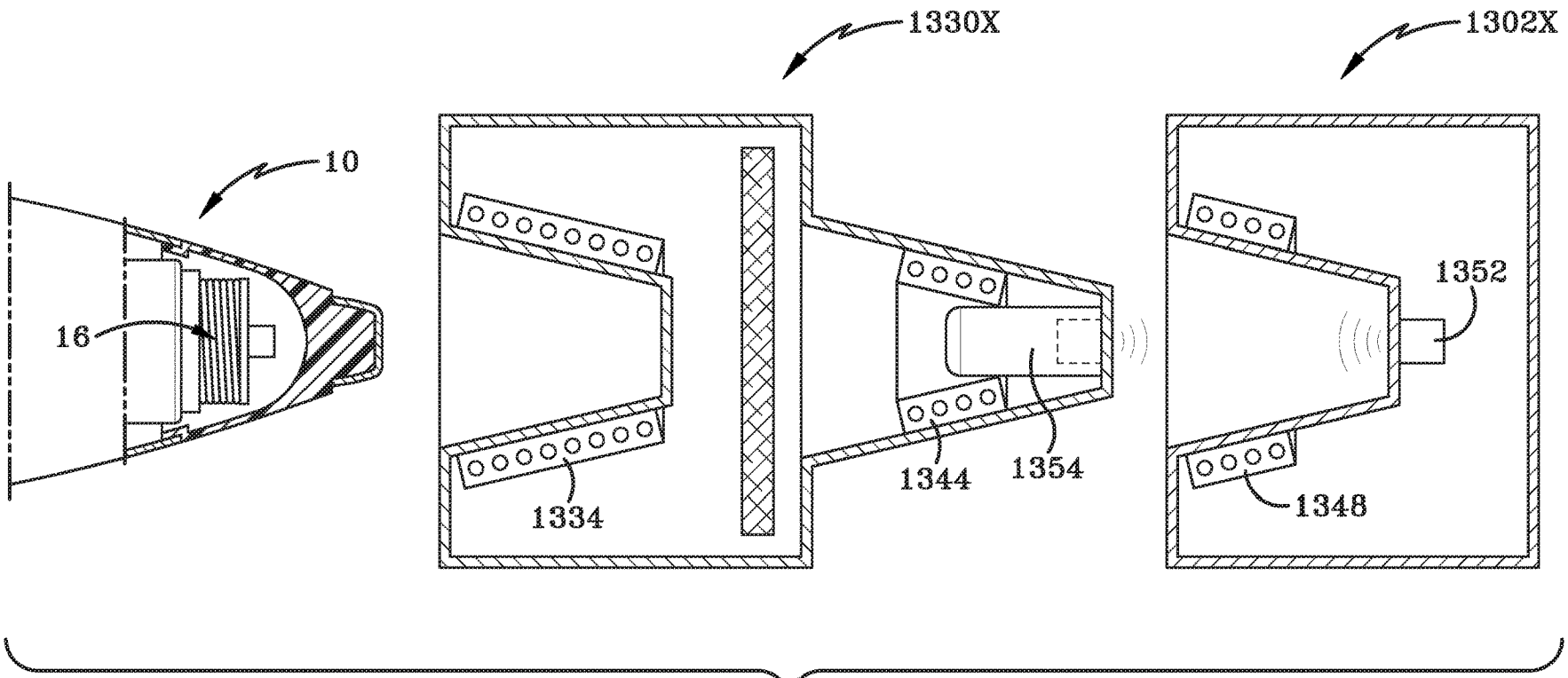
FIG. 17H is a diagrammatic longitudinal section of a nose region of the legacy fuze of FIG. 1, an incompatible fuze setter, and a twentieth embodiment of a fuze setter adapter in accordance with the present disclosure, shown disengaged from each other.
Figure 17I:
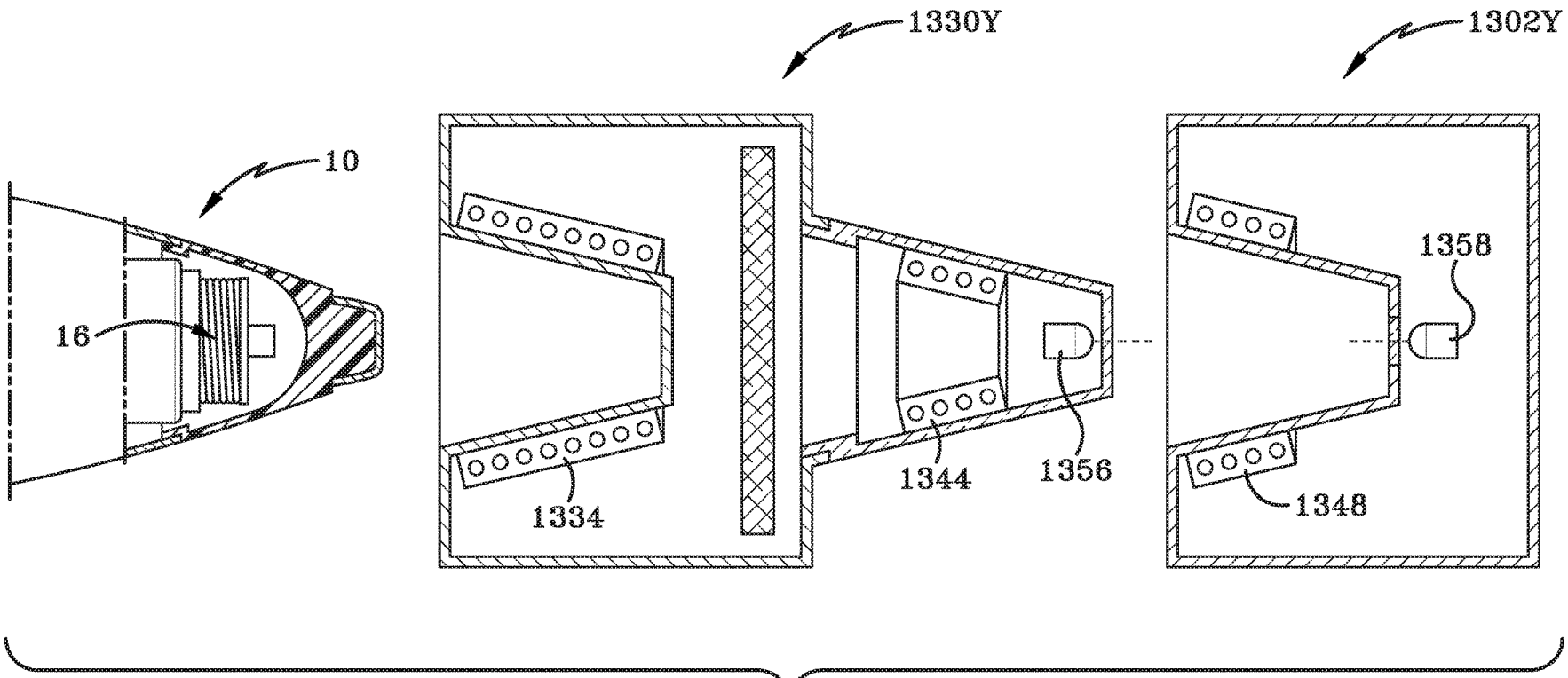
FIG. 17I is a diagrammatic longitudinal section of a nose region of the legacy fuze of FIG. 1, an incompatible fuze setter, and a twenty-first embodiment of a fuze setter adapter in accordance with the present disclosure, shown disengaged from each other.

FIGS. 17F through 17I show diagrammatic longitudinal sections of the LF 10 of FIG. 1 with differently configured next generation fuze setters that utilize different wireless interfaces. In FIGS. 17G through 17I the wiring that connects the interfaces to the processor control (unnumbered) has been omitted, as have some of the numbers that refer to parts of the fuze setter adapter housing and the fuze setter housing that are the same as those shown in FIG. 17F. All of the fuze setters illustrated in FIGS. 17F through 17I have wireless interfaces that are incompatible with the induction coil 16 of LF 10. The fuze setter adapters illustrated in FIGS. 17F through 17I are differently configured so as to be able to engage the differently configured fuze setters with LF 10 and thereby enable electrical power and data signals to be transferred between the fuze setter and LF 10.

Referring to FIG. 17F, and in accordance with an aspect of the present disclosure, a wireless eighteenth embodiment FSA 1330V is provided that is capable of operatively engaging LF 10 and fuze setter 1302V.

FSA 1330V has a first region 1330A configured to engage with LF 10 and a second region 1330B configured to engage with fuze setter 1302V. FSA 1330V includes a housing 1332. A first region 1330A of FSA 1330V includes a wall 1332*a* that defines an opening to a port 1332*b* defined in housing 1332. Port 1332*b* is bounded and defined by an inwardly extending and tapered sidewall 1332*c* and an end wall 1332*d*. Port 1332*b* is shaped and sized to be complementary to the nose region of LF 10 and to physically receive the nose region therein.

First region 1330A of FSA 1330V is substantially identical to first region 1230A of FSA 1230V and is provided with a single fuze setter adapter induction coil 1336 located adjacent the surface 1332*c*' of sidewall 1332*c*. Fuze setter adapter induction coil 1336 is of a type that is compatible with induction coil 16 of LF 10. Induction coil 1336 is capable of electrical power transfer and data/communications transfer with induction coil 16.

Second region 1330B of FSA 1330V comprises a connector region that is complementary in shape and size to the port 114*b* defined by fuze setter 1302V and is configured to be physically received within port 114*b*. The connector region as illustrated in FIG. 17F includes a tapered sidewall 1332*e* and an end wall 1332*f*. Instead of the plurality of contact pads 1270 being provided on the exterior surface of sidewall 1332*e*, FSA 1330V includes a first induction coil 1346 and a second induction coil 1348. First and second induction coils 1346, 1348 are substantially identical in structure to first and second induction coils 746, 748 (FIG. 12A). First and second induction coils 1346, 1348 are configured in such a way that when the connector region of second region 1330B is inserted into port 114*b* of fuze setter 1302V, first and second induction coils 117, 119 and first and second induction coils 1346, 1348 will be able to communicate with each other.

Referring still to FIG. 17F, FSA 1330V is provided with a processor control 1360 that is operatively engaged with fuze setter adapter induction coil 1336 by wiring 1362. The first and second induction coils 1346, 1348 are operatively engaged with processor control 1360 by wiring 1364. The processor control 1360 includes control and electrical power electronics that enable the LF 10 and fuze setter 1302V to be placed in communication with each other. Processor control 1360 further allows fuze setter 1302V to perform a fuze setting operation on LF 10. The manner in which processor control 1360 connects the electronics of fuze setter 1302V and LF 10 will be discussed later herein.

The arrows "C" show that LF 10 may be physically introduced into port 1332*b* on FSA 1330V for fuze setting and may be removed therefrom once fuze setting is completed. The arrows "D" show that FSA 1330V may be physically introduced into port 114*b* of fuze setter 1302V for fuze setting and may be removed therefrom once fuze setting is completed.

FIG. 17G shows a fuze setter 1302W that is incompatible with LF 10 in that fuze setter 1302W includes a next generation induction coil 1348 located adjacent an inner surface of the sidewall defining the chamber. Additionally, an RF transceiver 1352 is located adjacent an interior surface of the end wall that defines the chamber. Coil 1348 and RF transceiver 1352 cannot communicate with induction coil 16. A complementary nineteenth embodiment FSA 1330W is provided that is capable of operatively engaging LF 10 and fuze setter 1302W so that they are capable of electrical power transfer and data communication with each other. FSA 1330W has a connector region with an induction coil 1344 and an RF transceiver 1350. The nose region of LF 10 is introduced into the port of FSA 1330W so that coils 16, 1334 are able to communicate. The connector region of FSA 1330W is introduced into the chamber of fuze setter 1302W and induction coils 1344 and 1348 are able to communicate as are RF transceivers 1344 and 1348.

FIG. 17H shows a fuze setter 1302X that is incompatible with LF 10 in that fuze setter 1302X includes a next generation induction coil 1348 that is located adjacent an inner surface of the sidewall and coil 1348 cannot communicate with induction coil 16. Additionally, an RF transceiver 1352 is located adjacent an interior surface of end wall that defines the chamber. Coil 1348 and RF transceiver 1352 cannot communicate with induction coil 16. A complementary twentieth embodiment FSA 1330X is provided that is capable of operatively engaging LF 10 and fuze setter 1302X in such a way that they are capable of electrical power transfer and data signal transfer with each other. FSA 1330X has a connector region with an induction coil 1344 and a HoB sensor 1354. The nose region of LF 10 is introduced into the port of FSA 1330X so that coils 16, 1334 are able to communicate. The connector region of FSA 1330X is introduced into the chamber of fuze setter 1302X and induction coils 1344 and 1348 are able to communicate as are HoB sensor 1354 and RF transceiver 1348.

FIG. 17I shows a fuze setter 1302Y that is incompatible with LF 10 in that fuze setter 1302Y includes a next generation induction coil 1348 located adjacent an inner surface of the sidewall. An optical transceiver 1358 is located adjacent an interior surface of end wall that defines the chamber. Coil 1348 and optical transceiver 1358 are unable to communicate with induction coil 16 of LF 10. A complementary twenty-first embodiment FSA 1330Y is provided that is capable of operatively engaging LF 10 and fuze setter 1302Y so that they are capable of electrical power transfer and data signal transfer with each other. FSA 1330Y has a connector region with an induction coil 1344 and an optical transceiver 1356. The nose region of LF 10 is introduced into the port of FSA 1330Y so that coils 16, 1334 are able to communicate. The connector region of FSA 1330Y is introduced into the chamber of fuze setter 1302Y and induction coils 1344 and 1348 are able to communicate as are optical transceivers 1358, 1356.

Figure 18A:
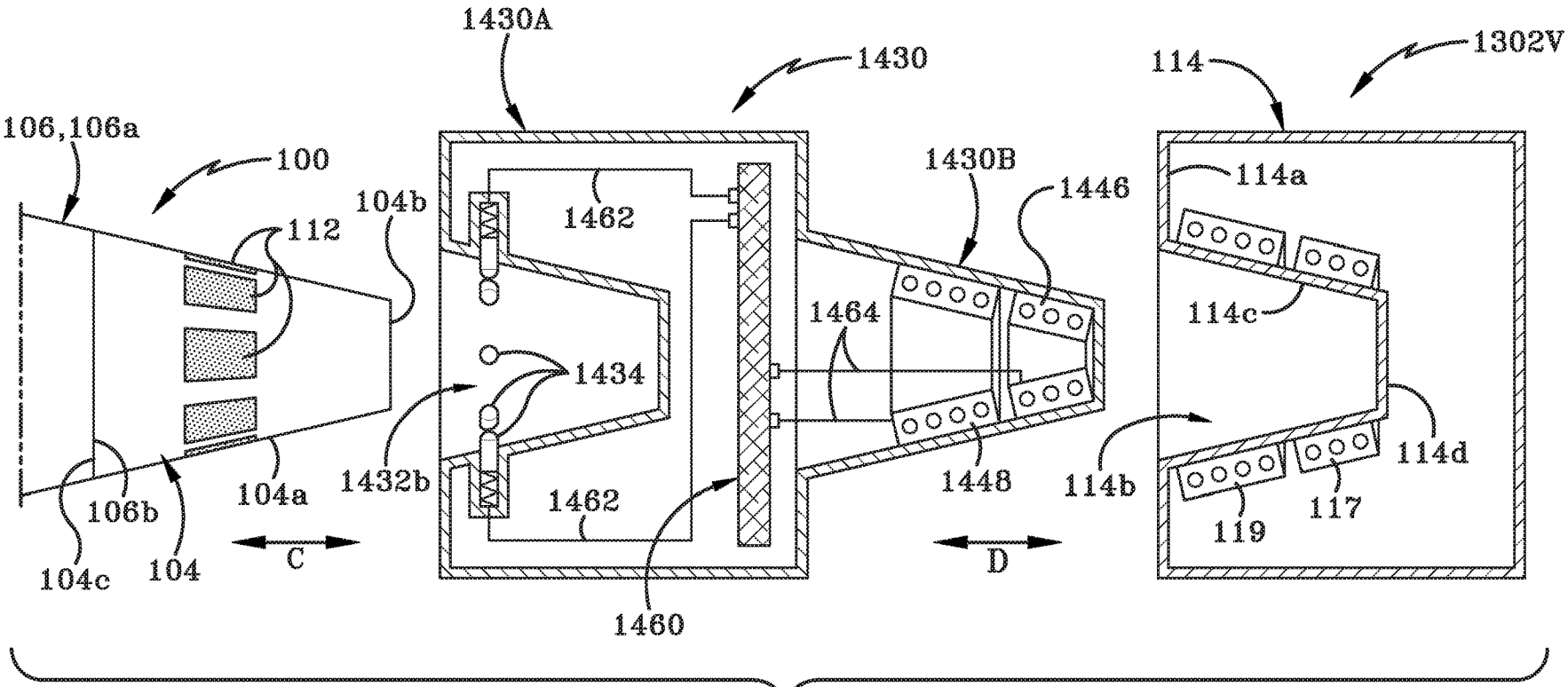
FIG. 18A is a diagrammatic, partial side elevation, longitudinal section of the next generation fuze of FIG. 2, an incompatible second embodiment next generation fuze setter (FIG. 17F), and a twenty-second embodiment of a fuze setter adapter in accordance with the present disclosure, shown disengaged from each other.
Figure 18B:
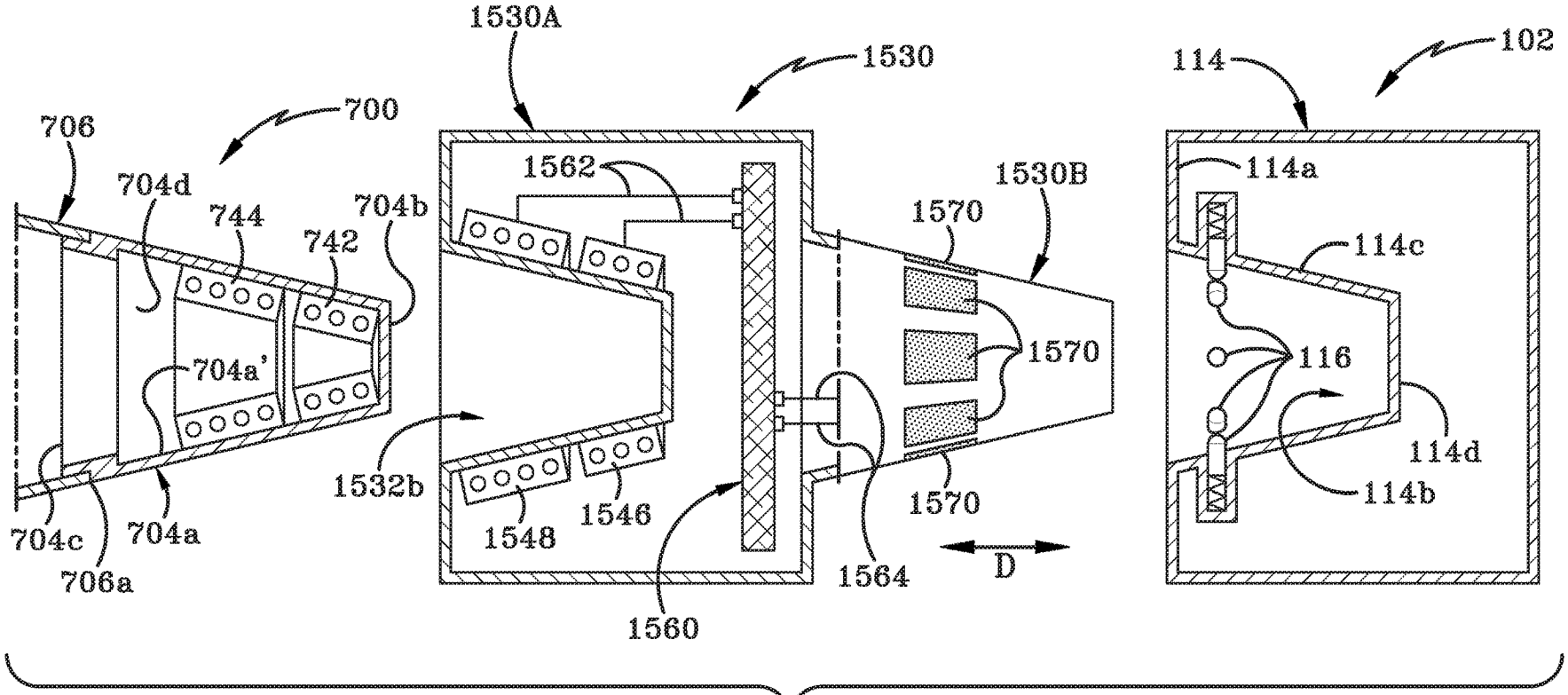
FIG. 18B is a diagrammatic longitudinal section of the next generation fuze of FIG. 12A, an incompatible first embodiment next generation fuze setter of FIG. 2, and a twenty-third embodiment of a fuze setter adapter in accordance with the present disclosure, shown disengaged from each other.

A fuze setter adapter in accordance with an aspect of the present disclosure is able to incorporate any combination of the interfaces described herein on either side of the fuze setter adapter, i.e., on the side that engages the fuze and on the side that engages the fuze setter. FIGS. 18A and 18B are provided to show examples of fuze setter adapters in accordance with the present disclosure being used to enable one type of next generation fuze to be engaged with an incompatible second type of next generation fuze in such a way that fuze setting is able to be performed.

FIG. 18A shows a NGF 100 (FIG. 2) that includes contact pads 112 on its radome housing 104 being engaged with a NGFS 102A (FIG. 19) that has a first induction coil 117 and a second induction coil 119. In accordance with an aspect of the present disclosure, a twenty-second embodiment FSA 1430 is provided that enables communication between NGF 100 and NGFS 102A.

FSA 1430 includes a first region 1430A that is operatively engaged with NGF 100 and a second region 1430B that is operatively engaged with NGFS 102A. First region 1430A is substantially identical in structure and function to first region 130A (FIG. 4A) of FSA 130 and includes a plurality of electrical contacts 1434 that are capable of communication with contact pads 112 of NGF 100. Second region 1430A of FSA 1430 is substantially identical in structure and function to second region 1330B of FSA 1330 and includes a first and second induction coil 1446, 1448 that are capable of communication with first and second induction coils 117, 119 of NGFS 102A.

FSA 1430 includes a processor control 1460 that is operatively engaged with electrical contacts 1434 by wiring 1462 and is operatively engaged with first and second induction coils 1446, 1448 by wiring 1464. The processor control 1460 includes control and electrical power electronics that enable NGF 100 and NGFS 102A to be placed in communication with each other. Processor control 1460 further allows NGFS 102A to perform a fuze setting operation on NGF 100. The manner in which processor control 1460 connects the electronics of NGFS 102A and NGF 100 will be discussed later herein.

The arrows "C" show that NGF 100 may be physically introduced into port 1432*b* on FSA 1430 for fuze setting and may be removed therefrom once fuze setting is completed. The arrows "D" show that FSA 1430 may be physically introduced into port 114*b* of NGFS 102A for fuze setting and may be removed therefrom once fuze setting is completed. Although not illustrated herein, it will be understood that locking mechanisms may be provided to secure FSA 1430 to legacy fuze 10 and NGFS 102A.

FIG. 18B shows a second example of a one type of next generation fuze being engaged with an incompatible second type of next generation fuze setter via a twenty-third embodiment FSA 1530 in accordance with the present disclosure. In this example, a NGF 700 (FIG. 12A) is to be engaged with a NGFS 102 (FIG. 2) with FSA 1530. NGF 700 includes a first induction coil 742 and a second induction coil 744. NGFS 102 includes a plurality of electrical contacts 116 that are incapable of communicating with first induction coil 742 and second induction coil 744.

FSA 1530 includes a first region 1530A that is operatively engaged with NGF 700 and a second region 1530B that is operatively engaged with NGFS 102. First region 1530A is substantially identical in structure and function to first region 730A (FIG. 12A) of FSA 730 and includes a first induction coil 1546 and a second induction coil 1548. Second region 1530B is substantially identical in structure and function to second region 1230B of FSA 1230 (FIG. 17A) and includes a plurality of contact pads 1570.

FSA 1530 includes a processor control 1560 that is operatively engaged with first and second induction coils 1546, 1548 by wiring 1562 and is operatively engaged with contact pads 1570 by wiring 1564. The processor control 1560 includes control and electrical power electronics that enable NGF 700 and NGFS 102 to be placed in communication with each other. Processor control 1560 further allows NGFS 102 to perform a fuze setting operation on NGF 700. The manner in which processor control 1560 connects the electronics of NGFS 102 and NGF 700 will be discussed later herein.

The arrows "C" show that NGF 700 may be physically introduced into port 1532*b* on FSA 1530 for fuze setting and may be removed therefrom once fuze setting is completed. The arrows "D" show that FSA 1530 may be physically introduced into port 114*b* of NGFS 102 for fuze setting and may be removed therefrom once fuze setting is completed. Although not illustrated herein, it will be understood that locking mechanisms may be provided to secure FSA 1530 to legacy fuze 10, and NGFS 102.

Figure 19:
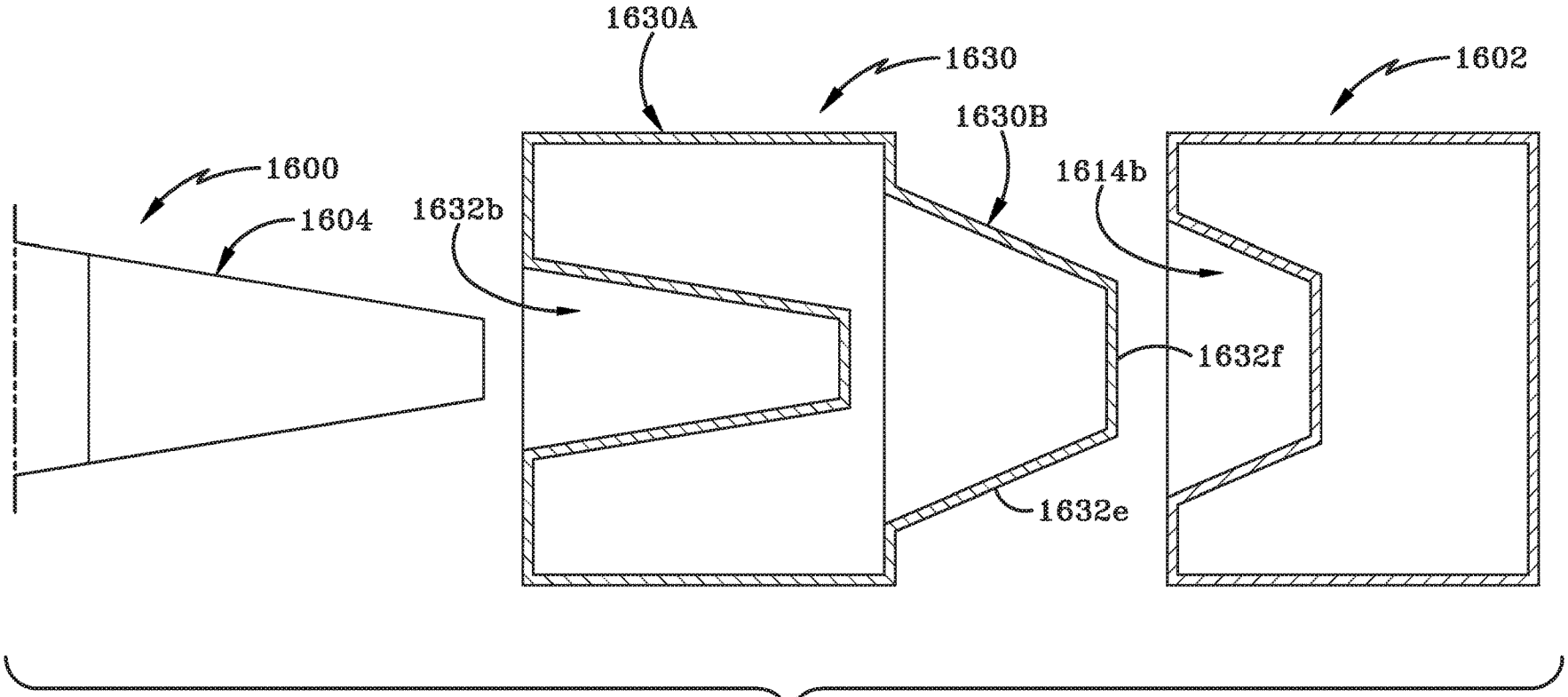
FIG. 19 is a diagrammatic longitudinal section of a first configuration of a next generation fuze, an incompatible second configuration of next generation fuze setter, and a twenty-fourth embodiment of a fuze setter adapter in accordance with the present disclosure.

FIG. 19 discloses a twenty fourth embodiment of a fuze setter adapter in accordance with the present disclosure that enables engagement between an incompatible fuze and fuze setter. In this example, the incompatibility stems from a radome housing on the fuze that is not of a compatible complementary shape and/or size to the port provided on the fuze setter. FIG. 19 shows an exemplary NGF 1600 having a relatively elongated radome housing 1604 with a shallow taper angle. The exemplary fuze setter 1602, on the other hand, defines a relatively short port 1614 having a steeper taper angle. When radome housing 1604 is introduced into port 1614 electrical power transfer and/or data communications may not be possible because contact pads, electrical contacts, induction coils, RF transceivers, HoB sensors, or optical transceivers on the two devices may not be able to establish communication with each other. A FSA 1630 is provided with a first region 1630A that defines a port 1632*b* therein that is complementary in shape and size to the radome housing 1604 on NGF 1600. FSA 1630 is also provided with a second region 1630B that is complementary in shape and size to the chamber 1614*b* defined in fuze setter 1602. The fuze and fuze setter in this example are presumed to have components for electrical power transfer and data communications that would typically be able to communicate with each other. However, in other examples, in addition to providing a port 1632*b* and a connector region 1632*e*, 1632*f*, that are complementary to the shapes of radome housing 1604 of NGF 1600 and chamber 1614 of fuze setter 1602, FSA 1630 may provide compatible components for electrical power transfer and data communications between NGF 1600 and fuze setter 1602.

It should be understood that each of the processor controls 160, 260, 360, 460, 560, 660, 760, 860, 960, 1060, 1160V, 1160W, 1260, 1360, 1460, and 1560 includes a processor with memory that is used for data buffering. In other words, the data is able to be received by the processor from one of the fuze setter and fuze at one rate and is able to be transmitted to the other of the fuze setter and fuze at a different rate. Similarly, with respect to data format, data may be received at the processor from the fuze setter in one format and then retransmitted to the fuze in a different format, and vice versa.

Figure 20:
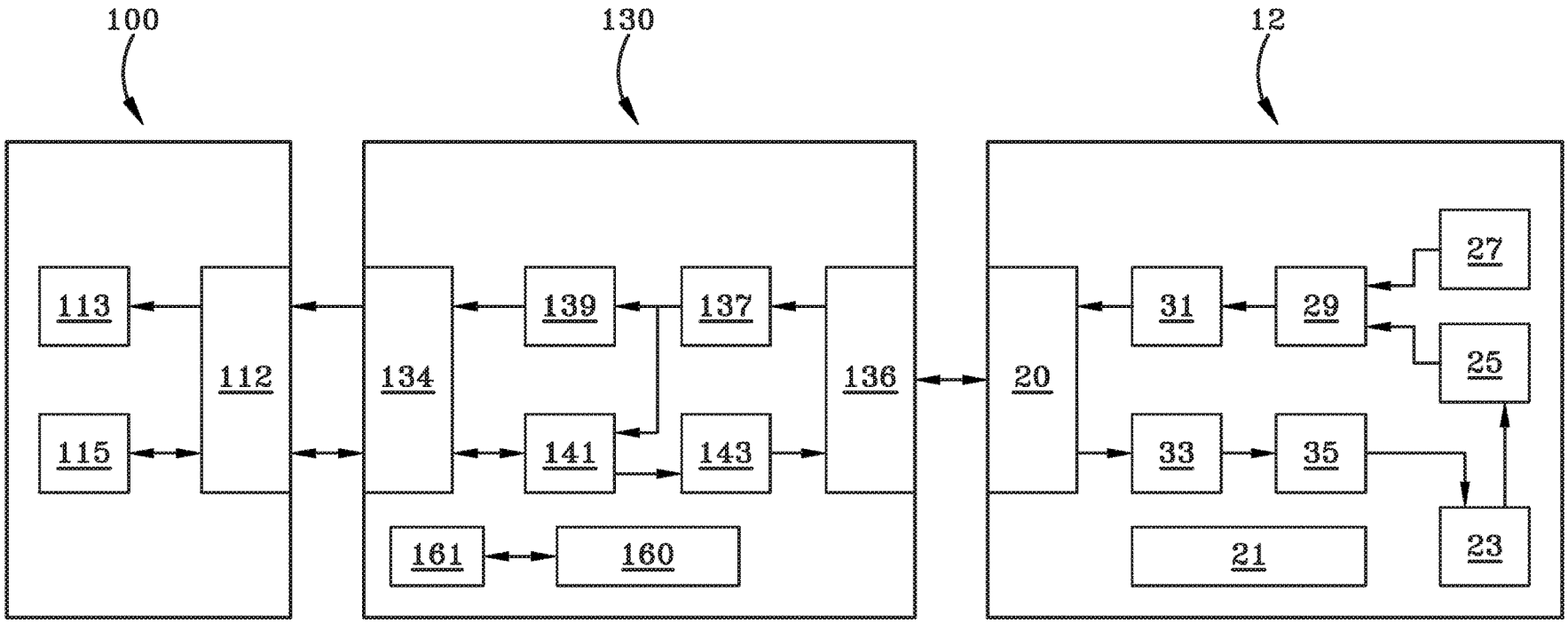
FIG. 20 is a flowchart depicting the operation of a direct connect next generation fuze, an incompatible legacy fuze and a twenty-fourth embodiment of a fuze setter adapter that operationally engages the fuze and legacy fuze to each other.

FIG. 20 is a flowchart depicting the operation of a direct connect next generation fuze, a legacy inductive fuze setter, and a fuze setter adapter that operationally engages the fuze and legacy fuze setter and enables them to communicate with each other. The flowchart is applicable to all of the embodiments of direct connect next generation fuzes and the complementary fuze setter adapters disclosed herein. However, in order to more clearly explain the operation of this system, the direct connect NGF 100, LFS 12, and FSA 130 are reference in the flowchart.

The operation of FSA 130 regarding electrical power and data transfer from LFS 12 to NGF 100 includes the following. LFS 12 includes a processor control 21 that controls all relevant aspects of timing, signal condition, timing, and data encoding and decoding across the inductive interface 20. Processor control 21 is also used to arbitrate whether and when power or data is transferred over inductive interface 20 and in what direction (i.e., whether the data is being transmitted to NGF 100 or received from NGF 100). LFS 12 encodes fuze data 23 onto appropriate waveforms 25 to transmit to NGF 100. LFS 12 also transfers electrical power onto appropriate waveforms 27 to transmit to NGF 100. The encoded fuze data waveform 25 and electrical power waveform 27 are combined into a power/data waveform 29. In a next step 31, the waveform 29 is used to drive fuze setter inductive coil 20. The waveform 29 is detected in FSA 130 via inductive coupling between the FSA inductive interface 136 and the LFS inductive interface 20 when the FSA 130 is mated to the LFS 12.

Processor control 160 in FSA 130 is used to control all relevant aspects of timing, signal conditioning, timing, and data encoding and decoding across the inductive interface 136 and direct contact interface 134 of FSA 130. It should be noted that processor control 160 includes a memory 161 that is used for data buffering. This allows data to be received from LFS 12 at one rate and to be transmitted to NGF 100 at another rate, and vice versa. Data buffering also allows data to be received from the LFS 12 in one format and transmitted to NGF 100 in a different format, and vice versa. FSA 130 decodes the power and transmitted data waveform 137. FSA 130 applies power 139 and data signals 141 to appropriate contact pins on the fuze direct connect interface 134, 112. NGF 100 receives the power 113 and data 115 transferred by FSA 130.

The operation of FSA 130 regarding data transfer from NGF 100 to the LFS 12 includes the following. The processor control 160 in FSA 130 is used to control all relevant aspects of timing, signal condition, timing, and data encoding and decoding across the inductive interface 136 and direct contact interface 134 of FSA 130. NGF 100 is powered by the power 113 received from the LFS 12 via FSA 130. NGF 100 transmits data to FSA 130 via the direct connect interface 112, 134. The processor 160 in FSA 130 reads the data (i.e. the received data from the fuze) and buffer memory 161 may be used to buffer (temporarily store) the incoming data, allowing the processor 160 to reformat the data into a format compatible with the FSA 130. The reformatted data is then re-encoded onto a waveform 143 in a format suitable for transmitting via the inductive interface 136, 20. Encoded data is received by the LFS 12 via the inductive interface element 136 of FSA 130. The fuze setter processor 21 reads the received data 33 and extracts the received data (Rx data) 35 from the received waveform 143.

Figure 21:
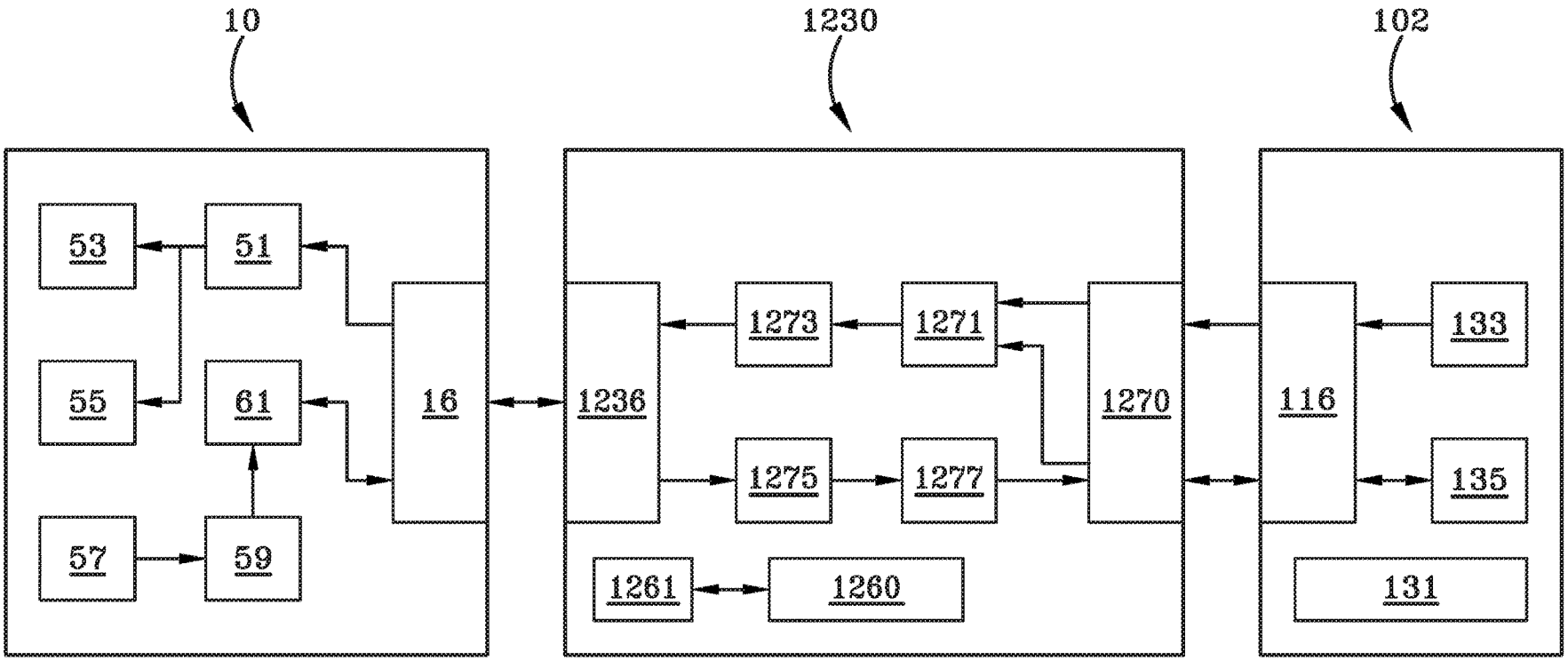
FIG. 21 is a flowchart depicting the operation of a wireless next generation fuze, an incompatible legacy fuze, and a fuze setter adapter that operationally engages the fuze and legacy fuze to each other.

FIG. 21 is a flowchart depicting the operation of a direct connect next generation fuze setter, a legacy fuze, and a fuze setter adapter that operationally engages the fuze setter and legacy fuze to each other. By way of example only, the selected next generation fuze setter is direct connect NGFS 102 (FIG. 2, also shown as 1202V in FIG. 17A), LF 10 and FSA 1230V. The flowchart is, however, applicable to any of the embodiments of the next generation fuzes and the complementary fuze setter adapters disclosed herein.

The operation of FSA 1230V with respect to electrical power and data transfer from NGFS 102 to LF 10 comprises the following. The processor control 131 in NGFS 102 is used to control all relevant aspects of timing signal conditioning, timing and data encoding and decoding across direct connect interface 116. It is also used to arbitrate whether and when power or data is transferred over the direct connect interface 116 and in what direction (i.e., transmit or receive). NGFS 102 transfers electrical power 133 and fuze data 135 to FSA 1230V via the direct connect interface 116 to the corresponding direct connect interface 1270 within FSA 1230V. The processor control 1260 in FSA 1230V is used to control all relevant aspects of timing, signal conditioning, timing and data encoding and decoding across the inductive and direct connect interfaces of FSA 1230V. Processor control 1260 includes memory 1261 that can be used for data buffering and so that data received at one rate from NGFS 102 can be transmitted to LF 10 at another rate, and vice versa. Data may also be received from the NGFS 102 in one format and then is retransmitted to the LF10 in a different format, and vice versa. FSA 1230V combines and encodes power and data to be transferred to the LF 10 into an appropriate waveform 1271. The waveform 1271 is used to drive 1273 the fuze inductive coil 1236 of the fuze setter adapter inductive interface. The waveform is detected and read 51 by the LF 10 via inductive coupling across the inductive interface 16. The LF 10 extracts electrical power 53 and extracts and decodes 55 the transmitted data waveform (i.e., $T_x$ data).

The operation of FSA 1230V with respect to data transfer from the LF 10 to NGFS 102 includes the following. The processor control 1260 in FSA 1230V is used to control all relevant aspects of timing, signal condition, timing and data encoding and decoding across the inductive interface 1236 and direct contact interface 1270 of FSA 1230V. The LF 10 is powered by the power 53 received from NGFS 102 via FSA 1230V. The LF 10 encodes data 57 to be transferred to the fuze setter ($R_x$ data) by encoding in appropriate waveform 59 and which drives 61 the inductive coil 16 and transmits the waveform 59 to FSA 1230V via the inductive interface 16, 1236. FSA 1230V reads the inductive coil 1275 and decodes the received data (Rx data) 1277 transferred by the LF 10. The received data (Rx data) 1277 is then transferred to NGFS 102 via the direct connect interface 1270, 116.

It will be understood that the methodologies of operation shown in FIGS. 20 and 21 are applicable to any of the fuzes, fuze setters, and fuze setter adapters disclosed herein. The type of interfaces through which the fuzes, fuze setters, and fuze setter adapters communicate with each other changes as does the wiring that connects the interfaces to the associated processor control and the programming in the processor control.

As indicated above, the flowcharts illustrated in FIGS. 20 and 21 describe the operation of fuze setter adapters for converting the inductive interface of a legacy fuze setter to a direct-connect electrical interface on a fuze, and vice versa. As a general concept (see FIG. 22), the fuze setter adapters serve as intermediary devices which allow a fuze setter to communicate with a fuze where the interfaces of the fuze setter and the fuze are incompatible. Interface incompatibility may include any or all of a mechanical interface, an electrical interface, a communications interface, and/or an electrical power interface. There is no fundamental constraint that either interface needs to be inductively coupled.

The fuze setter adapter is an active adapter that provides the ability to accept, store, buffer, translate and communicate data between the two adapter regions that are coupled to otherwise incompatible fuze and fuze setter. The fuze setter adapter may be powered directly from the fuze setter or from an external host, and may also communicate with an external host. In some cases, the fuze may be powered by an internal battery and therefore would not require power from the fuze setter. In this case, the adapter would only need to support communications between fuze and fuze setter.

Figure 22:
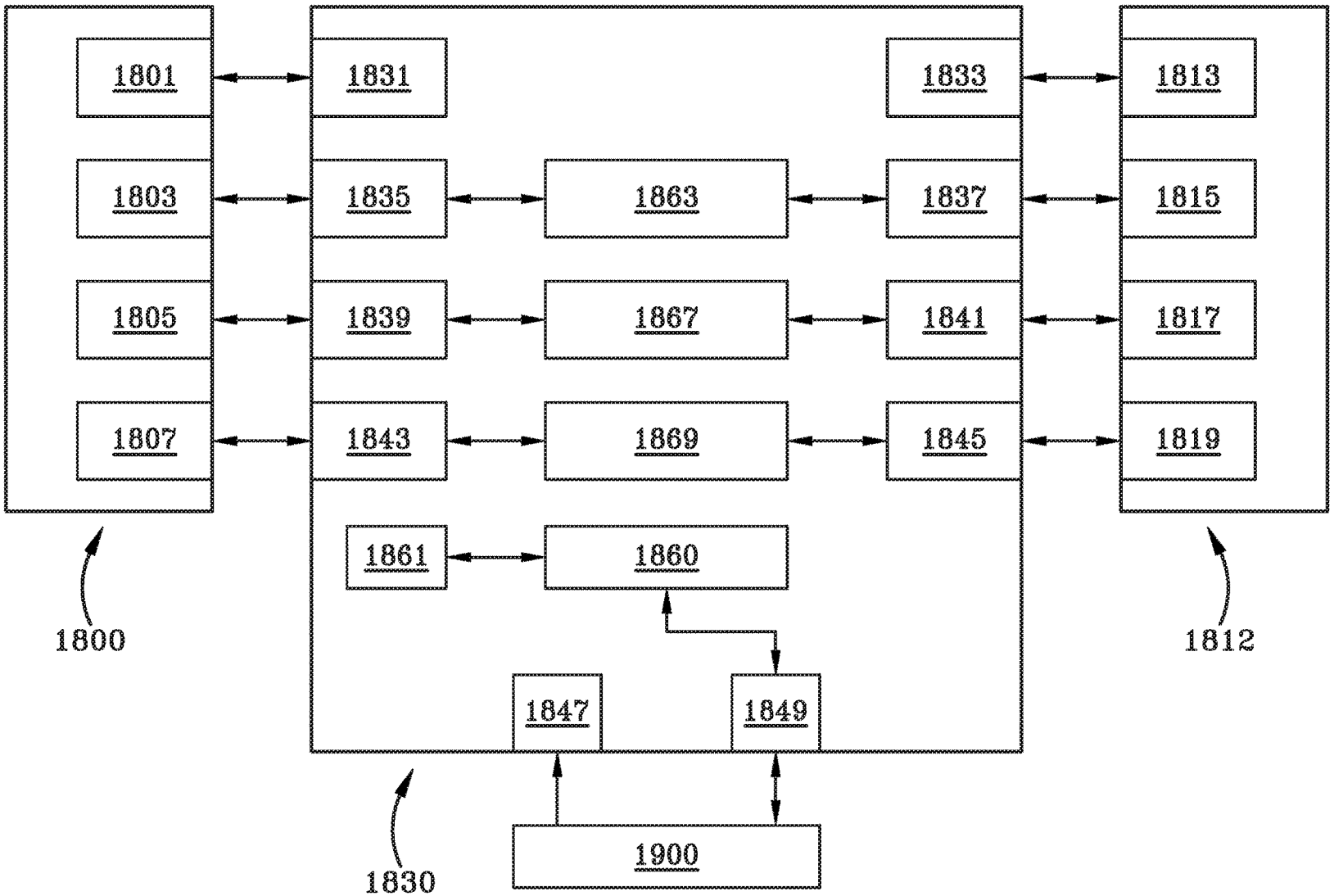
FIG. 22 is a flowchart depicting the operation of a fuze and a fuze setter that are inherently incompatible with each other, and a universal fuze setter adapter in accordance with the present disclosure that is configured to operationally engage the incompatible fuze and fuze setter to each other.

FIG. 22 is a flowchart depicting the operation of a generalized or universal FSA 1830 that is utilized to operationally engage and incompatible fuze 1800 and fuze setter 1812 with each other. The flowchart illustrates the exemplary FSA 1830 in accordance with the present disclosure that is configured to mate with each of fuze 1800 and fuze setter 1812. FSA 1830 is further configured to communicate with each of fuze 1800 and fuze setter 1830 and to thereby establish connection between the communications and electrical power interfaces of fuze 1800 and fuze setter 1812 that enables a fuze setting operation to occur. FSA 1830 is an active adapter that provides all interface translations and conversions necessary to allow communications and electrical power transfer between fuze 1800 and an otherwise incompatible fuze setter 1812.

Fuze 1800 includes a mechanical interface 1801, an electrical signal interface 1803, an electrical power interface 1805, and a communications interface 1807. Fuze setter 1812 includes a mechanical interface 1813, an electrical signal interface 1815, an electrical power interface 1817, and a communications interface 1819.

FSA 1830 provides mechanical interfaces 1831, 1833. The first mechanical interface 1831 is compatible with mechanical interface 1801 of fuze 1800. The second mechanical interface 1832 is compatible with mechanical interface 1813 of fuze setter 1812.

FSA 1830 provides electrical signal interfaces 1835, 1837. These interfaces provide the ability to communicate information between fuze 1800 and fuze setter 1812 via discrete electrical signals. The first electrical signal interface 1835 is compatible with electrical signal interface 1803 of fuze 1800 and the second electrical signal interface 1837 is compatible with electrical signal interface 1815 of fuze setter 1812. Signal conversion electronics 1863 within FSA 1830 convert a set of electrical signals from the fuze setter 1812 to a corresponding set of electronics compatible with fuze 1800, and vice versa.

FSA 1830 additionally provides electrical power interfaces 1839, 1841 and electrical power conversion functions 1867 between fuze setter 1812 and fuze 1800. A first of these electrical power interfaces 1839 is compatible with electrical power interface 1805 of fuze 1800 and the second electrical power interface 1841 is compatible with electrical power interface 1817 of fuze setter 1812. Power conversion electronics 1867 within FSA 1830 convert input power from fuze setter 1812 into a form compatible with fuze 1800 and provide that converted power to the fuze interface 1805.

The communications interface of FSA 1830 also provides communication interfaces 1843, 1845 and communication translation 1869 between fuze setter 1812 and fuze 1800. A first communications interface 1843 is compatible with the communications interface 1807 of fuze and the second communications interface 1845 is compatible with the communications interface 1819 of fuze setter 1812. Translation includes, for example, any message format, data rate, data content, and data format conversions that may be necessary to allow compatible communications between fuze 1800 and fuze setter 1812. In other words, translation includes any elements that will allow communication between a fuze setter and an incompatible fuze. The translation software utilized for translation is the software resident in FSA 1830 that serves to translate messages and data received by a first of the two communications interfaces 1843, 1845 into a format compatible with communication with a second of the two communications interfaces provided by FSA 1830, and vice versa.

FSA 1830 can include interfaces to an external host 1900. The interfaces can include an external host electrical power interface 1847 and an external host communications interface 1849. The electrical power interface 1847 may be used to extract power from the host 1900 that can be used to power the FSA 1830, fuze setter 1812, and/or fuze 1800. The communications interface 1847 may be used for host-to-fuze setter adapter communications, and for host-to-fuze setter and/or host-to-fuze communications via FSA 1830. Communications interface 1847 may receive communications and data signals from the external host 1900 or may transmit communications and data signals to the external host 1900. Connecting FSA 1830 to external host 1900 such as a remote computer) will allow fuze setting and other operations to be monitored and controlled via the host 1900.

FSA 1830 includes a processor control 1860 having a memory 1861. Processor control 1860 is connected to all of the internal functional blocks of FSA 1830 as necessary, i.e., with the mechanical interfaces 1831, 1833; the electrical signal interfaces 1835, 1837; the electrical power interfaces 1839, 1841; and the communications interfaces 1843, 1845. Processor control 1860 is also connected to communications interface 1849 and electrical power interface 1847 that are selectively operatively engaged with remote external host 1900. Processor control 1860 includes programming that operatively engages the systems of fuze and fuze setter with each other and enables fuze setting to occur. It will be understood that each of the processor controls disclosed herein perform substantially the same function in the fuze setter adapters within which they are located.

Processor control 1860 is capable of electrical signal conversion 1863. In other words processor control 1860 is able to take an electrical signal received by interface 1837 of FSA 1830 from electrical signal interface 1815 of fuze setter 1812 and, using the electrical signal conversion function 1863 of processor control 1860, convert that electrical signal to one compatible for electrical signal interface 1803 of fuze 1800. Processor control 1860 then sends the converted electrical signal to electrical signal interface 1803 of fuze 1800 via electrical signal interface 1835 of FSA 1830. The reverse situation is also true in that processor control 1860 is able to take an electrical signal received by electrical signal interface 1835 of FSA 1830 from electrical signal interface 1803 of NGF 200 and, using the electrical signal conversion function 1863 of processor control 1860, convert that electrical signal to one compatible for electrical signal interface 1817 of fuze setter 1812. Processor control 1860 then sends the converted electrical signal to electrical signal interface 1817 of fuze setter 1812 via electrical signal interface 1837 of FSA 1830.

Processor control 1860 is capable of performing an electrical power conversion 1865. In other words, processor control 1860 is able to take electrical power received by electrical power interface 1841 of FSA 1830 from electrical power interface 1817 of fuze setter 1812 and, using the electrical power conversion function 1865 of processor control 1860, convert that electrical power to a power signal that is compatible with electrical power interface 1805 of fuze 1800. Processor control 1860 then sends the converted electrical power signal to electrical power interface 1805 of fuze 1800 via electrical power interface 1839 of FSA 1830. The reverse situation is also true in that processor control 1860 is able to take electrical power received by electrical power interface 1839 of FSA 1830 from electrical power interface 1805 of fuze 1800 and, using the electrical power conversion function 1865 of processor control 1860, convert that electrical power to a power signal that is compatible with electrical power interface 1817 of fuze setter 1812. Processor control 1860 then sends the converted electrical power signal to electrical power interface 1817 of fuze setter 1812 via electrical power interface 1841 of FSA 1830.

Processor control 1860 is also capable of performing a communications conversion function and/or a communications translation function. Processor control 1860 also has memory that enables data buffering 1869. In other words, processor control 1860 is able to take communications or data received by communications interface 1845 from communications interface 1819 of fuze setter 1812 and, using the communication conversion/translation/data buffering function 1869 of processor control 1860, convert the communications or data signal to one compatible for communications interface 1807 of fuze 1800. Processor control 1860 will then send the converted communications signal from communications interface 1843 of FSA 1830 to communications interface 1807 of fuze 1800. Bidirectional communication is also possible in some instances. In these instances, communications or data signals from communications interface 1807 of fuze 1800 may be received by communications interface 1843 of FSA 1830 and converted by the communications conversion/translation/data buffering function 1869 of processor control 1860 to a signal compatible with communications interface 1819 of fuze setter 1812. That converted communications or data signal is sent to communications interface 1819 of fuze setter 1812 via communications interface 1845 of FSA 1830. In either instance, memory 1861 of processor control 1860 can be used for data buffering. This arrangement allows data to be received at one rate from communications interface 1807, for example, and is able to be transmitted at a different rate to communications interface 1819, and vice versa.

Figure 23A:
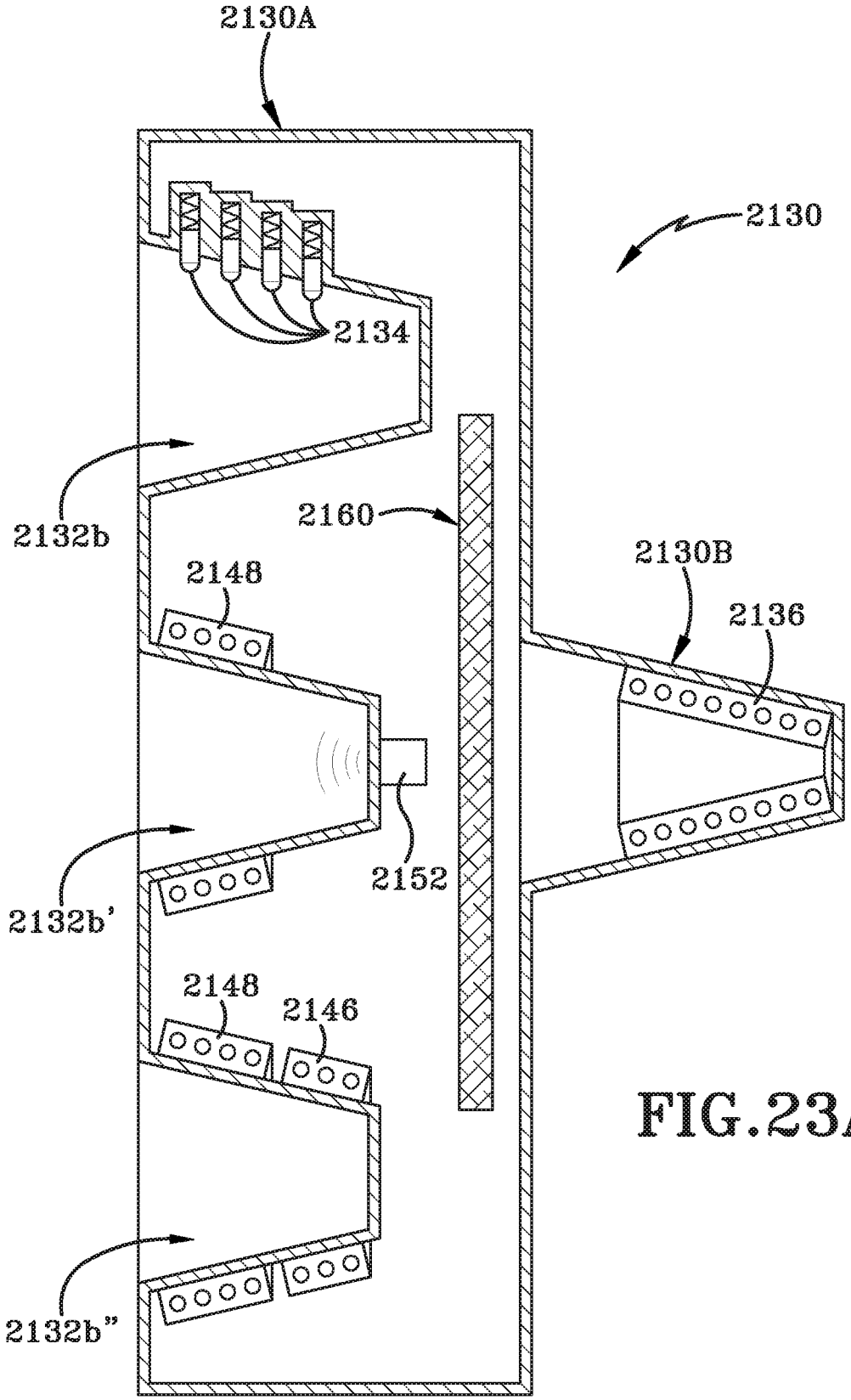
FIG. 23A is a diagrammatic longitudinal section of a twenty-fifth embodiment of a fuze setter adapter in accordance with the present disclosure that is able to operatively engage multiple different fuzes to a single type of fuze setter.
Figure 23B:
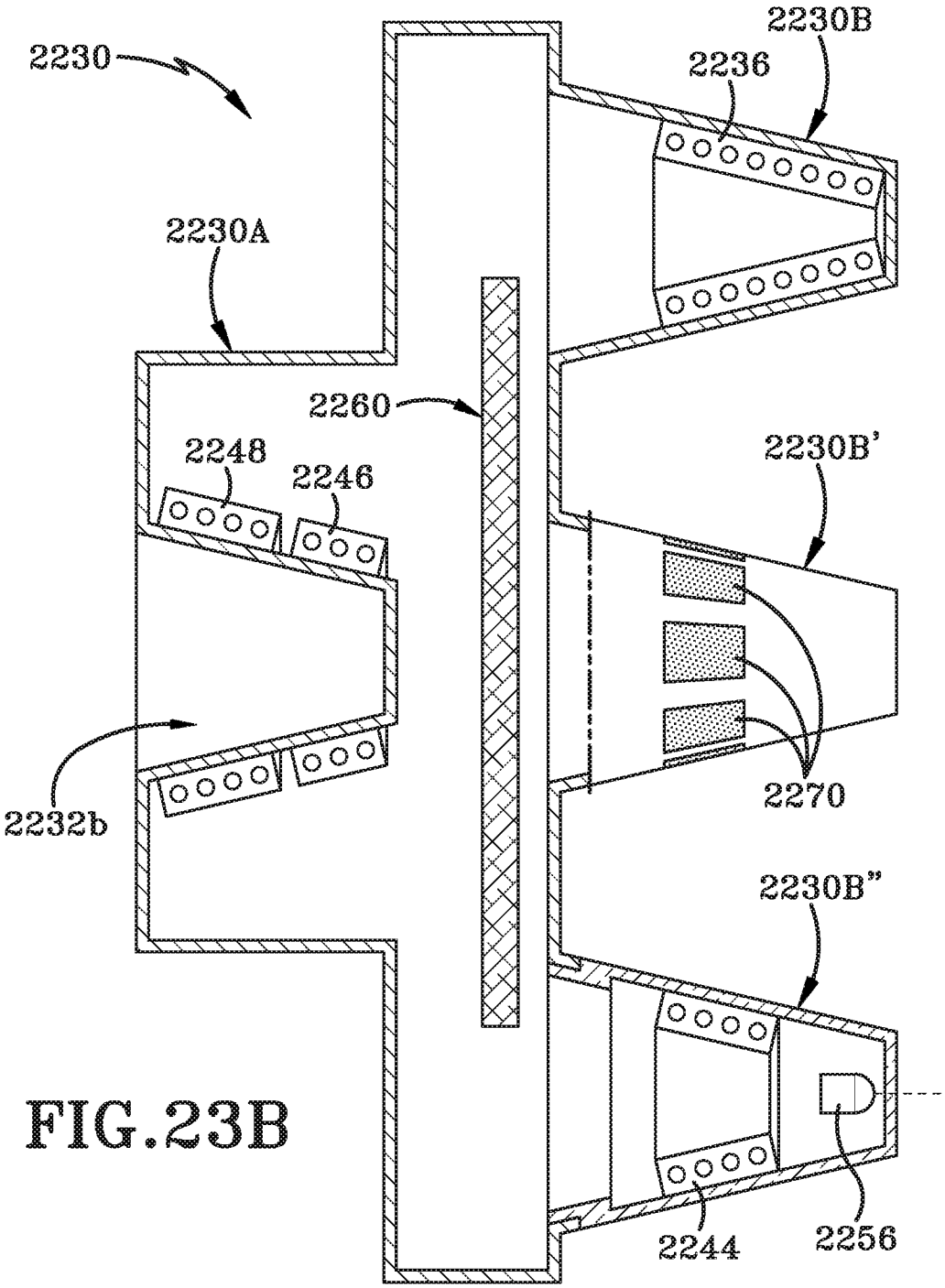
FIG. 23B is a diagrammatic longitudinal section of a twenty-sixth embodiment of a fuze setter adapter in accordance with the present disclosure that is able to operatively engage a single type of fuze with multiple different fuze setters.
Figure 23C:
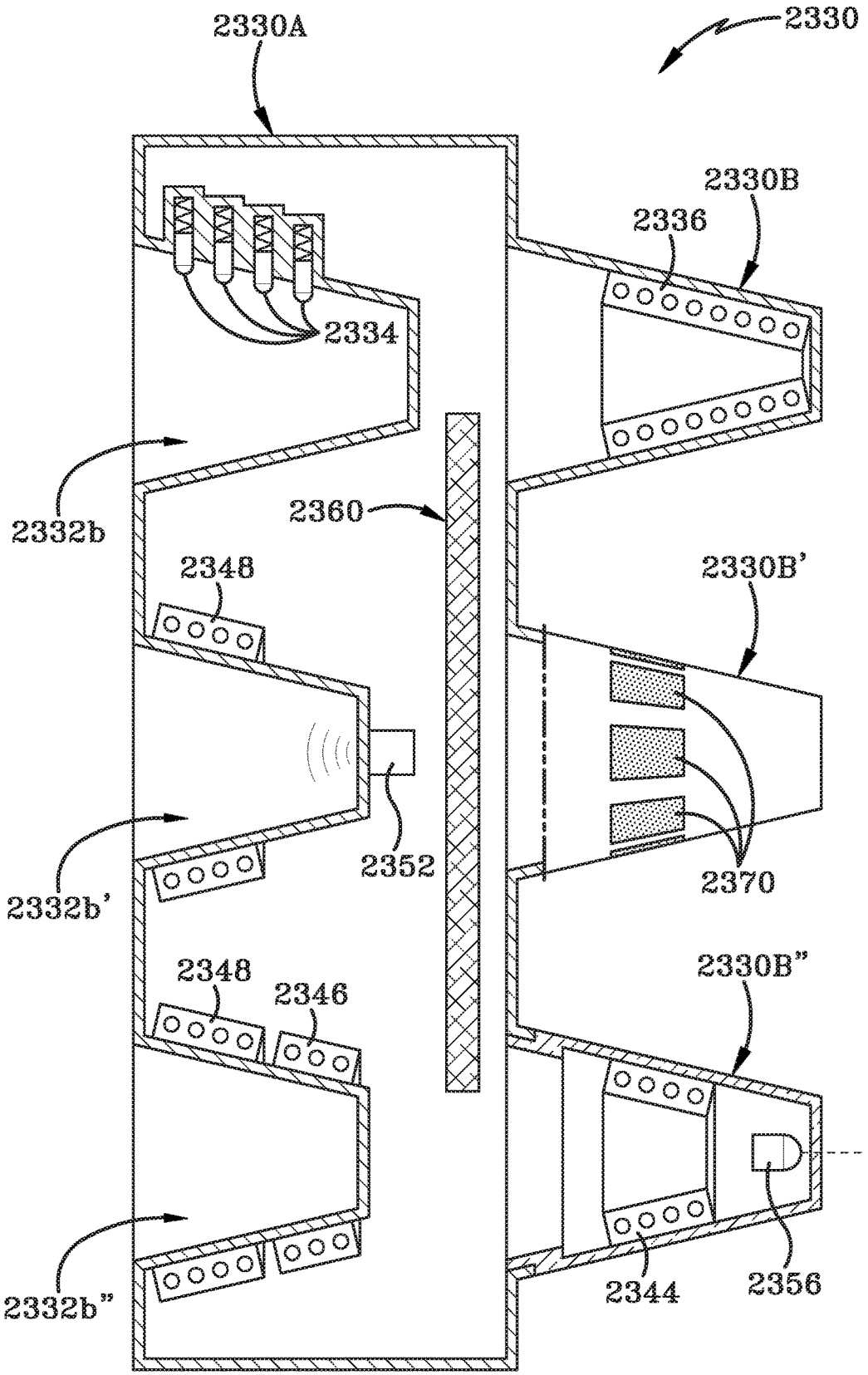
FIG. 23C is a diagrammatic longitudinal section of a twenty-seventh fuze setter adapter in accordance with the present disclosure that is able to operatively engage multiple different fuzes to multiple different fuze setters.

FIGS. 23A through 23C provide examples of fuze setter adapters that are utilized to enable multiple fuzes and/or fuze setters to be engaged with each other. FIG. 23A shows a twenty-fifth embodiment FSA 2130 in accordance with the present disclosure. FSA 2130 includes a first region 2130A configured to engage with a fuze and a second region 2130B configured to engage with a fuze setter. FSA 2130 includes a housing that defines multiple ports for engaging fuzes. Three exemplary ports 2132*b*, 2132*b*', and 2132*b*" are shown in FIG. 23A. Each of the ports is configured to be able to receive a different type of fuze. The first port 2132*b* is illustrated as including a plurality of contact pins 2134 arranged in such a manner as to be suitable for communication with FS 100 shown in FIG. 4A. The second port 2132*b*' is illustrated as including an induction coil 2148 and a RF transceiver 2152 arranged in such a manner as to be suitable for communication with FS 800 shown in FIG. 13. The third port 2132*b*" is illustrated as including two induction coils 2146, 2148 arranged in such as manner as to be suitable for communication with FS 700 shown in FIG. 12A. FSA 2130 includes a single connector region 2130B that is configured to include an induction coil 2136 suitable for communication with LFS 12 (FIG. 1). Each of the ports 2132*b*, 2132*b*', and 2132*b*", as well as induction coil 2136 is operatively engaged by wiring (not shown) to processor control 2160. (It will be understood that while a single processor control 2160 is illustrated, more than one processor control may be provided in FSA 2130 to control different interfaces.) FSA 2130 is therefore able to be utilized as a type of "universal" fuze setter adapter that can be taken into the field and used to perform fuze setting operations on a variety of different munitions. The port selected for use will be based on the particular fuze that needs to be programmed.

As illustrated by way of example only, second region 2130B of FSA 2130 is configured to be engaged with LFS 12 (FIG. 1). It will be understood, however, that any of the configurations of second regions of the fuze setter adapters disclosed in this specification may be utilized, or any other differently configured second region may be provided on FSA 2130.

It should be understood that although the various ports 2132*b*, 2132*b*', and 2132*b*" are shown in FIG. 23A as all being enclosed within a single housing, in another embodiment, one or more of the ports 2132*b*, 2132*b*' and 2132*b*" may comprise separate components that are located outside of the housing and are connected thereto by way of a suitable electrical cable. FSA 2130 will therefore comprise a central housing containing at least the processor 2160 plus one or more electrical cables connected to the processor 2160 and extending outwardly from the housing, and terminating in one of the various port configurations. It will be understood that in one exemplary embodiment, the connector region 2130B may additionally or alternatively form part of a separate component that is connected by a suitable electrical cable to processor 2160, where the cable extends outwardly from the housing and terminates in the separate connector region component.

FIG. 23B shows a twenty-sixth embodiment FSA 2230 in accordance with the present disclosure. FSA 2230 includes a first region 2230A configured to engage with a fuze and a second region configured to engage with a fuze setter. FSA 2230 includes a housing that defines a single port for engaging a fuze. Port 2232*b* is configured to include two induction coils 2248, 2246 suitable for communication with NGF 700 (FIG. 12A). Three exemplary connector regions 2230B, 2230B', and 2230B" are provided on FSA 2230. Each of the connector regions is configured to be able to engage a different type of fuze setter. The first connector region 2230B is illustrated as including an induction coil 2236 arranged in such a manner as to be suitable for communication with LFS 12 (FIG. 1). The second connector region 2230B' is illustrated as including a plurality of contact pads 2270 arranged in such a manner as to be suitable for communication with FS 1202V (FIG. 17A). The third connection region 2230B" is illustrated as including an induction coil 2244 and an optical transceiver 2258. The third connection region 2230B" is arranged in such as manner as to be suitable for communication with FS 1302Y shown in FIG. 17I. Each of the connector regions 2230B, 2230B', and 2230B", as well as induction coils 2246 and 2248 are operatively engaged by wiring (not shown) to processor control 2260. (It will be understood that while a single processor control 2260 is illustrated, more than one processor control may be provided in FSA 2230 to control different interfaces.) FSA 2230 is therefore able to be utilized as a type of "universal" fuze setter adapter that can be taken into the field and used to perform fuze setting operations on one type of fuze using an appropriate one of a variety of different fuze setters. The connector region selected for use will be based on the particular fuze setter that is available to perform fuze setting.

It will be understood that any number of connector regions may be provided on FSA 2230 to engage with any desired number of different fuze setters. It will further be understood that any of the configurations of the connector regions disclosed in this specification or any other desired configuration of the connector region, may be utilized in FSA 2230. The one direct connect connector region (2230B') and the two wireless connector regions (2230B and 2230B") illustrated herein are exemplary only.

As illustrated by way of example only, first region 2230A of FSA 2230 is configured to be engaged with NGS 100 (FIG. 4A). It will be understood, however, that any of the configurations of first regions of the fuze setter adapters disclosed in this specification may be utilized, or any other differently configured first region may be provided on FSA 2230.

It should be understood that although the various connector regions 2230B, 2230B', and 2230B" are shown in FIG. 23B as all being enclosed within a single housing, in another embodiment, one or more of the connector regions may comprise separate components that are located outside of the housing and are connected thereto by way of a suitable electrical cable. FSA 2230 will therefore comprise a central housing containing at least the processor 2260 plus one or more electrical cables connected to the processor 2260 and extending outwardly from the housing, and terminating in one of the various connector region configurations. It will be understood that in one exemplary embodiment, the port 2232*b* may additionally or alternatively form part of a separate component that is connected by a suitable electrical cable to processor 2260, where the cable extends outwardly from the housing and terminates in the separate connector region component.

FIG. 23C shows a twenty-seventh FSA 2330 in accordance with the present disclosure. FSA 2330 includes a first region 2330A configured to engage with various fuzes and a second region configured to engage with various fuze setters. FSA 2330 includes a housing that defines multiple ports 2332*b*, 2332*b*' and 2332*b*" for engaging different fuzes. Ports 2332*b*, 2332*b*', and 2332*b*" are substantially identical to ports 2132*b*, 2132*b*', and 2132*b*" and are used for the same purpose. FSA 2330 also multiple exemplary connector regions 2330B, 2330B', and 2330B". Connector regions 2330B, 2330B' and 2330B" are substantial identical to connector regions 2230B, 2230B', and 2230B" and are used for the same purpose. All of the ports 2332*b*, 2332*b*', and 2332*b*" and all of the connector regions 2330B, 2330B', and 2330B" are operatively engaged with processor control 2360 (or with multiple processor controls) via wiring that is not illustrated.

FSA 2330 is able to be utilized as a type of "universal" fuze setter adapter that can be taken into the field and used to perform fuze setting operations on multiple different types of fuzes using an appropriate one of any of a variety of different fuze setters provided on FSA 2330. The port or connector region selected for use will be based on the particular fuze or particular fuze setter that is available.

It will be understood that any number of ports and connector regions may be provided on FSA 2330 to engage with any desired number of different fuzes and fuze setters. It will further be understood that any of the configurations of the ports and/or connector regions disclosed in this specification or any other desired configuration of ports and connector regions, may be utilized in FSA 2330. The illustrated ports and connector regions are exemplary only.

It should be understood that although the various ports 2332*b*, 2332*b*', and 2332*b*" and connector regions 2330B, 2330B', and 2330B" are shown in FIG. 23C as all being enclosed within a single housing, in another embodiment, one or more of the ports 2332*b*, 2332*b*' and 2332*b*" and/or one or more of the connector regions 2330B, 2330B', and 2330B" may comprise separate components that are located outside of the housing and are connected thereto by way of a suitable electrical cable. FSA 2330 will therefore comprise a central housing containing at least the processor 2360 plus one or more electrical cables connected to the processor 2360 and extending outwardly from the housing, and terminating in one of the various port configurations or one of the various connector region configurations.

Figure 24:
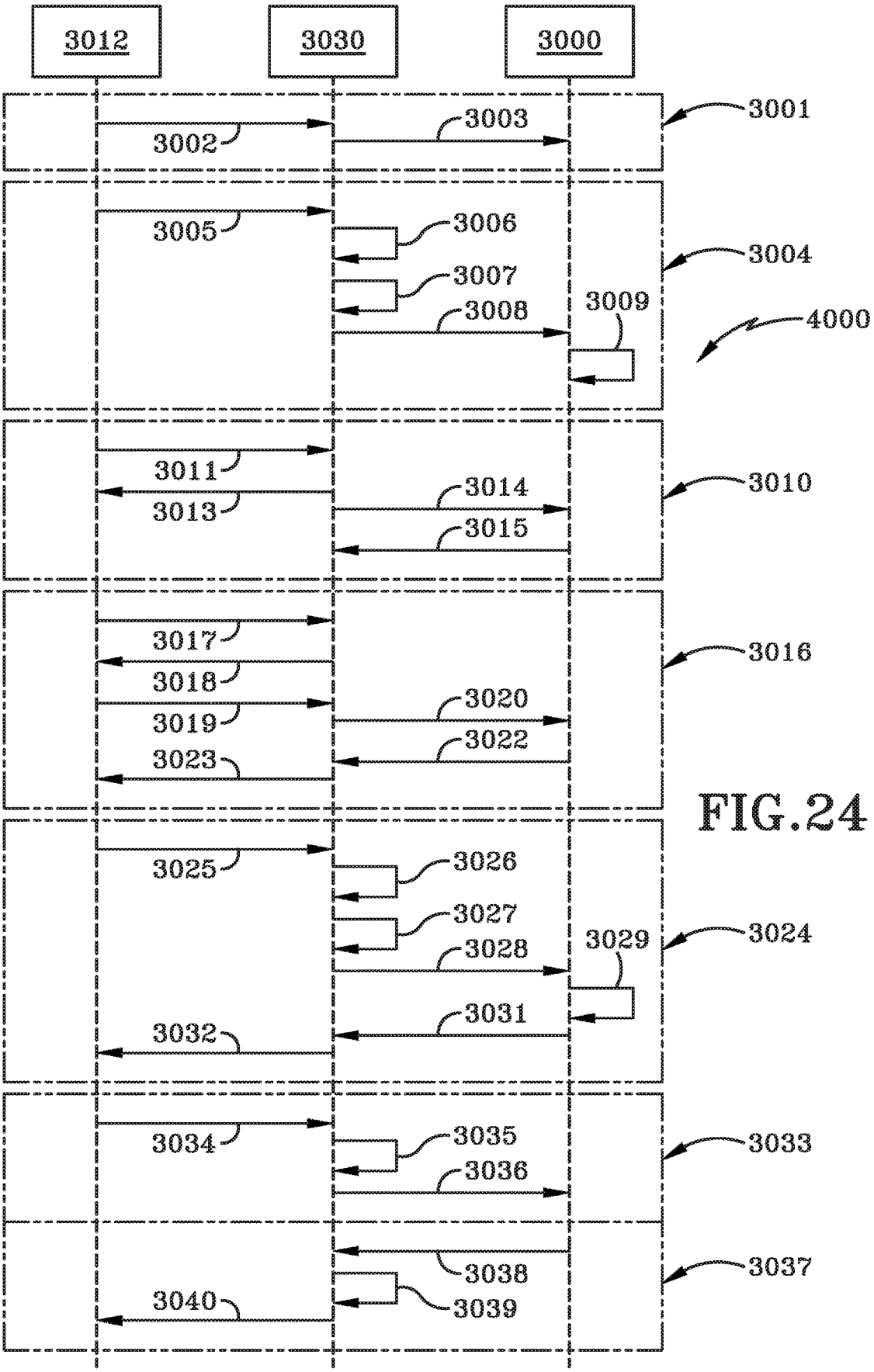
FIG. 24 is a flowchart showing a fuze setting operation.

Referring to FIG. 24 there is shown a flowchart of an exemplary method 4000 of utilizing a fuze setting system comprising a NGF 3000, an incompatible fuze setter 3012 (hereafter FS 3012), and a FSA 3030 to perform a fuze setting operation. It should be noted that this flowchart is simplified. In practice, there would be a lot of detailed interaction between NGF 3000, FSA 3030, and FS 3012. For example, most actions taken would include a validity check to ensure that each action requested was executed successfully, e.g. communications were established, data was received and transferred successfully etc. This type of action has been omitted from the figure. Additionally, every one of the aforementioned checks anticipates the possibility of a fault or failure. Specific actions, also not shown in this figure, would be taken in the event of a fault or failure condition. Similarly, the figure shows things happening in a sequence. However, in practice, based on the design, certain activities may happen concurrently, e.g. electrical power and data conversion may occur concurrently.

As illustrated in the figure, a first step 3001 involves connecting FSA 3030 to NGF 3000 and FS 3012. This is accomplished by attaching FS 3012 to FSA 3030 as indicated by arrow 3002 and attaching FSA 3030 to NGF 3000 as indicated by arrow 3003.

In a second step 3004, electrical power is applied and the fuze setter adapter processor (in the processor control) and the fuze processor (not shown) will boot up and initialize. This is accomplished by applying electrical power to FSA 3030 indicated by arrow 3005. The fuze setter adapter processor boots up as indicated by arrow 3006. FSA 3030 generates fuze-compatible electric power, indicated by arrow 3007. FSA 3030 applies electrical power to NGF 3000, indicated by arrow 3008, and the fuze processor boots up 3009. (FSA 3030 will apply electrical power to NGF 3000 via the electrical power interfaces provided on FSA 3030 and NGF 3000.)

In a third step 3010, communications between FS 3012, FSA 3030, and NGF 3000 are established. This is accomplished by establishing communications between FS 3012 and FSA 3030, indicated by arrow 3011, and the FSA 3030 reporting back to the FS 3012 verification that fuze setter-to-fuze setter adapter communications have been established, as indicated by arrow 3013. The third step also includes establishing communications between FSA 3030 and NGF 3000, indicated by arrow 3014, and reporting confirmation that fuze setter adapter-to-fuze communication has been established, indicated by arrow 3015.

In a fourth step 3016, the FS 3012 checks the status of FSA 3030 and NGF 3000, and verifies they are good to go. This is accomplished by the FS 3012 requesting the fuze setter adapter status, indicated by arrow 3017, and the fuze setter adapter reporting its status, indicated by arrow 3018. The FS 3012 then requests the fuze status, indicated by arrow 3019, which causes FSA 3030 to request the fuze status 3020. In other words, the request for fuze status is transferred from the FS 3012 to NGF 3000 via FSA 3030. NGF 3000 reports the fuze status, indicated by arrow 3022, and the fuze setter adapter reports the fuze status to the fuze setter, indicated by arrow 3023. In other words, the fuze status report is transferred from NGF 3000 to the FS 3012 via FSA 3030.

In a fifth step 3024, fuze setting data is transferred from the FS 3012 to FSA 3030 and then from FSA 3030 to NGF 3000. NGF 3000 reports its Data Received status back to the fuze 3012 via FSA 3030. It will be understood that the data in question may be any type of data but generally will fall into one of two major categories. The data could be fuze setting data that needs to be programmed into NGF 3000 prior to launch of the projectile with which fuze is engaged, or it could be new software/firmware load for reprogramming NGF 3000. The FS 3012 transfers fuze data to FSA 3030, indicated by arrow 3025. FSA 3030 decodes data from FS 3012 and stores the decoded data in memory of the processor control in FSA 3030, indicated by arrow 3026.

FSA 3030 reads data from memory and encodes it in fuze-compatible format, indicated by arrow 3027 and then transfers fuze data to NGF 3000, indicated by arrow 2028. NGF 3000 processes and stores received data as necessary, indicated by arrow 3029. NGF 3000 reports data received status to FSA 3030, indicated by arrow 3031. The FSA 3030 reports fuze data received status to FS 3012, indicated by arrow 3032.

In a sixth step 3033, FS 3012 sends a discrete electrical signal to NGF 3000 via FSA 3030. This is accomplished by FS 3012 sending a discrete electrical signal to FSA 3030, indicated by arrow 3034. FSA 3030 converts the fuze setter discrete electrical signal to fuze-compatible format, indicated by arrow 3035, and sends the converted fuze setter discrete electrical signal to NGF 3000, indicated by arrow 3036. It will be understood that in practice, there may be more than one discrete electrical signal, with each of the more than one discrete electrical signals operating independently.

In a seventh step 3037, the FS 3012 receives a discrete electrical signal from NGF 3000 via FSA 3030. This is accomplished by NGF 3000 sending a fuze discrete electrical signal to FSA 3030, indicated by arrow 3038. FSA 3030 converts the fuze discrete electrical signal to a fuze setter-compatible format, indicated by arrow 3039. FSA 3030 then sends the converted fuze discrete electrical signal to FS 3012, indicated by arrow 3040. It will be understood that in practice, there may be more than one discrete electrical signal, with each of the more than one discrete electrical signals operating independently.

FIG. 24 applies to the fuze setting operation of all of the fuze setting systems disclosed herein, i.e., to all of the various systems that includes a fuze, an incompatible fuze setter, and a fuze setter adapter in accordance with the present disclosure, where the fuze setter adapter is utilized to resolve the incompatibility between the fuze and fuze setter.

It will be understood that a fuze setting system in accordance with the present disclosure may include a plurality of fuzes that have different interfaces for one of communications and electric power transfer. The plurality of fuzes may include LF 10, and any of the disclosed next generation fuzes, such as fuzes 100 and 700. Each of these plurality of fuzes 10, 100, 700 is capable of being interfaced with the same fuze setter (i.e., a common fuze setter) such as LFS 12, simply by providing a fuze setter adapter that makes the plurality of fuzes 10, 100, 700 compatible with the common fuze setter (i.e., LFS 12). The second region of the fuze setter adapter will be substantially identical since it is required to matingly engage with and communicate with the common fuze setter 12. The first region of the fuze setter adapter will be different in order to enable the fuze setter adapter to matingly engage with and communicate with the differently configured plurality of fuzes 10, 100, 700.

It will be understood that a fuze setting system in accordance with the present disclosure may include a plurality of fuze setters that have different interfaces for one of communications and electric power transfer. The plurality of fuze setters may include LFS 12, NGFS 102, and NGFS 102A, for example. Each of these plurality of fuze setters 12, 102, 102A is capable of being interfaced with the same fuze (i.e., a common fuze) such as NGF 700, simply by providing a fuze setter adapter that makes NGF 700 compatible with any particular fuze setter e.g. 12, 102. The first region of the fuze setter adapter will be substantially identical since it is required to matingly engage with and communicate with the common NGF 700. The second region of the fuze setter adapter will be different in order to enable the fuze setter adapter to matingly engage with and communicate with the differently configured plurality of fuze setters 12, 102, 102A.

The fuze setter adapter concept proposed herein is applicable to any munitions application where there may be a need to program a fuze with an otherwise incompatible fuze setter. The fuze setter adapter concept is contemplated to be utilized across platforms, whereby a fuze setter designed for a particular munition fuze may be used to program fuzes for different munitions. Conversely, fuze setter adapters can allow a fuze to be programmed by fuze setters not originally intended to program that particular fuze. For example, a fuze for a mortar round could be programmed using a fuze setter designed for a different artillery projectile, e.g., a 155 mm projectile. The fuze setter adapter provides flexibility to the field by extending the versatility of fuzes to be programmed by otherwise incompatible fuze setters and vice versa.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented in software, the software code or instructions can be executed on any suitable processor or collection of processors, whether provided in a single computer or distributed among multiple computers. Furthermore, the instructions or software code can be stored in at least one non-transitory computer readable storage medium.

Also, a computer, such as external host 1900, that is used to execute the software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format. Such computers may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

The term "logic", if used herein, includes but is not limited to hardware, firmware, software, and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. A fuze setter adapter, comprising:

a first interface adapted to couple with a fuze;

a second interface adapted to couple with a fuze setter, where the fuze setter is incompatible with the fuze; and a processor control operatively engaged with the first interface and the second interface; wherein programming provided in the processor control establishes communication between the fuze and the fuze setter and enables fuze setting to occur.

2. The fuze setter adapter according to claim 1, wherein each of the first interface and the second interface is one or more of an electrical signal interface, an electrical power interface, and a communications interface.

3. The fuze setter adapter according to claim 1, wherein each of the first interface and the second interface is one or more of a wireless interface and a direct connect interface.

4. The fuze setter adapter according to claim 3, wherein the wireless interface is one of an inductive coil, a Radio Frequency (RF) transceiver, a Height of Burst (HoB) sensor, and an optical transceiver.

5. The fuze setter adapter according to claim 3, wherein the direct connect interface is one of a contact pad, a continuous contact ring, a segmented contact ring, and a contact pin.

6. The fuze setter adapter according to claim 1, further comprising:

a first mechanical interface adapted to engage the fuze; and a second mechanical interface adapted to engage the fuze setter.

7. A fuze setting method comprising:

engaging a fuze setter adapter between a fuze setter and a fuze, where the fuze setter and the fuze are incompatible with each other;

establishing communication between the fuze setter adapter and both the fuze setter and the fuze;

transferring fuze setting data from the fuze setter to the fuze setter adapter; and transferring the fuze setting data from the fuze setter adapter to the fuze.

8. The method according to claim 7, wherein the transferring of the fuze setting data from the fuze setter to the fuze setter adapter further comprises:

encoding the fuze setting data into waveforms; and transferring the waveforms of the encoded fuze setting data from the fuze setter to the fuze setter adapter.

9. The method according to claim 8, further comprising:

receiving the waveforms of the encoded fuze setting data;

decoding the fuze setting data from the waveforms;

encoding the decoded fuze setting data into a fuze-compatible format; and transferring the fuze-compatible format of the fuze setting data from the fuze setter adapter to the fuze.

10. The method according to claim 9, further comprising:

transferring the waveforms of the encoded fuze setting data from the fuze setter to the fuze setter adapter via a first interface; and transferring the fuze-compatible format of the fuze setting data from the fuze setter adapter to the fuze via a second interface.

11. The method according to claim 7, further comprising utilizing one of a direct connect interface and a wireless interface as one or both of the first interface and the second interface.

12. The method according to claim 7, further comprising:

applying electrical power from the fuze setter to the fuze setter adapter;

generating fuze-compatible electrical power; and applying the fuze-compatible electrical power to the fuze.

13. The method according to claim 7, further comprising:

sending a discrete electrical signal from the fuze setter to the fuze setter adapter;

converting the discrete electrical signal to a fuze-compatible format; and sending the converted discrete electrical signal from the fuze setter adapter to the fuze.

14. The method according to claim 7, further comprising:

sending a fuze discrete electrical signal from the fuze to the fuze setter adapter;

converting the fuze discrete electrical signal to a fuze-setter-compatible format; and sending the converted fuze discrete electrical signal from the fuze setter adapter to the fuze setter.

15. The method according to claim 7, further comprising:

engaging the fuze with the fuze setter adapter via a first mechanical interface; and engaging the fuze setter adapter with the fuze setter via a second mechanical interface.

16. The method according to claim 7, further comprising:

utilizing programming provided in a processor control of the fuze setter adapter to perform one or more of an electrical signal conversion, a communications conversion, and a communications translation on the fuze setting data prior to transferring the fuze setting data from the fuze setter adapter to the fuze.

17. A fuze setting system, comprising:

a fuze adapted to be engaged with a projectile;

a fuze setter; wherein the fuze and the fuze setter are incompatible in at least one way that prevents fuze setting; and a fuze setter adapter configured to matingly engage with the fuze and the fuze setter; said fuze setter adapter including a processor control that establishes communication between the fuze and the fuze setter such that fuze setting occurs.

18. The fuze setting system according to claim 17, further comprising:

a fuze interface provided on the fuze;

a fuze setter interface provided on the fuze setter; wherein the fuze interface and the fuze setter interface are incompatible;

a first interface provided on the fuze setter adapter that couples with the fuze interface; and a second interface provided on the fuze setter adapter that couples with the fuze setter interface; and wherein the processor control is engaged with the first and second interface.

19. The fuze setting system according to claim 18, wherein the fuze interface, the fuze setter interface, the first interface, and the second interface are all electrical signal interfaces and the processor control enables bi-directional communication between the fuze setter and the fuze.

20. The fuze setting system according to claim 18, wherein the fuze interface, the fuze setter interface, the first interface, and the second interface are all electrical power interfaces; and the processor control enables electrical power to be transferred from the fuze setter to the fuze.

* * * * *